US008801317B2

(12) United States Patent
Pi et al.

(10) Patent No.: US 8,801,317 B2
(45) Date of Patent: Aug. 12, 2014

(54) RING BINDER MECHANISM

(75) Inventors: Jn Biao Pi, Hubei Province (CN); Chun Yuen To, Hong Kong (CN)

(73) Assignee: World Wide Stationary Mfg. Co., Ltd., Hong Kong (CN)

( * ) Notice: Subject to any disclaimer, the term of this patent is extended or adjusted under 35 U.S.C. 154(b) by 224 days.

(21) Appl. No.: 13/285,546

(22) Filed: Oct. 31, 2011

(65) Prior Publication Data

US 2012/0051830 A1 Mar. 1, 2012

Related U.S. Application Data

(62) Division of application No. 11/697,556, filed on Apr. 6, 2007, now Pat. No. 8,047,737.

(60) Provisional application No. 60/827,205, filed on Sep. 27, 2006.

(51) Int. Cl.
*B42F 13/22* (2006.01)
*B42F 13/26* (2006.01)

(52) U.S. Cl.
USPC ..... 402/30; 402/31; 402/36; 402/37; 402/38

(58) Field of Classification Search
CPC ..... B42F 13/22
USPC ..... 402/29–31, 36–39, 41–42
See application file for complete search history.

(56) References Cited

U.S. PATENT DOCUMENTS 419,160 A 1/1890 Smith
566,717 A 8/1896 Krah
621,256 A 3/1899 Krah
651,254 A 6/1900 Krah
683,019 A 9/1901 Buchanan
779,879 A 1/1905 Sheridan et al.
790,382 A 5/1905 McBride (Continued)

FOREIGN PATENT DOCUMENTS

CA 2500817 A1 9/2005
EP 1431065 A2 6/2004

(Continued)

OTHER PUBLICATIONS

Office action issued Mar. 12, 2010 in related U.S. Appl. No. 11/697,556 now issued as Patent No. 8,047,737—10 pgs.

(Continued)

*Primary Examiner* — Kyle Grabowski
(74) *Attorney, Agent, or Firm* — Senniger Powers LLP

(57) ABSTRACT

A ring binder mechanism includes a housing, a ring support, and rings for holding loose-leaf pages. Each ring includes a first ring member and a second ring member that are moveable between a closed position and an opened position. An actuator is mounted on the housing for moving the ring members from the closed position to the opened position. A travel bar has at least one locking element and is moveable between a locked position wherein the ring members are locked in the closed position and an unlocked position wherein the ring members are capable of being moved to the opened position. An intermediate connector operably connects the travel bar to the actuator. A portion of the intermediate connector is captured by and moveable with a wide section of a mounting groove in the travel bar so the intermediate connector can move relative to the travel bar.

19 Claims, 104 Drawing Sheets

(56) References Cited

U.S. PATENT DOCUMENTS

| | | | |
|---|---|---|---|
| 854,074 | A | 5/1907 | Bryant |
| 857,377 | A | 6/1907 | Baker |
| 974,831 | A | 11/1910 | Scherzinger |
| 1,011,391 | A | 12/1911 | Sturgis |
| 1,163,179 | A | 12/1915 | Schade, Jr. |
| 1,168,260 | A | 1/1916 | Albrecht |
| 1,398,034 | A | 11/1921 | Mero |
| 1,398,388 | A | 11/1921 | Murphy |
| 1,598,206 | A | 8/1926 | Lindstedt et al. |
| 1,733,548 | A | 10/1929 | Martin |
| 1,733,894 | A | 10/1929 | Martin |
| 1,787,957 | A | 1/1931 | Schade |
| 1,822,669 | A | 9/1931 | Schade |
| 1,824,791 | A | 9/1931 | Rengmann |
| 1,857,291 | A | 5/1932 | Trussell |
| 1,953,981 | A | 4/1934 | Trussell |
| 1,991,362 | A | 2/1935 | Krag |
| 1,996,463 | A | 4/1935 | Dawson et al. |
| 2,004,570 | A | 6/1935 | Dawson |
| 2,013,416 | A | 9/1935 | McClure |
| 2,024,461 | A | 12/1935 | Lotter |
| 2,067,846 | A | 1/1937 | Cooper |
| 2,075,766 | A | 3/1937 | Rand |
| 2,075,767 | A | 3/1937 | Rand |
| 2,081,372 | A | 5/1937 | Thomas |
| 2,089,211 | A | 8/1937 | Krag |
| 2,096,944 | A | 10/1937 | Unger et al. |
| 2,103,307 | A | 12/1937 | Unger |
| 2,105,235 | A | 1/1938 | Schade |
| 2,158,056 | A | 5/1939 | Cruzan |
| 2,179,627 | A | 11/1939 | Handler |
| 2,204,918 | A | 6/1940 | Trussell |
| 2,218,105 | A | 10/1940 | Griffin |
| 2,236,321 | A | 3/1941 | Ostrander |
| 2,239,062 | A | 4/1941 | Tallmadge |
| 2,239,121 | A | 4/1941 | St. Louis et al. |
| 2,251,878 | A | 8/1941 | Hanna et al. |
| 2,252,422 | A | 8/1941 | Unger |
| 2,260,929 | A | 10/1941 | Bloore |
| 2,288,189 | A | 6/1942 | Guinane |
| 2,304,716 | A | 12/1942 | Supin |
| 2,311,492 | A | 2/1943 | Unger |
| 2,322,595 | A | 6/1943 | Schade |
| 2,338,011 | A | 12/1943 | Schade |
| 2,421,799 | A | 6/1947 | Martin |
| 2,528,866 | A | 11/1950 | Dawson, Jr. |
| 2,543,866 | A | 3/1951 | Panfil, Sr. |
| 2,552,076 | A | 5/1951 | Wedge |
| 2,570,323 | A | 10/1951 | Condon et al. |
| 2,612,169 | A | 9/1952 | Segal |
| 2,789,561 | A | 4/1957 | Bonn et al. |
| 2,865,377 | A | 12/1958 | Schroer et al. |
| 2,871,711 | A | 2/1959 | Stark |
| 2,891,553 | A | 6/1959 | Acton |
| 2,894,513 | A | 7/1959 | Gempe et al. |
| 2,950,719 | A | 8/1960 | Lyon |
| 3,077,888 | A | 2/1963 | Thieme |
| 3,098,489 | A | 7/1963 | Vernon |
| 3,098,490 | A | 7/1963 | Wance |
| 3,101,719 | A | 8/1963 | Vernon |
| 3,104,667 | A | 9/1963 | Mintz |
| 3,149,636 | A | 9/1964 | Rankin |
| 3,190,293 | A | 6/1965 | Schneider et al. |
| 3,205,894 | A | 9/1965 | Rankin |
| 3,205,895 | A | 9/1965 | Johnson |
| 3,255,759 | A | 6/1966 | Dennis |
| 3,348,550 | A | 10/1967 | Wolf et al. |
| 3,718,402 | A | 2/1973 | Schade |
| 3,748,051 | A | 7/1973 | Frank |
| 3,884,586 | A | 5/1975 | Michaelis et al. |
| 3,954,343 | A | 5/1976 | Thomsen |
| 3,993,374 | A | 11/1976 | Schudy et al. |
| 4,127,340 | A | 11/1978 | Almgren |
| 4,130,368 | A | 12/1978 | Jacoby et al. |
| 4,222,679 | A | 9/1980 | Luogameno |
| 4,352,582 | A | 10/1982 | Eliasson |
| 4,486,112 | A | 12/1984 | Cummins |
| 4,522,526 | A | 6/1985 | Lozfau et al. |
| 4,566,817 | A | 1/1986 | Barrett, Jr. |
| 4,571,108 | A | 2/1986 | Vogl |
| 4,690,580 | A | 9/1987 | Kissel |
| 4,696,595 | A | 9/1987 | Pinkney |
| 4,798,491 | A | 1/1989 | Lassle |
| 4,813,803 | A | 3/1989 | Gross |
| 4,815,882 | A | 3/1989 | Ohminato |
| 4,886,390 | A | 12/1989 | Silence et al. |
| 4,919,557 | A | 4/1990 | Podosek |
| 5,067,840 | A | 11/1991 | Cooper et al. |
| 5,116,157 | A | 5/1992 | Gillum et al. |
| 5,135,323 | A | 8/1992 | Pinheiro |
| 5,180,247 | A | 1/1993 | Yu |
| 5,255,991 | A | 10/1993 | Sparkes |
| 5,286,128 | A | 2/1994 | Gillum |
| 5,332,327 | A | 7/1994 | Gillum |
| 5,346,325 | A | 9/1994 | Yamanoi |
| 5,354,142 | A | 10/1994 | Yu |
| 5,368,407 | A | 11/1994 | Law |
| 5,378,073 | A | 1/1995 | Law |
| 5,393,155 | A | 2/1995 | Ng |
| 5,393,156 | A | 2/1995 | Mullin et al. |
| 5,476,335 | A | 12/1995 | Whaley |
| 5,524,997 | A | 6/1996 | von Rohrscheidt |
| 5,577,852 | A | 11/1996 | To |
| 5,634,666 | A | 6/1997 | Lee |
| 5,651,628 | A | 7/1997 | Bankes et al. |
| 5,660,490 | A | 8/1997 | Warrington |
| 5,692,847 | A | 12/1997 | Zane et al. |
| 5,692,848 | A | 12/1997 | Wada |
| 5,718,529 | A | 2/1998 | Chan |
| 5,782,569 | A | 7/1998 | Mullin et al. |
| 5,788,392 | A | 8/1998 | Cheung |
| 5,807,006 | A | 9/1998 | Cheung |
| 5,810,499 | A | 9/1998 | Law |
| 5,816,729 | A | 10/1998 | Whaley |
| 5,836,709 | A | 11/1998 | Cheung |
| 5,868,513 | A | 2/1999 | Law |
| 5,879,097 | A | 3/1999 | Cheng |
| 5,882,135 | A | 3/1999 | Ko |
| 5,895,164 | A | 4/1999 | Wu |
| 5,924,811 | A | 7/1999 | To et al. |
| 5,957,611 | A | 9/1999 | Whaley |
| 5,975,785 | A | 11/1999 | Chan |
| 6,036,394 | A | 3/2000 | Cheng |
| 6,142,697 | A | 11/2000 | Williams |
| 6,146,042 | A | 11/2000 | To et al. |
| 6,155,737 | A | 12/2000 | Whaley |
| 6,203,229 | B1 | 3/2001 | Coerver |
| 6,206,601 | B1 | 3/2001 | Ko |
| 6,217,247 | B1 | 4/2001 | Ng |
| 6,270,279 | B1 | 8/2001 | Whaley |
| 6,276,862 | B1 | 8/2001 | Snyder et al. |
| 6,293,722 | B1 | 9/2001 | Holbrook et al. |
| 6,364,558 | B1 | 4/2002 | To |
| 6,371,678 | B1 | 4/2002 | Chizmar |
| 6,467,984 | B1 | 10/2002 | To |
| 6,474,897 | B1 | 11/2002 | To |
| 6,533,486 | B1 | 3/2003 | To |
| 6,749,357 | B2 | 6/2004 | Cheng |
| 6,758,621 | B2 | 7/2004 | To |
| 6,821,045 | B2 | 11/2004 | Whaley |
| 6,840,695 | B2 | 1/2005 | Horn |
| 6,916,134 | B2 | 7/2005 | Wong |
| 7,223,040 | B2 | 5/2007 | Koike et al. |
| 7,275,886 | B2 | 10/2007 | Cheng |
| 7,296,946 | B2 | 11/2007 | Cheng et al. |
| 7,404,685 | B2 | 7/2008 | Cheng |
| 7,478,963 | B2 | 1/2009 | Tanaka et al. |
| 7,491,006 | B2 | 2/2009 | Whaley |
| 7,524,127 | B2 | 4/2009 | Petrie et al. |
| 7,524,128 | B2 | 4/2009 | Cheng |
| 7,530,755 | B2 | 5/2009 | Whaley |
| 7,534,064 | B2 | 5/2009 | Cheng |
| 7,549,817 | B2 | 6/2009 | Cheng et al. |
| 7,648,302 | B2 | 1/2010 | Zhang et al. |

(56) References Cited

U.S. PATENT DOCUMENTS

| | | | | |
|---|---|---|---|---|
| 7,661,898 | B2 | 2/2010 | Ng et al. | |
| 7,661,899 | B2 | 2/2010 | Lin | |
| 7,665,926 | B2 | 2/2010 | Cheng | |
| 7,674,062 | B2 | 3/2010 | Horn | |
| 7,731,441 | B2 | 6/2010 | Ng et al. | |
| 7,748,922 | B2 | 7/2010 | Cheg | |
| 8,052,343 | B2 | 11/2011 | Zhang et al. | |
| 8,186,899 | B2 | 5/2012 | Ng et al. | |
| 2003/0044221 | A1 | 3/2003 | To et al. | |
| 2005/0201818 | A1 | 9/2005 | Cheng | |
| 2005/0207826 | A1 | 9/2005 | Cheng et al. | |
| 2006/0008318 | A1 | 1/2006 | Ng | |
| 2006/0056906 | A1 | 3/2006 | Horn | |
| 2006/0147254 | A1 | 7/2006 | Cheng | |
| 2006/0228164 | A1* | 10/2006 | Horn | 402/31 |
| 2006/0251467 | A1 | 11/2006 | Cheng | |
| 2007/0086836 | A1 | 4/2007 | Cheng | |
| 2008/0075527 | A1 | 3/2008 | Pi et al. | |
| 2009/0060631 | A1 | 3/2009 | To et al. | |
| 2011/0170942 | A1 | 7/2011 | Huang et al. | |

FOREIGN PATENT DOCUMENTS

| | | | |
|---|---|---|---|
| FR | 1336765 | A | 9/1963 |
| FR | 1346864 | A | 12/1963 |
| FR | 2221924 | | 10/1974 |
| FR | 2238332 | A5 | 2/1975 |
| GB | 868724 | | 5/1961 |
| GB | 906279 | | 9/1962 |
| GB | 952536 | | 3/1964 |
| GB | 2275023 | A | 8/1994 |
| GB | 2292343 | A | 2/1996 |
| GB | 2387815 | A | 10/2003 |
| JP | 5979379 | U | 5/1984 |
| JP | 6118880 | U | 2/1986 |
| JP | 1299095 | A | 12/1989 |
| JP | 2034289 | U | 3/1990 |
| JP | 4120085 | U | 10/1992 |
| JP | 10-217662 | A | 8/1998 |
| JP | 2004098417 | A | 4/2004 |
| WO | 2013026351 | A1 | 3/2009 |

OTHER PUBLICATIONS

Response filed Jun. 29, 2010 to Office Action dated Mar. 12, 2010 regarding related U.S. Appl. No. 11/697,556 now issued as Patent No. 8,047,737—18 pgs.

Office action issued Oct. 20, 2010 in related U.S. Appl. No. 11/697,556 now issued as Patent No. 8,047,737—11 pgs.

Response filed Jan. 6, 2011 to Office Action dated Oct. 20, 2011 regarding related U.S. Appl. No. 11/697,556 now issued as Patent No. 8,047,737—16 pgs.

Office action issued Mar. 16, 2011 in related U.S. Appl. No. 11/697,556 now issued as Patent No. 8,047,737—7 pgs.

Response filed Jun. 16, 2011 to Office Action dated Mar. 16, 2011 regarding related U.S. Appl. No. 11/697,556 now issued as Patent No. 8,047,737—16 pgs.

* cited by examiner

RING BINDER MECHANISM

CROSS-REFERENCE TO RELATED APPLICATIONS

This application claims the benefit of U.S. Non-Provisional application Ser. No. 11/697,556, filed Apr. 6, 2007 and U.S. Provisional Application No. 60/827,205, filed Sep. 27, 2006, both of which are hereby incorporated by reference in their entirety.

FIELD OF THE INVENTION

This invention relates to a ring binder mechanism for retaining loose-leaf pages, and in particular to an improved ring binder mechanism for opening and closing ring members and for locking closed ring members together.

BACKGROUND

A ring binder mechanism retains loose-leaf pages, such as hole-punched pages, in a file or notebook. It has ring members for retaining the pages. The ring members may be selectively opened to add or remove pages or closed to retain pages while allowing the pages to be moved along the ring members. The ring members mount on two adjacent hinge plates that join together about a pivot axis. An elongate housing loosely supports the hinge plates within the housing and holds the hinge plates together so they may pivot relative to the housing.

The undeformed housing is slightly narrower than the joined hinge plates when the hinge plates are in a coplanar position (180°). So as the hinge plates pivot through this position, they deform the resilient housing and cause a spring force in the housing that urges the hinge plates to pivot away from the coplanar position, either opening or closing the ring members. Thus, when the ring members are closed the spring force resists hinge plate movement and clamps the ring members together. Similarly, when the ring members are opened, the spring force holds them apart. An operator may typically overcome this force by manually pulling the ring members apart or pushing them together. Levers or other actuators may also be provided on one or both ends of the housing for moving the ring members between the opened and closed positions. But a drawback to these known ring binder mechanisms is that when the ring members are closed, they do not positively lock together. So if the mechanism is accidentally dropped, the ring members may unintentionally open.

Some ring binder mechanisms have been modified to include locking structure to block the hinge plates from pivoting when the ring members are closed. The blocking structure positively locks the closed ring members together, preventing them from unintentionally opening if the ring binder mechanism is accidentally dropped. The blocking structure also allows the housing spring force to be reduced because the strong spring force is not required to clamp the closed ring members together. Thus, less operator force is required to open and close the ring members of these mechanisms than in traditional ring binder mechanisms.

Some of these ring binder mechanisms incorporate the locking structure onto a control slide connected to the lever. The lever moves the control slide (and its locking structure) to either block the pivoting movement of the hinge plates or allow it. One drawback to these mechanisms, however, is that an operator must positively move the lever after closing the ring members to position the locking structure so as to block the hinge plates and lock the ring members closed. Failure to do this could allow the hinge plates to inadvertently pivot and open the ring members, especially if the mechanisms are accidentally dropped.

Some locking ring binder mechanisms use springs to move the locking structure into a position blocking the hinge plates when the ring members close. Examples are shown in co-assigned U.S. patent application Ser. No. 10/870,801 (Cheng et al.), Ser. No. 10/905,606 (Cheng), and Ser. No. 11/027,550 (Cheng). These mechanisms employ separate springs to help lock the mechanisms.

Movement of the locking structure is generally linear or translational, but the movement is effected by pivoting of a lever or other movement by a suitable actuator. Accordingly, there is a need to transfer only the translational component of the lever's motion to the locking structure. There are solutions that have been proposed. For example, refer to co-owned U.S. patent application Ser. No. 10/870,801. However, there is a need to accomplish the transmission of motion with structure which is inexpensive to manufacture, simple in overall construction, and reliable in repeated operation.

SUMMARY

A ring binder mechanism for retaining loose leaf pages comprises a housing, a ring support supported by the housing for movement relative to the housing, and rings for holding the loose-leaf pages. Each ring includes a first ring member and a second ring member. The first ring member is mounted on the ring support for movement relative to the second ring member between a closed position and an opened position. In the closed position, the two ring members form a substantially continuous, closed loop for allowing loose-leaf pages retained by the rings to be moved along the rings from one ring member to the other. In the opened position, the two ring members form a discontinuous, open loop for adding or removing loose-leaf pages from the rings. An actuator is mounted on the housing for movement relative to the housing whereby the actuator movement pivots the ring support to move the ring members from the closed position to the opened position. A travel bar comprises at least one locking element and is moveable between a locked position wherein the ring members are locked in the closed position and an unlocked position wherein the ring members are capable of being moved to the opened position. An intermediate connector operably connects the travel bar to the actuator. A biasing member is engageable with the intermediate connector and at least one of the travel bar and actuator for biasing the travel bar toward the locked position.

In another aspect, a ring binder mechanism for retaining loose leaf pages comprises a housing, a ring support supported by the housing for movement relative to the housing, and rings for holding the loose-leaf pages. Each ring includes a first ring member and a second ring member. The first ring member is mounted on the ring support for movement relative to the second ring member between a closed position and an opened position. In the closed position, the two ring members form a substantially continuous, closed loop for allowing loose-leaf pages retained by the rings to be moved along the rings from one ring member to the other. In the opened position, the two ring members form a discontinuous, open loop for adding or removing loose-leaf pages from the rings. An actuator is mounted on the housing for movement relative to the housing for causing the pivoting motion of the ring support to move the ring members from the closed position to the opened position. A locking element locks the ring members in the closed position. An intermediate connector operably connects the locking element to the actuator. The actuator is configured for pivoting movement relative to the intermediate connector without movement of the intermediate connector.

In yet another aspect, a ring binder mechanism for retaining loose leaf pages comprises a housing, a ring support supported by the housing for movement relative to the housing, and rings for holding the loose-leaf pages. Each ring includes a first ring member and a second ring member. The first ring member is mounted on the ring support for movement relative to the second ring member between a closed position and an opened position. In the closed position, the two ring members form a substantially continuous, closed loop for allowing loose-leaf pages retained by the rings to be moved along the rings from one ring member to the other. In the opened position, the two ring members form a discontinuous, open loop for adding or removing loose-leaf pages from the rings. An actuator is mounted on the housing for movement relative to the housing for causing the pivoting motion of the ring support to move the ring members from the closed position to the opened position. A travel bar comprises at least one locking element and is moveable between a locked position wherein the ring members are locked in the closed position and an unlocked position wherein the ring members are capable of being moved to the opened position. The travel bar includes a mounting groove having at least one narrow section and a wide section spacing inward on the travel bar from the narrow section. An intermediate connector operably connects the travel bar to the actuator. The intermediate connector has a portion thereof captured by the wide section of the mounting groove in the travel bar. The portion of the intermediate connector is moveable within the wide section of the mounting groove so that the intermediate connector can move relative to the travel bar.

Other features of the invention will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
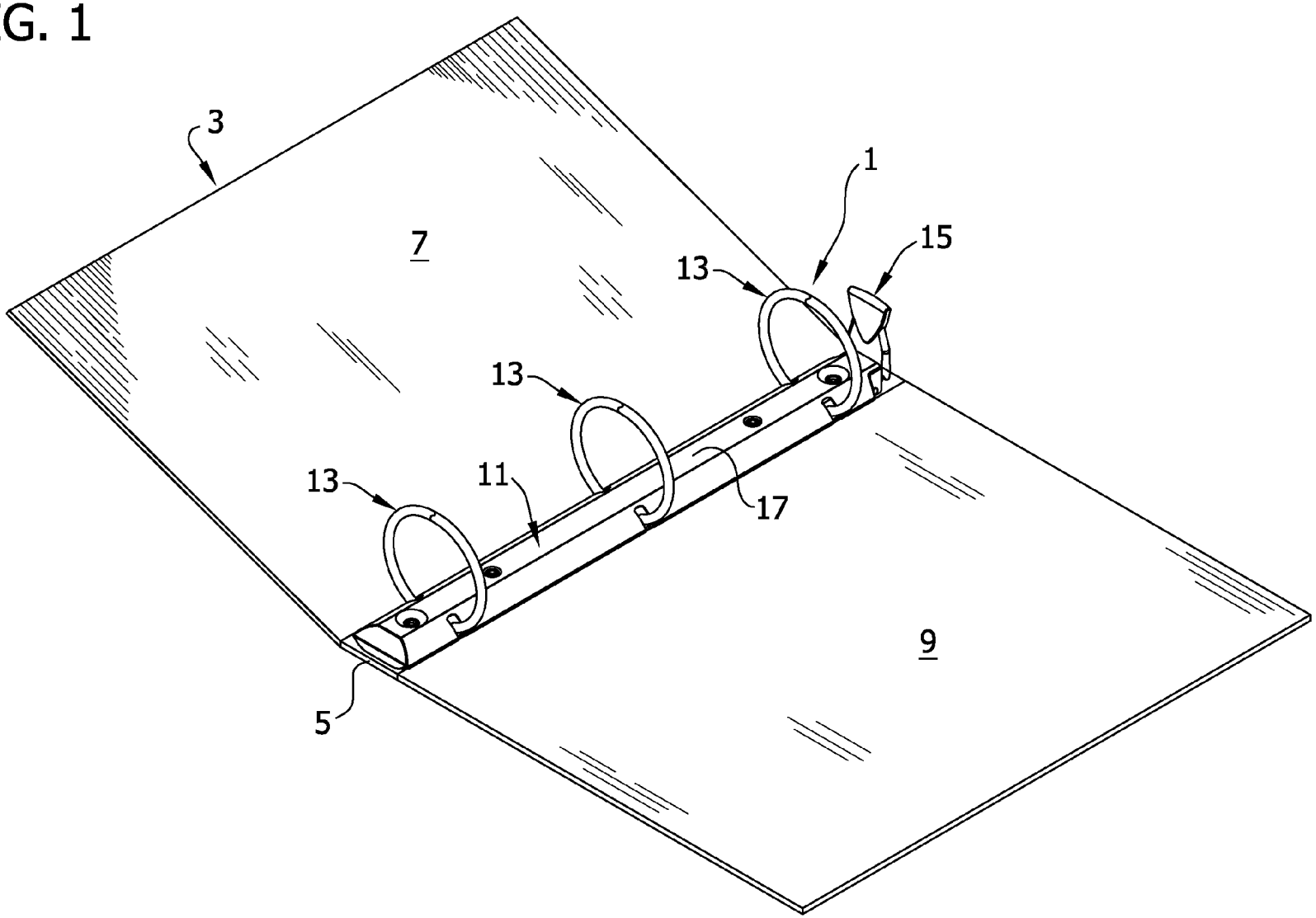
FIG. 1 is a perspective of a notebook incorporating a first embodiment of a ring binder mechanism.

Referring to the drawings, FIGS. 1-13B show a first embodiment of a ring binder mechanism generally at 1. In FIG. 1, the mechanism 1 is shown mounted on a notebook designated generally at 3. Specifically, the mechanism 1 is shown mounted on a spine 5 of the notebook 3 between a front cover 7 and a back cover 9 hingedly attached to the spine 3. The front and back covers 7, 9 move to selectively cover or expose loose-leaf pages (not shown) retained by the mechanism 1 in the notebook 3. Ring binder mechanisms mounted on notebooks in other ways or on surfaces other than a notebook, for example, a file, do not depart from the scope of this invention.

Figure 2:
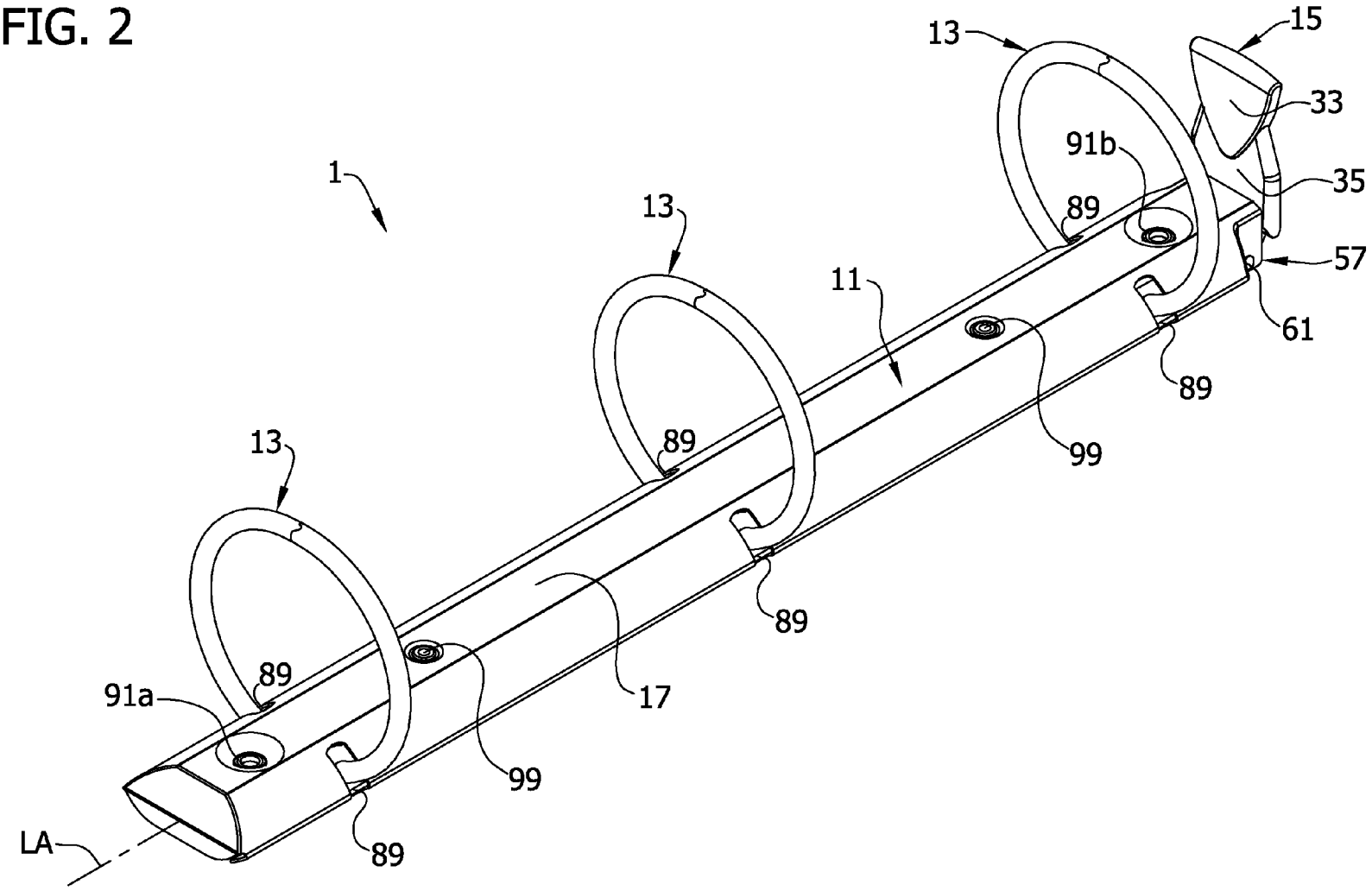
FIG. 2 is a top side perspective of the ring binder mechanism at a closed and locked position and with the lever in a first relaxed position.
Figure 3:
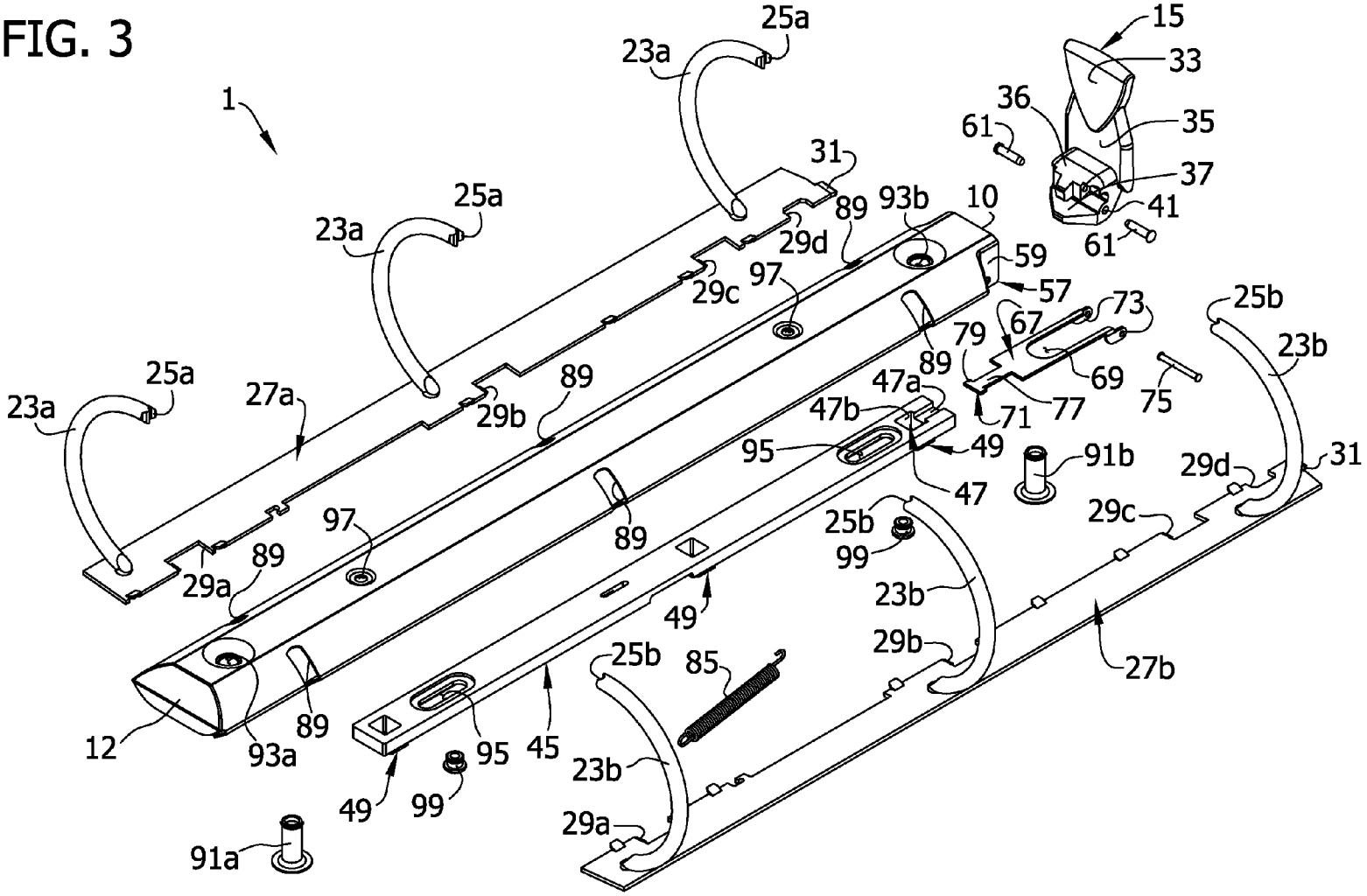
FIG. 3 is an exploded perspective of the ring binder mechanism of FIG. 1.

As shown in FIG. 1, a housing, designated generally at 11, supports three rings (each designated generally at 13) and a lever (broadly, an "actuator," and designated generally at 15). The rings 13 retain loose-leaf pages on the ring binder mechanism 1 in the notebook 3 while the lever 15 operates to open and close the rings so that pages may be added or removed. Referring now also to FIGS. 2 and 3, the housing 11 is shaped as an elongated rectangle with a uniform, roughly arch-shaped cross section, having at its center a generally flat plateau 17. A first longitudinal end 10 of the housing 11 (to the right in FIG. 3) is generally open while a second, opposite longitudinal end 12 is generally closed (to the left in FIG. 3). Bent under rims 21 (FIG. 4) extend lengthwise along longitudinal edges of the housing 11 from the first longitudinal end 10 of the housing to the second longitudinal end 12. Mechanisms having housings of other shapes, including irregular shapes, or housings that are integral with a file or notebook do not depart from the scope of this invention.

The three rings 13 of the ring binder mechanism 1 are substantially similar and are each generally circular in shape (e.g., FIG. 2). As shown in FIG. 3, the rings 13 each include two generally semi-circular ring members 23*a*, 23*b* formed from a conventional, cylindrical rod of a suitable material (e.g., steel). The ring members 23*a*, 23*b* include free ends 25*a*, 25*b*, respectively, formed to secure the ring members against transverse misalignment (relative to longitudinal axes of the ring members) when they are closed together (see FIG. 2). Ring binder mechanisms with ring members formed of different material or having different cross-sectional shapes, for example, oval shapes, do not depart from the scope of this invention.

As also shown in FIG. 3, the ring binder mechanism 1 includes two substantially identical hinge plates (broadly, "ring supports"), designated generally at 27*a*, 27*b*, supporting the ring members 23*a*, 23*b*, respectively. The hinge plates 27*a*, 27*b* are each generally elongate, flat, and rectangular in shape and are each somewhat shorter in length than the housing 11. Four corresponding cutouts 29*a-d* are formed in each of the hinge plates 27*a*, 27*b* along an inner edge margin of the plate. A finger 31 extends longitudinally away from a first end of each of the hinge plates 27*a*, 27*b* (to the right in FIG. 3). The fingers 31 are each narrower in width than the respective hinge plates 27*a*, 27*b* and are positioned with their inner longitudinal edges generally aligned with the inner longitudinal edges of the plates. The purpose of the cutouts 29*a-d* and fingers 31 will be described hereinafter. The lever 15 and hinge plates 27*a*, 27*b* can broadly be referred to as an "actuation system."

Referring to FIGS. 2 and 3, the lever 15 includes a grip 33, a body 35 attached to the grip, and an upper lip 36 and lower lip 37 attached to the body. The grip 33 is sized and shaped to facilitate grasping the lever 15 and applying force to move the lever. In the illustrated ring binder mechanism 1, the body 35 is formed as one piece with the grip 33 for substantially conjoint movement with the grip. In fact, the entire lever 15 is formed as a single piece. The various components of the lever 15 may be formed separately and attached thereto without departing from the scope of the invention.

Referring again to FIG. 3, the ring binder mechanism 1 includes an elongated travel bar designated generally at 45. The travel bar includes a mounting groove 47 at a first end (to the right in FIG. 3) and three locking elements (each designated generally at 49) along a bottom surface. The mounting groove, indicated generally at 47, in the travel bar 45 has a narrower section 47*a* near the end of the travel bar and a wider section 47*b* inward of the end. The locking elements 49 are spaced apart longitudinally along the travel bar 45 with one locking element adjacent each longitudinal end of the travel bar, and one located toward a center of the travel bar. The travel bar 45 may have other shapes or greater or fewer than three locking elements 49 within the scope of this invention. The travel bar and locking elements may be broadly referred to as a "locking system."

Figure 6:
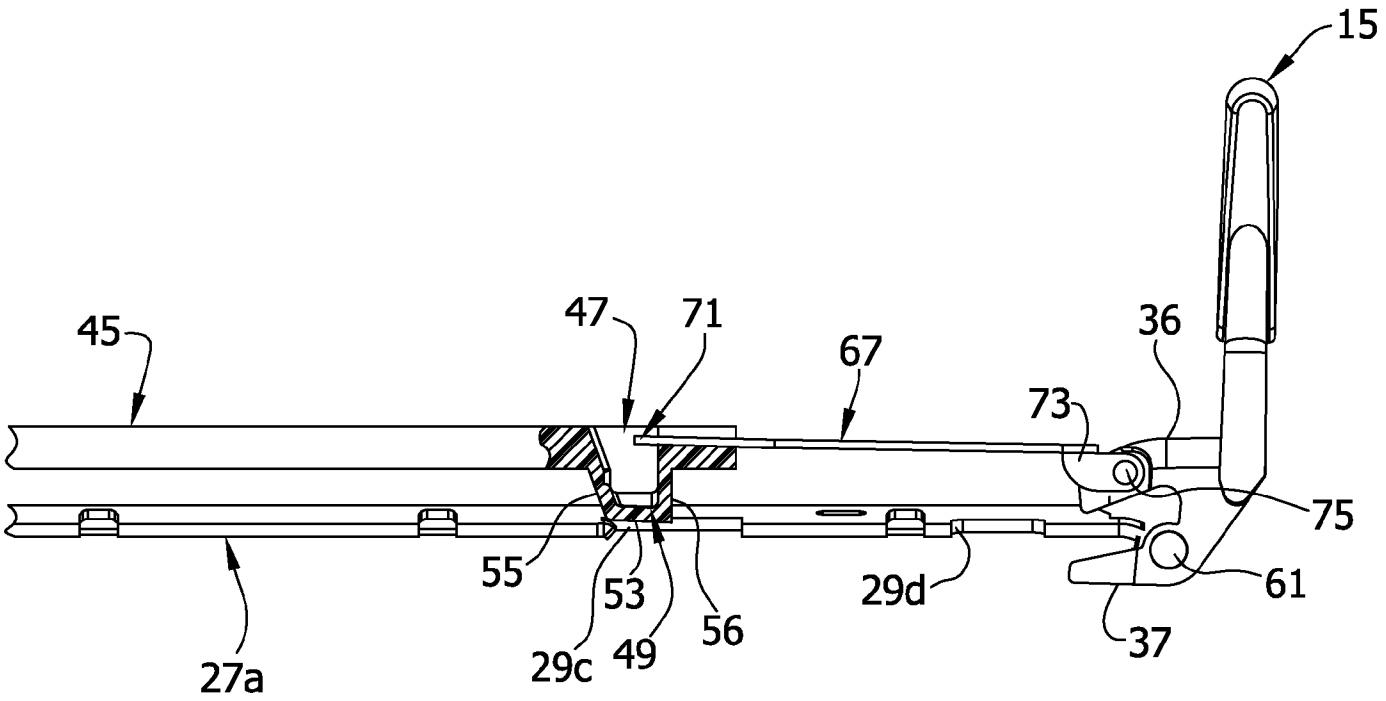
FIG. 6 is an enlarged fragmentary side elevation thereof with the housing and a hinge plate removed.

The locking elements 49 of the illustrated travel bar 45 are each substantially similar in shape. As shown in FIG. 6, each locking element 49 includes a narrow, flat bottom 53, an angled forward edge 55, and a rearward edge 56. In the illustrated embodiment, the locking elements 49 each have a generally wedge shape. The angled edges 55 of the locking elements 49 may engage the hinge plates 27*a*, 27*b* and assist in pivoting the hinge plates down. In the illustrated embodiment, the locking elements 49 are formed as one piece of material with the travel bar 45 by, for example, a mold process. But the locking elements 49 may be formed separate from the travel bar 45 and attached thereto without departing from the scope of the invention. Additionally, locking elements with different shapes, for example, block shapes (e.g., no angled edges), are within the scope of this invention.

Figure 4:
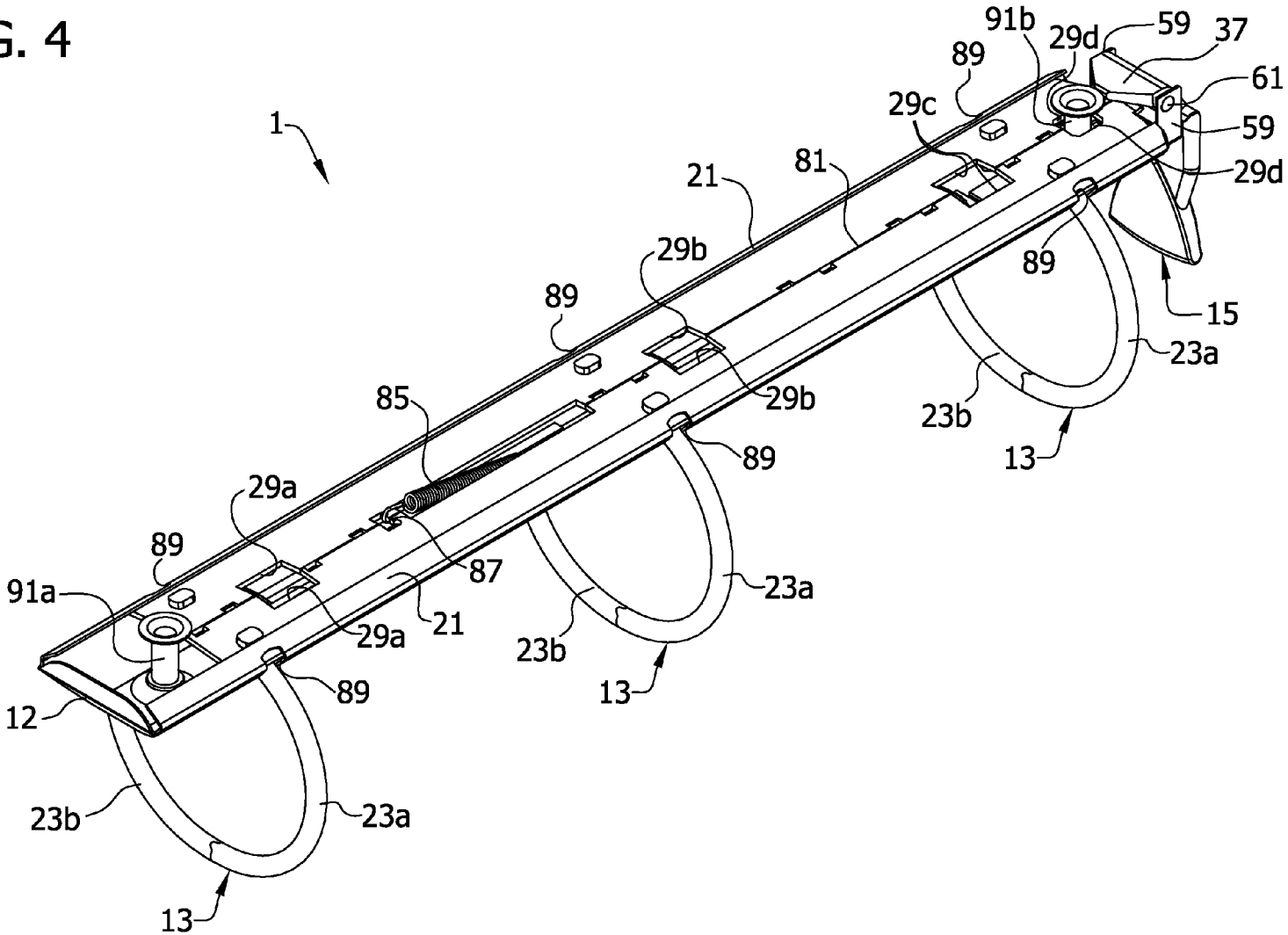
FIG. 4 is a bottom side perspective thereof.

The ring binder mechanism 1 in assembled form will now be described with reference to FIGS. 4-6 in which the mechanism is illustrated with the ring members 23*a*, 23*b* in the closed position and the lever 15 in an upright position. As shown in FIG. 4, the lever 15 pivotally mounts on the first, open end of the housing 11 by a lever mount, indicated generally at 57, having mounting arms 59. A mounting opening (not shown) in each mounting arm 59 aligns with a channel 41 in the lever 15. At least one hinge pin 61 passes through the aligned openings 60 and channel 41 to pivotally mount the lever 15 on the housing 11. The illustrated configuration uses two hinge pins 61 to mount the lever 15. The lever mount 57 is shown as being one piece with the housing 11, but it may be formed separate from the housing and attached thereto without departing from the scope of the invention.

Figure 5:
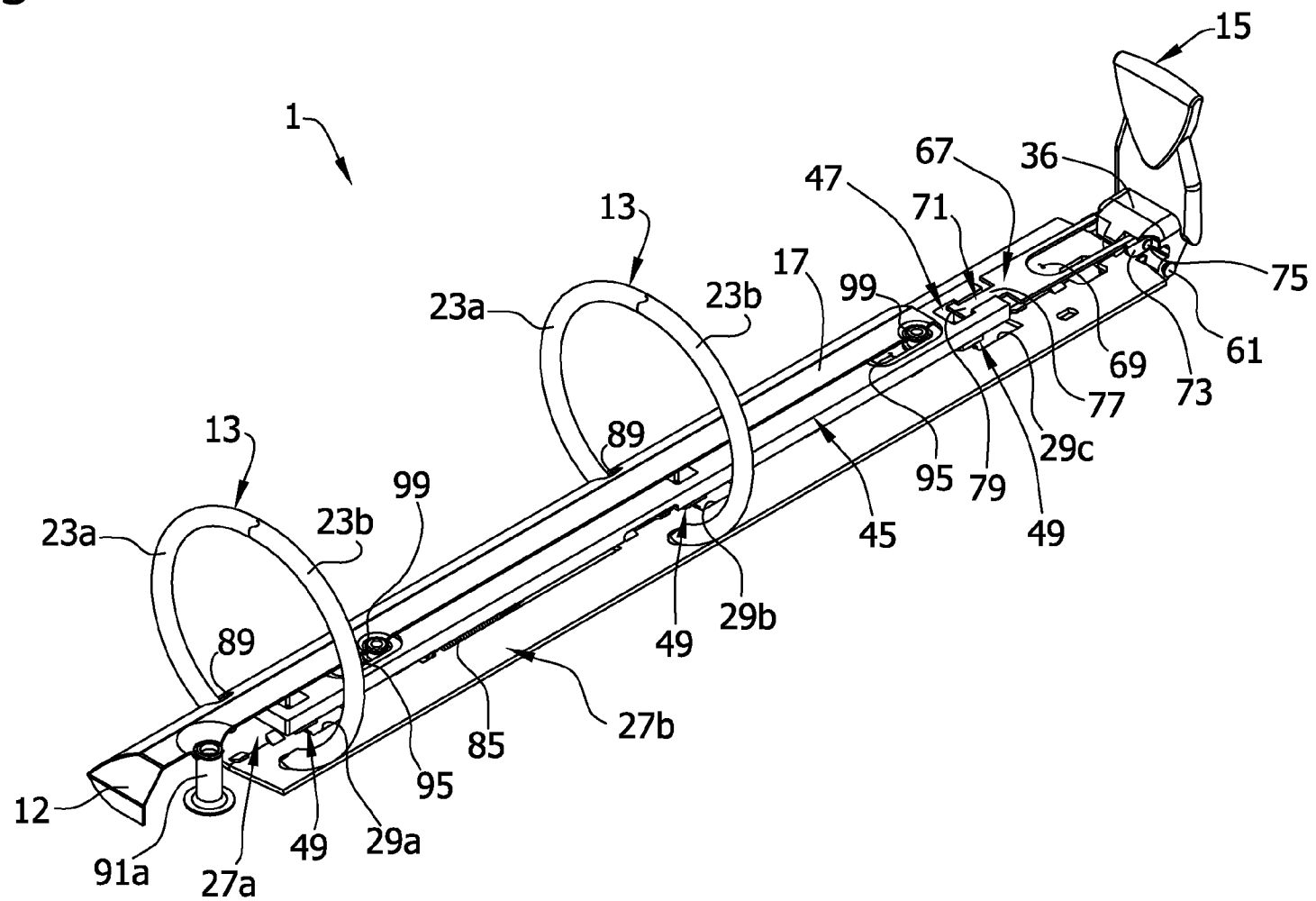
FIG. 5 is a fragmentary perspective of the ring binder mechanism of FIG. 2 with a portion of a housing broken away to reveal internal construction.

As shown in FIG. 5, the travel bar 45 is disposed within the housing 11 beneath the housing's plateau 17. The travel bar 45 extends lengthwise of the housing 11, in generally parallel orientation with a longitudinal axis LA (see FIG. 2) of the housing, with the locking elements 49 extending toward the hinge plates 27*a*, 27*b*. Referring to FIGS. 5 and 6, the travel bar 45 is operably connected to the lever 15 by an intermediate connector, designated generally at 67. In this embodiment, the intermediate connector 67 is illustrated as a flat elongate plate having a U-shaped cutout 69 at a first end and an elongate tab, designated generally at 71, at a second end. The first end of the intermediate connector includes two parallel-spaced free ends 73 shaped to fit on opposite sides of the upper lip 36 of the lever 15 and be secured to the upper lip by a hinge pin 75 to form a pivoting connection. The tab 71 has a larger, narrow neck 77 and a wider head 79 at the free end of the neck. The tab 71 fits in the mounting groove 47 of the travel bar 45 so that the neck 77 extends through the narrower section 47*a* and the head 79 is received in the wider section 47*b*. The wider section 47*b* of the mounting groove 47 is longer than the head 79 of the tab 71 of the intermediate connector 67 so that the tab has room to move linearly, in a longitudinal direction, relative to the travel bar 45. The tab 71 operably secures the intermediate connector 67 to the travel bar 45 so that the tab can pull on the travel bar. The tab 71 also allows the intermediate connector 67 to pivot relative to the travel bar 45 to accommodate small vertical movements of the intermediate connector that occur when the lever 15 pivots.

Figure 7:
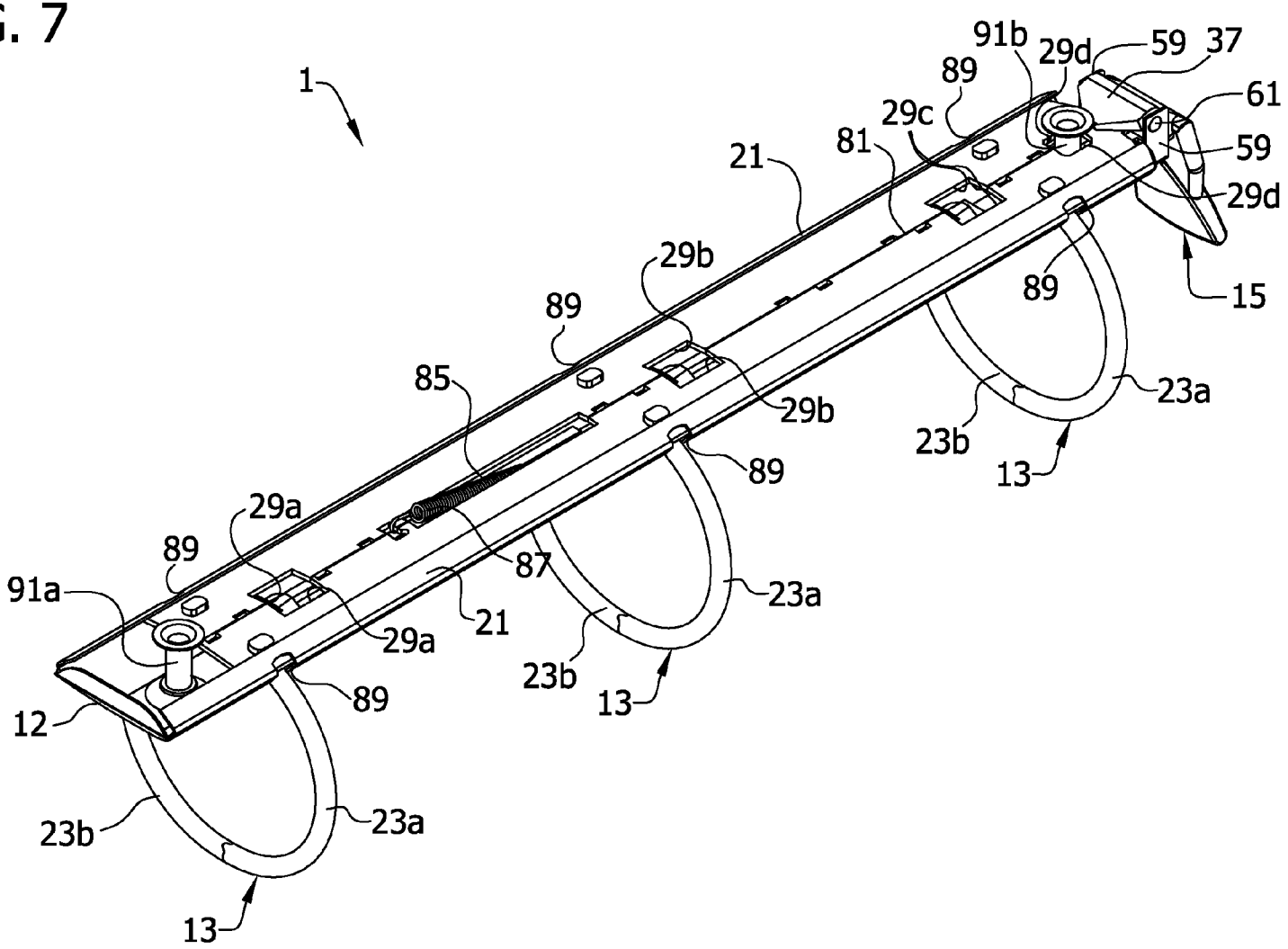
FIG. 7 is a bottom side perspective similar to FIG. 4 but with the ring binder mechanism at a closed and unlocked position and with the lever in a first deformed position.
Figure 10:
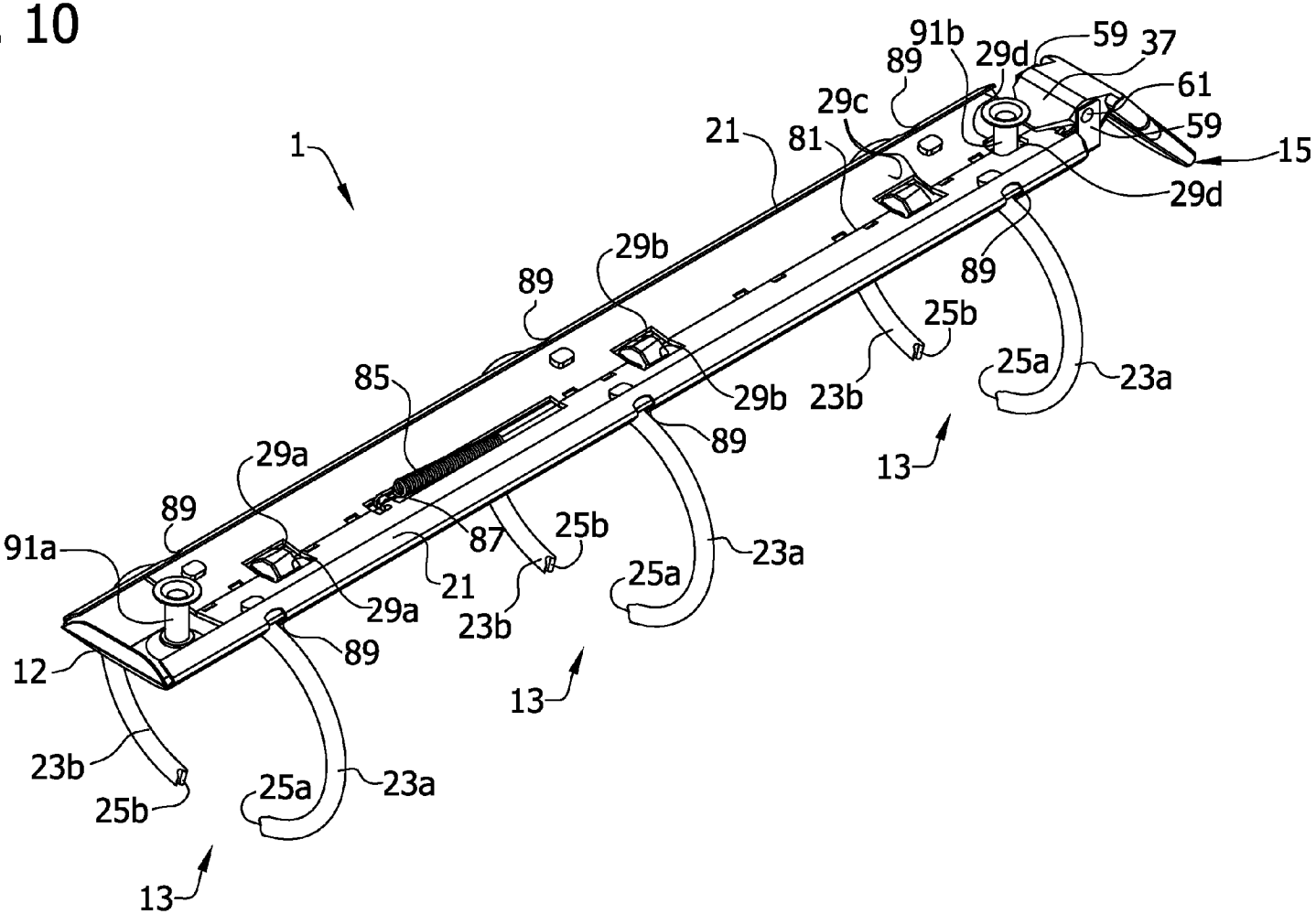
FIG. 10 is a bottom side perspective thereof.

As shown in FIGS. 4, 7, and 10, the hinge plates 27*a*, 27*b* are interconnected in parallel arrangement along their inner longitudinal edge margins, forming a central hinge 81 having a pivot axis. This is done in a conventional manner known in the art. As will be described, the hinge plates 27*a*, 27*b* can pivot about the hinge 81 upward and downward. The four cutouts 29*a-d* in each of the two individual hinge plates 27*a*, 27*b* (FIG. 3) align to form four openings also designated 29*a-d* in the interconnected plates (FIG. 4). The housing 11 supports the interconnected hinge plates 27*a*, 27*b* within the housing below the travel bar 45. The outer longitudinal edge margins of the hinge plates 27*a*, 27*b* loosely fit behind the bent under rims 21 of the housing 11 for allowing them to move within the rims when the hinge plates pivot. As shown in FIGS. 5 and 6, the fingers 31 of the hinge plates 27*a*, 27*b* extend between the lower lip 37 and the upper lip 36 of the lever 15 so that lower surfaces of the hinge plates are engageable by the lower lip and upper surfaces of the hinge plates 27*a*, 27*b* are engageable by the upper lip. A spring 85 (broadly referred to as a "biasing member") connects to the hinge plates 27*a*, 27*b* at a hook 87 disposed along the inner edge margins of the hinge plates (FIG. 4) and to the travel bar 45 at a detent (not shown) in the bar. The bias provided by the spring 85 urges the travel bar 45 to move away from the lever 15 (i.e., toward a locked position). This seats the head 79 of the tab 71 of the intermediate connector 67 against an outward end of the wider section 47*b* of the mounting groove 47 of the travel bar 45 and holds the lever 15 in an upright position.

As shown in FIG. 3, the ring members 23*a*, 23*b* are each mounted on upper surfaces of respective ones of the hinge plates 27*a*, 27*b* in generally opposed fashion, with the free ends 25*a*, 25*b* facing. As shown in FIGS. 4 and 5, the ring members 23*a*, 23*b* extend through respective openings 89 along sides of the housing 11 so that the free ends 25*a*, 25*b* of the ring members can engage above the housing. The ring members 23*a*, 23*b* are rigidly connected to the hinge plates 27*a*, 27*b* as is known in the art and move with the hinge plates when they pivot. Although in the illustrated ring binder mechanism 1 both ring members 23*a*, 23*b* of each ring 13 are each mounted on one of the two hinge plates 27*a*, 27*b* and move with the pivoting movement of the hinge plates, a mechanism in which each ring has one movable ring member and one fixed ring member does not depart from the scope of this invention (e.g., a mechanism in which only one of the ring members of each ring is mounted on a hinge plate with the other ring member mounted, for example, on a housing).

As shown in FIG. 4, two mounting posts 91*a*, 91*b* (see also, FIG. 3) are secured to the illustrated ring binder mechanism 1 to mount the mechanism on, for example, the notebook 3 (e.g., FIG. 1) in any suitable manner. The posts 91*a*, 91*b* attach to the housing 11 at mounting post openings 93*a*, 93*b* (FIG. 3) of the plateau 17 located toward the longitudinal ends 10, 12 of the housing. One of the two mounting posts 91*b* (toward the right in FIG. 4) extends through the U-shaped cutout 69 in the intermediate connector 67, through one of the openings 29*d* in the interconnected hinge plates 27*a*, 27*b*, and through one of the mounting post openings 93*b*. The other mounting post 91*a* extends through one of the openings 29*a* in the interconnected hinge plates 27*a*, 27*b* and through the other mounting post opening 93*a* in the housing 11. The travel bar 45 terminates before it reaches the mounting post 91*a* adjacent the second longitudinal end 12 of the housing 11.

As illustrated in FIG. 3, two elongate openings 95 extend through the travel bar 45 and align with two rivet openings 97 of the housing plateau 17. Grooved rivets 99 secure to the housing plateau 17 at the rivet openings 97 and extend through the respective elongate openings 95 of the travel bar 45 to vertically support the travel bar within the housing 11 for movement relative to the housing. The travel bar 45 fits within the grooves of the rivets 99, allowing the travel bar to slide in translation lengthwise of the housing 11.

Figure 8:
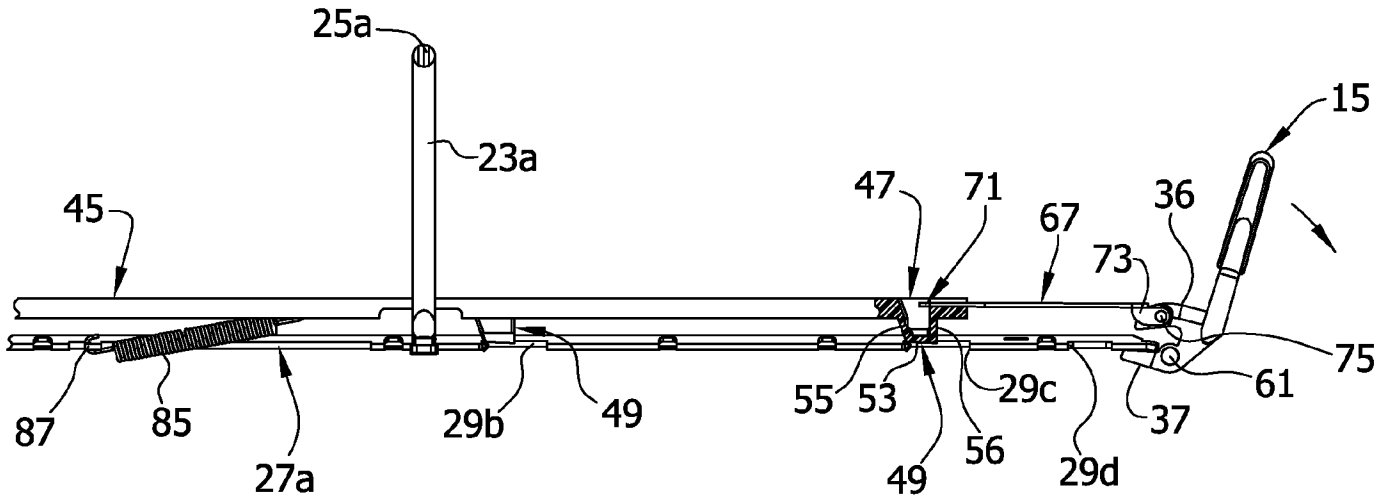
FIG. 8 is an enlarged fragmentary side elevation similar to FIG. 6 but with the ring binder mechanism at the closed and unlocked position and the lever at the first deformed position.
Figure 9:
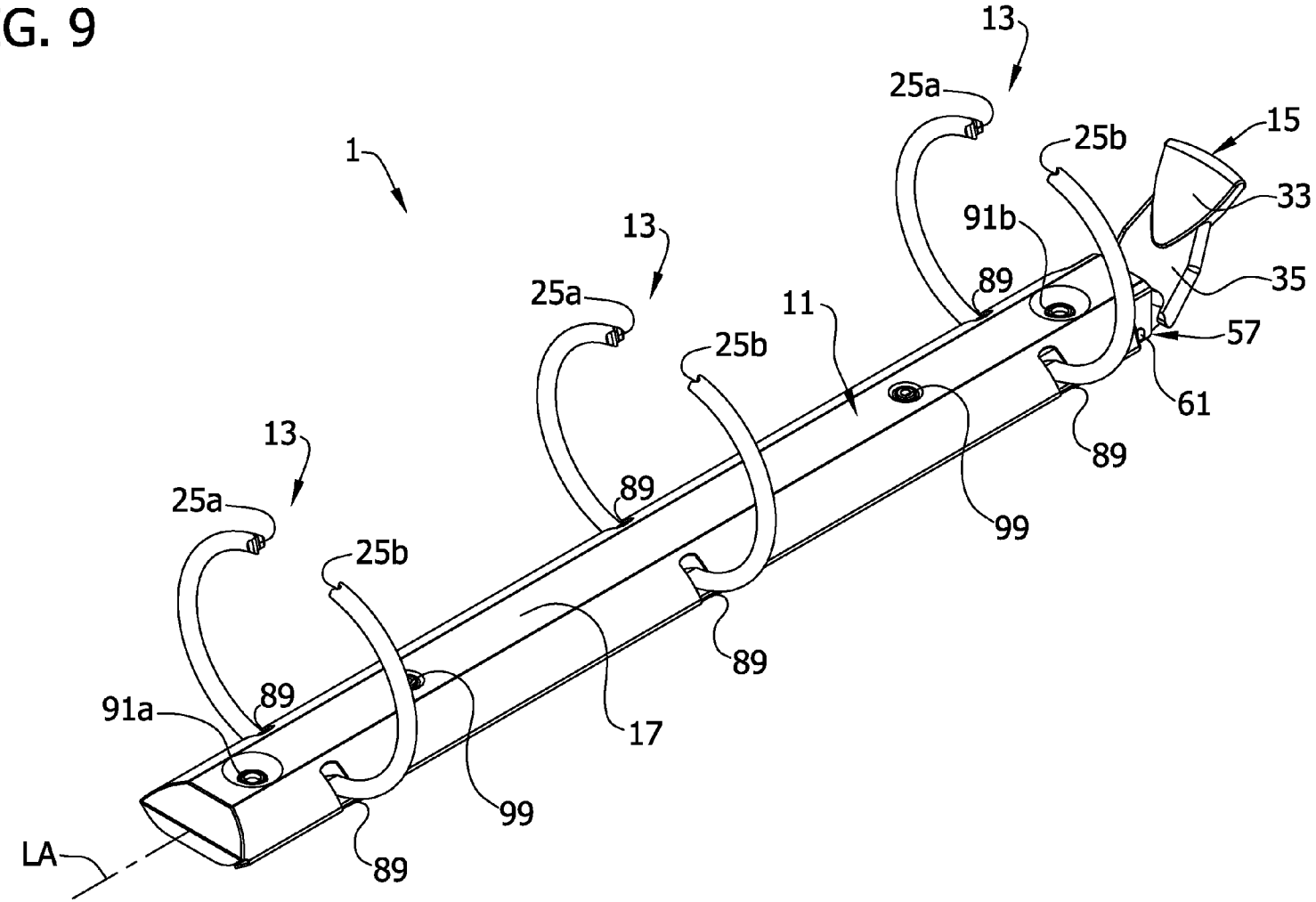
FIG. 9 is a top side perspective of the ring binder mechanism at an opened position and with the lever in a second deformed position.
Figure 11:
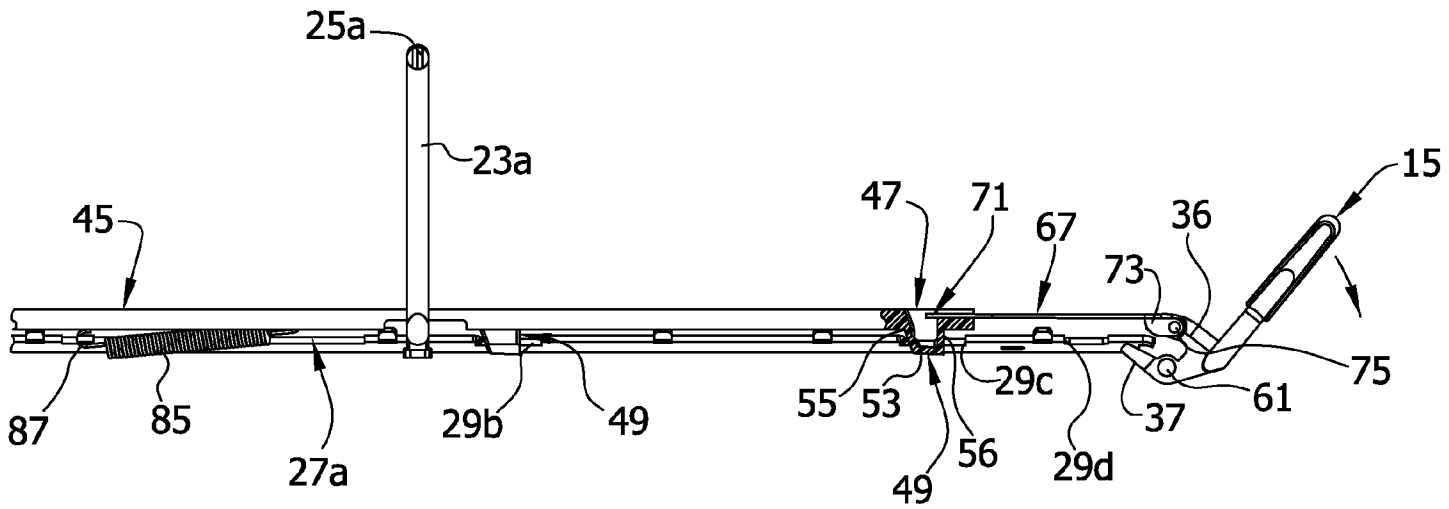
FIG. 11 is an enlarged fragmentary side elevation similar to FIG. 6 but with the ring binder mechanism at the opened position.

Operation of the ring binder mechanism 1 of this embodiment will now be described. FIGS. 4-6 illustrate the mechanism 1 in a closed and locked position with the lever 15 in the upright position. To unlock the ring binder mechanism 1 and open the ring members 23*a*, 23*b*, an operator pivots the lever 15 outward and downward (clockwise as indicated by the arrow in FIG. 8). The lower lip 37 of the lever 15 is initially spaced apart from the lower surfaces of the hinge plates 27*a*, 27*b* (FIG. 6). This provides time for the upper lip 36 of the lever 15 to pull the intermediate connector 67, which simultaneously pulls the travel bar 45 and moves the locking elements 49 toward the lever 15 and into registration with the openings 29*a*, 29*b*, 29*c* in the hinge plates 27*a*, 27*b* before the upper lip engages the hinge plates. The spring 85 extends and tends to urge the travel bar 45 and locking elements 49 back toward the locked position with the locking elements behind the hinge plates 27*a*, 27*b*. As shown in FIGS. 7 and 8, the lower lip 37 of the lever 15 then moves into engagement with lower surfaces of the hinge plates 27*a*, 27*b* (only one hinge plate is shown in FIG. 8) and begins pushing them upward toward the housing plateau 17. Once the hinge plates 27*a*, 27*b* pass through the co-planar position, the spring force of the housing 11 pivots the hinge plates fully upward over the locking elements 49 and the ring members 23*a*, 23*b* open as shown in FIGS. 9-11. The extended spring 85 recoils slightly and seats the locking elements 49 against forward edges of the openings 29*a*, 29*b*, 29*c* in the hinge plates 27*a*, 27*b*. The spring 85 is still under tension, but the locking elements 49 remain seated in the openings 29*a*, 29*b*, 29*c* as the spring force of the housing 11 resists movement of the hinge plates 27*a*, 27*b* downward.

Figure 12A:
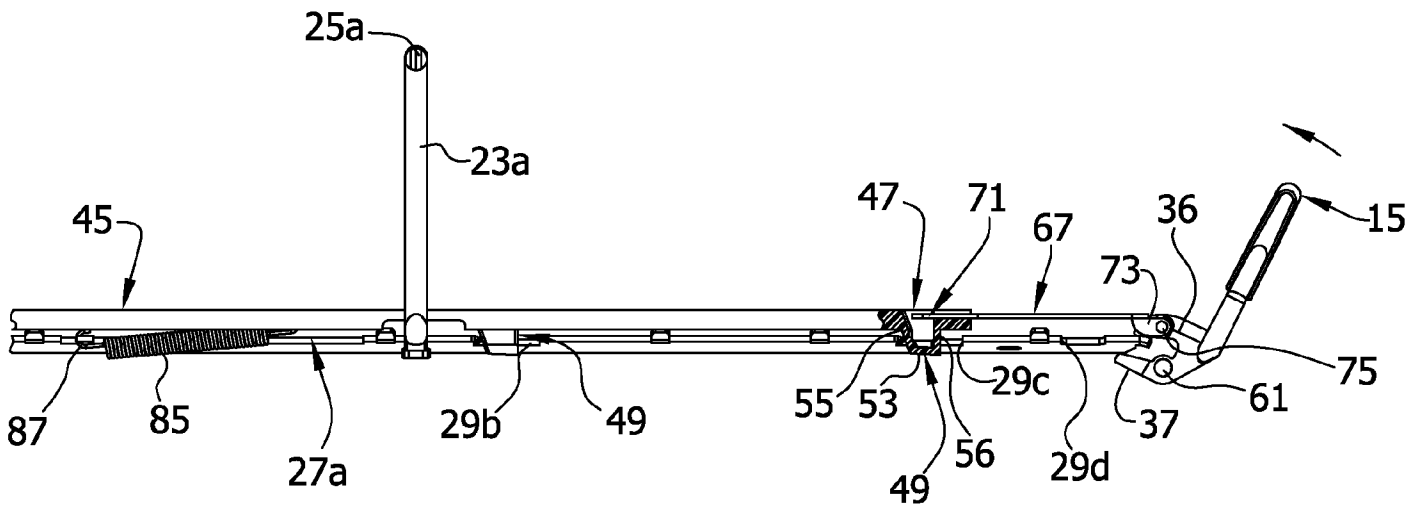
FIGS. 12A and 12B are side views similar to FIG. 11 illustrating pivoting movement of the lever toward the closed and locked position and the concurrent movement of the intermediate connector and hinge plate.
Figure 13A:
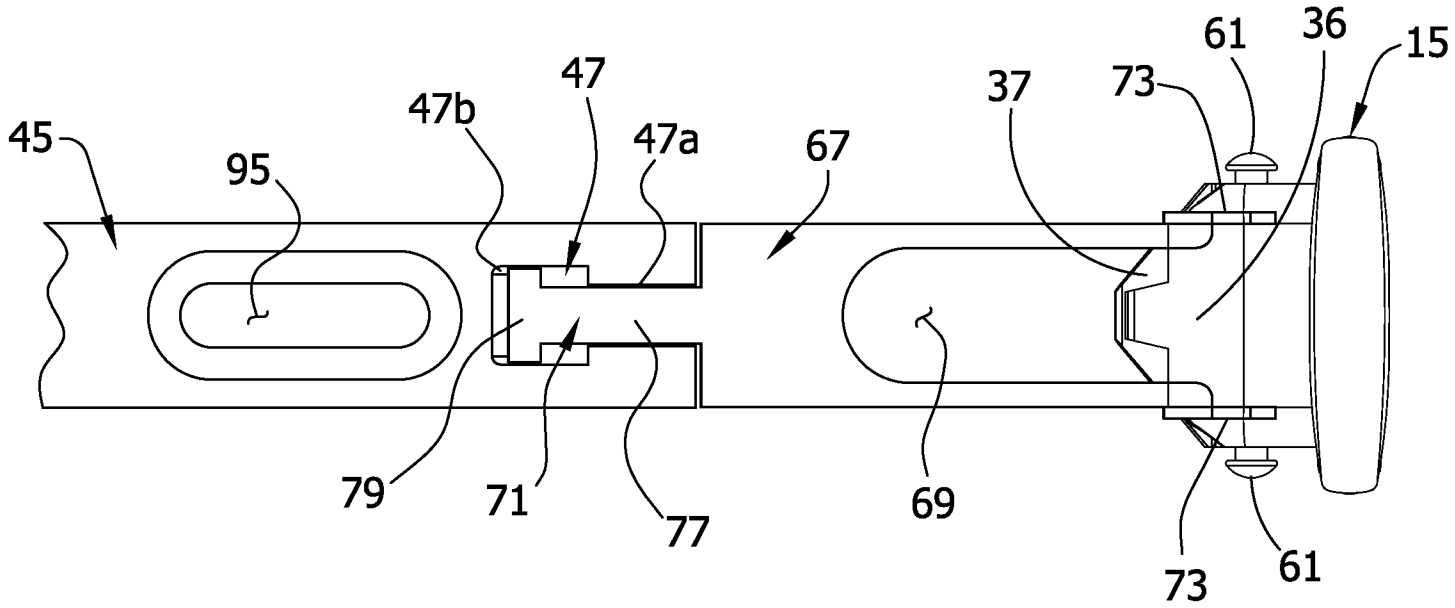
FIGS. 13A and 13B are top plan views of FIGS. 12A and 12B, respectively.

To close the ring members 23*a*, 23*b* and return the mechanism 11 to the locked position, an operator pivots the lever upward and inward as indicated by the arrow in FIG. 12A. The upper lip 36 of the lever 15 pushes the intermediate connector 67 forward. The head 79 on the tab 71 of the intermediate connector 67 moves within the wider section 47*b* of the mounting groove 47 of the travel bar 45 from the outward end of the groove toward an inward end of the groove. The travel bar 45 does not move with the lever 15 while the head 79 of the tab 71 moves within the mounting groove 47 (FIG. 13A). As the lever 15 continues to pivot, the upper lip 36 of the lever 15 moves into engagement with upper surfaces of the hinge plates 27*a*, 27*b* and pivots them downward, through the co-planar position, and opens the ring members 23*a*, 23*b*.

Figure 12B:
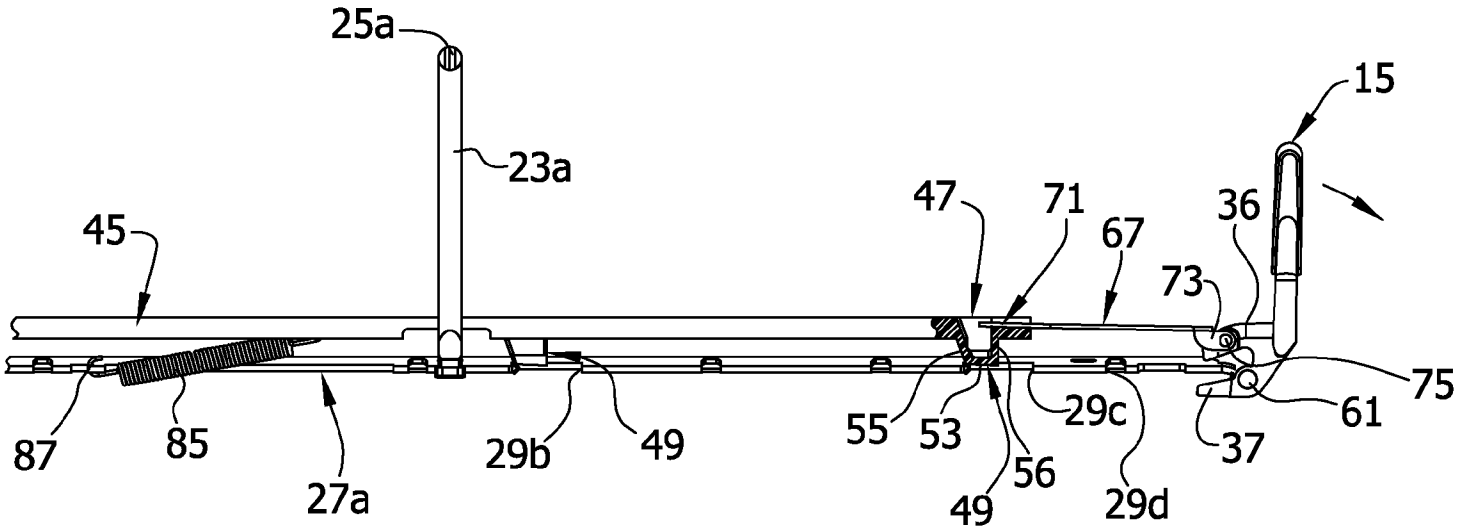
Figure 13B:
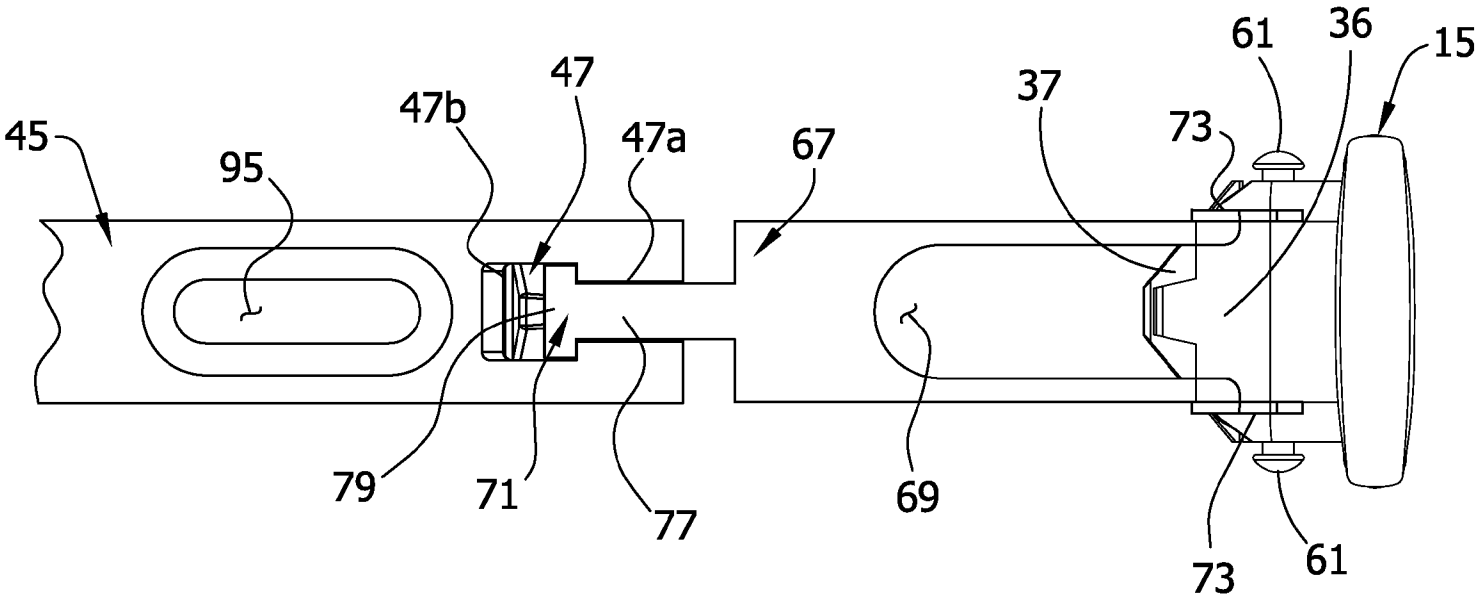
Figure 14:
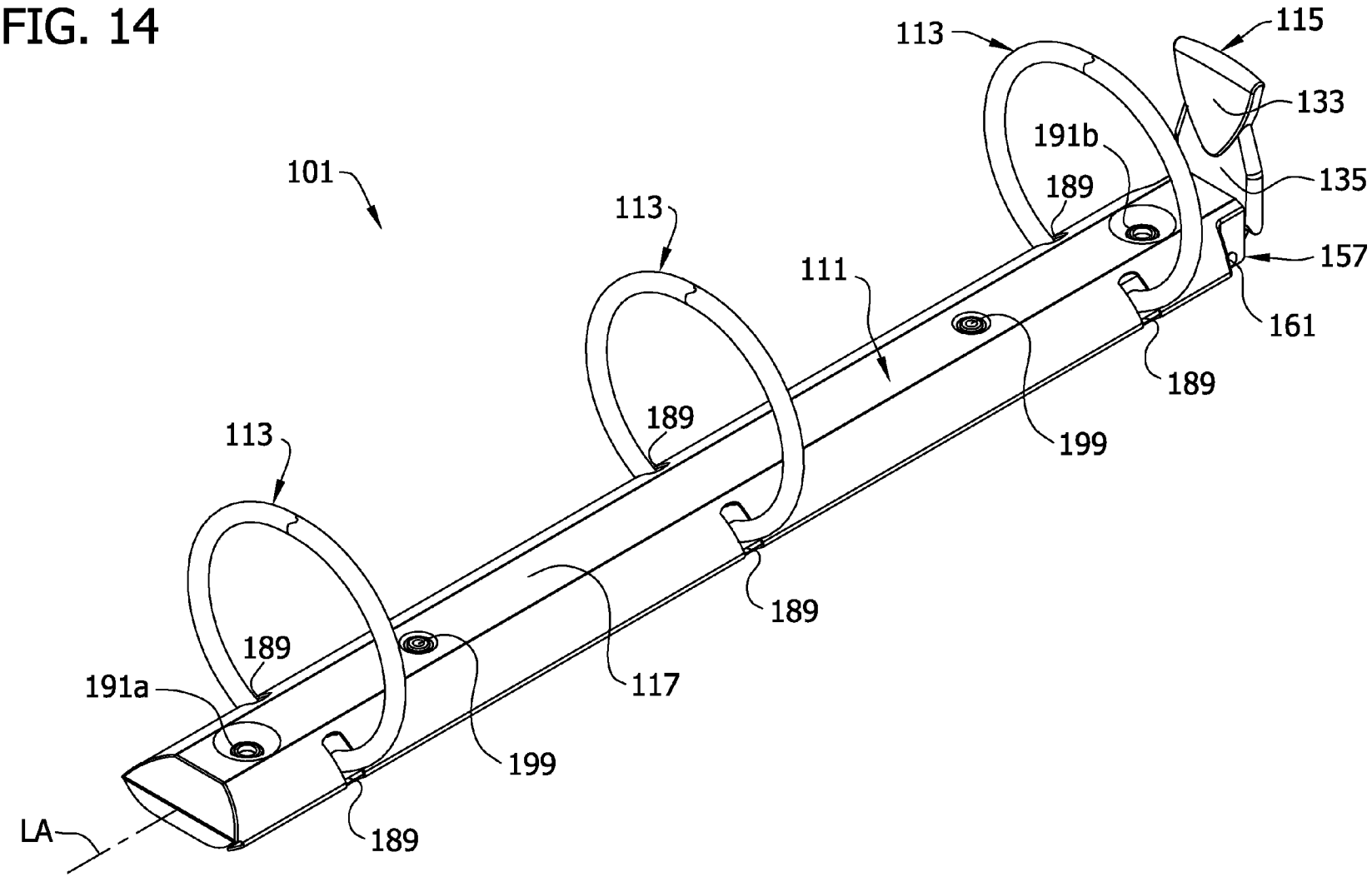
FIG. 14 is a top side perspective of a second embodiment of a ring binder mechanism at a closed and locked position and with the lever in a first relaxed position.
Figure 15:
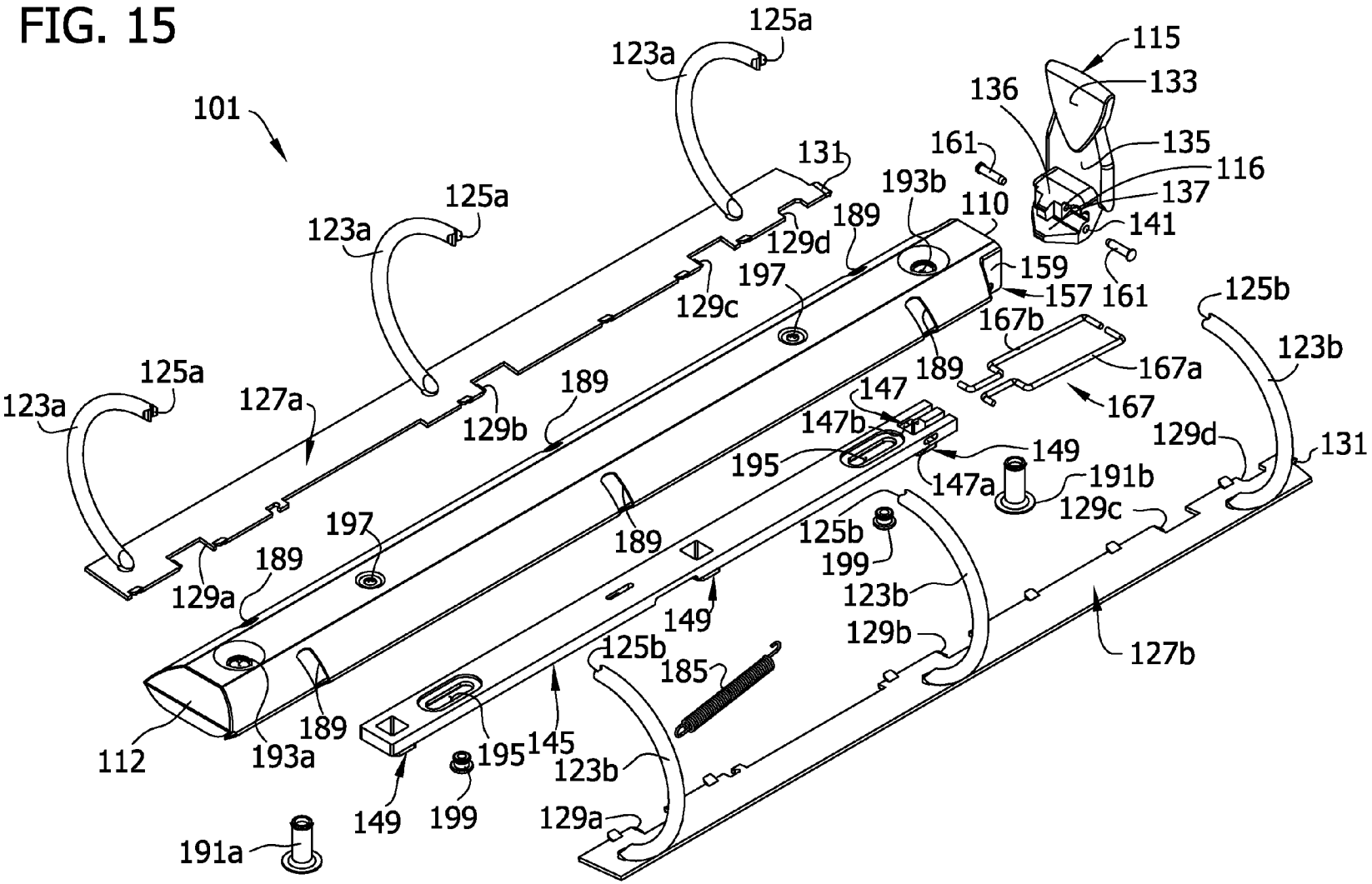
FIG. 15 is an exploded perspective of the ring binder mechanism.

As soon as the hinge plates 27*a*, 27*b* clear bottom surfaces of the locking elements 49, the extension spring 85 pulls on the travel bar 45 and moves it and the locking elements back to the locked position with the locking elements behind the hinge plates. The travel bar 45 moves a short distance relative to the intermediate connector 67 until the head 79 of the tab 71 again contacts the outward end of the wider section 47*b* of the mounting groove 47 of the travel bar 45 (FIG. 13B). The travel bar 45 then pulls on the intermediate connector 67 and the lever 15 and returns the lever to its upright position (FIG. 12B).

In this embodiment the lower lip 37 of the lever 15 is spaced apart from the lower surfaces of the hinge plates 27*a*, 27*b* when the ring members 23*a*, 23*b* are closed. This provides room for the lower lip 37 to pivot to pull the locking elements 49 from the locked position behind the hinge plates 27*a*, 27*b* to the unlocked position in registration with openings 29*a*, 29*b*, 29*c* in the hinge plates before beginning to pivot the hinge plates upward.

Also in this embodiment, the intermediate connector 67 and travel bar 45 are formed so that the travel bar slidably receives the tab 71 of the intermediate connector, allowing the connector to move relative to the travel bar in a linear direction along a longitudinal axis of the travel bar. The intermediate connector 67 is initially positioned relative to the travel bar 45 so that opening movement of the lever 15 pulls on the intermediate connector and simultaneously moves the travel bar and locking elements 49 toward the lever and out of the locked position. The intermediate connector 67 can then move relative to the travel bar 45 so that closing movement of the lever 15 pushes on the intermediate connector but does not initially move the travel bar 45. Instead, the intermediate connector 67 moves relative to the travel bar 45 so that the lever 15 can first pivot the hinge plates 27*a*, 27*b* downward to close the ring members 23*a*, 23*b*. Then the spring 85 pulls the travel bar 45 and locking elements 49 to the locked position, which in turn pulls the lever 15 to the upright position.

FIGS. 14-20B illustrate a second embodiment of a ring binder mechanism 101 in which an intermediate connector 167 comprises a pair of wires 167*a*, 167*b* bent into elongate, roughly half-rectangular forms. Each wire 167*a*, 167*b* connects to a lever 115 at an opening 116 in an upper lip 136 of the lever and to a travel bar 145 at elongate openings 147*a*, 147*b* in a mounting groove 147 of the bar. The elongate openings 147*a*, 147*b* secure the wires 167*a*, 167*b* to the travel bar 145 while still allowing the wires to move relative to the travel bar in a linear direction along the longitudinal axis of the travel bar.

Figure 16:
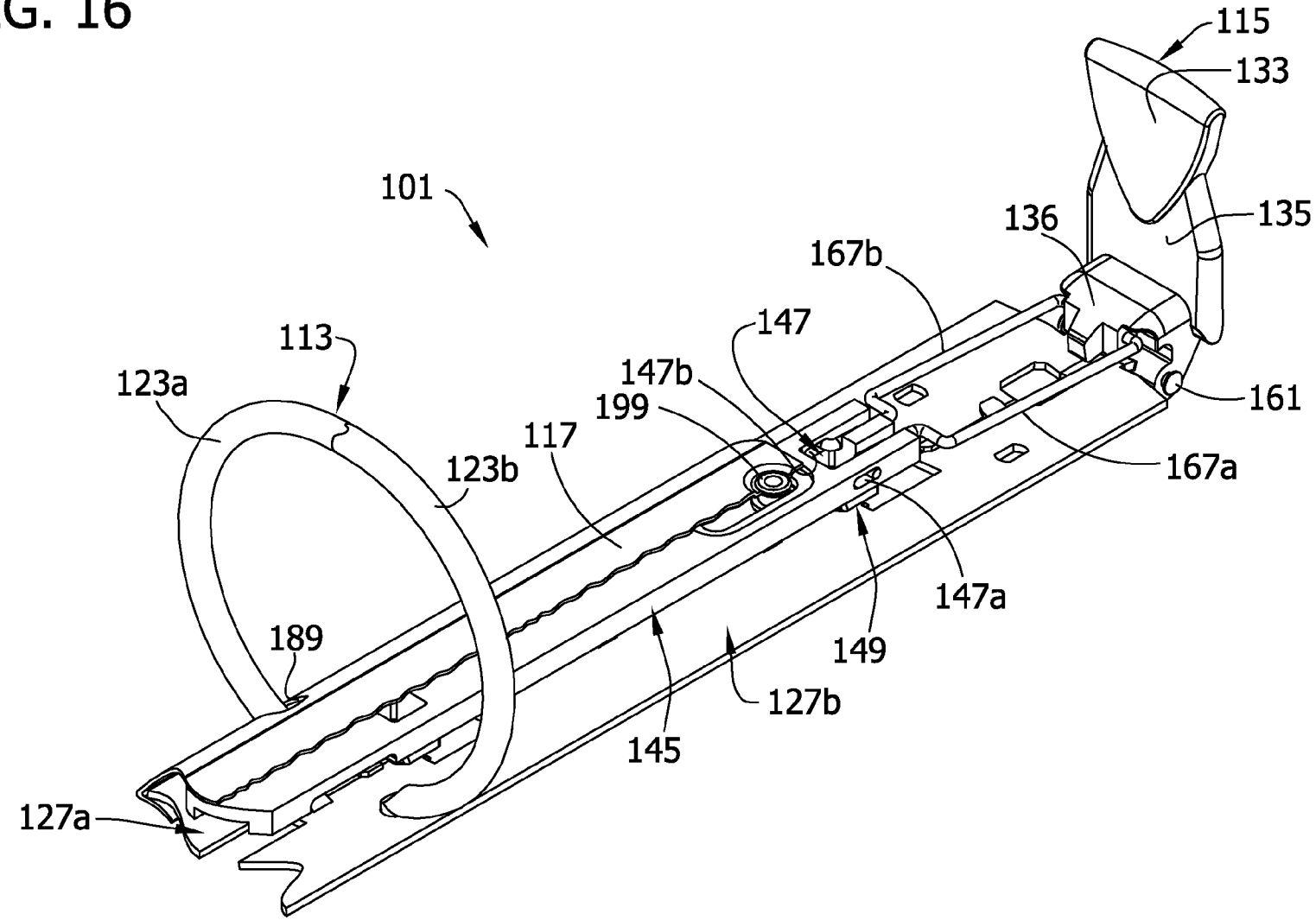
FIG. 16 is an enlarged fragmentary perspective of the ring binder mechanism of FIG. 14 with a portion of a housing broken away to reveal internal construction.
Figure 17:
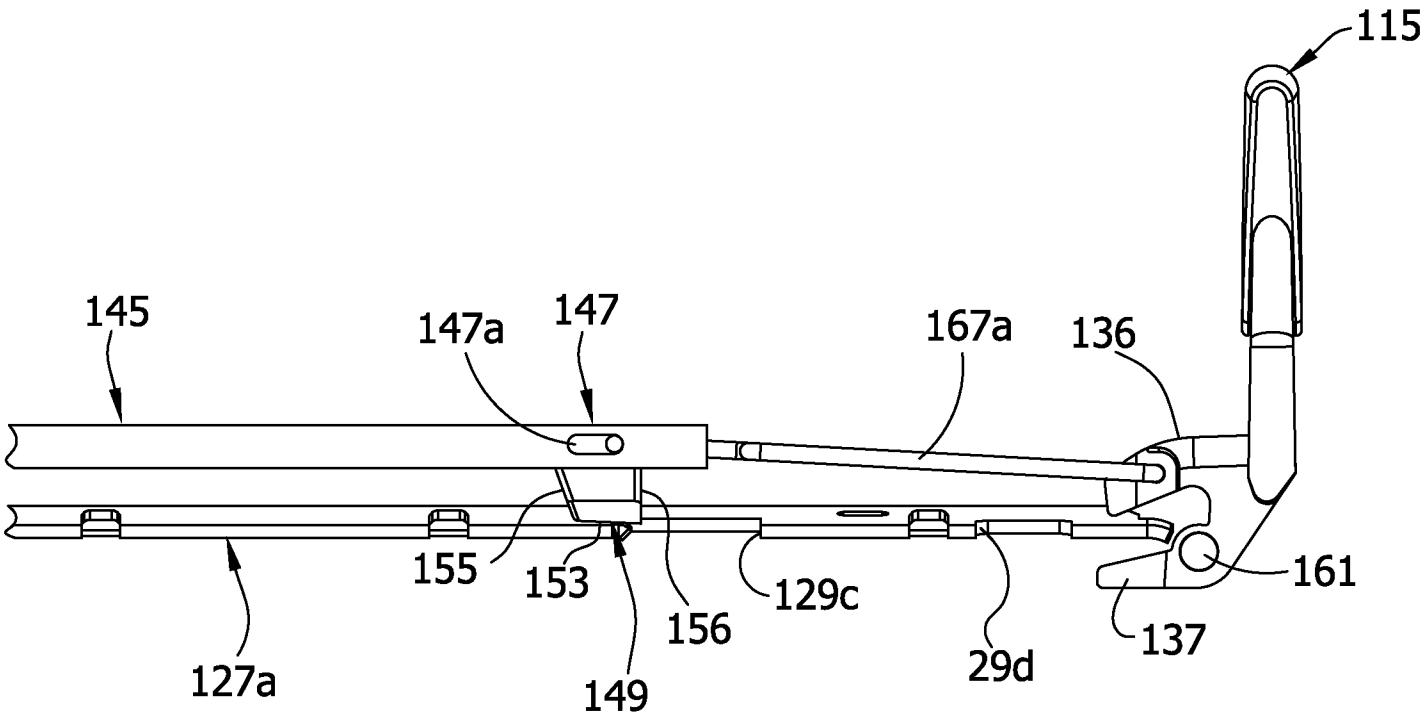
FIG. 17 is an enlarged fragmentary side elevation of the ring binder mechanism with the housing and a hinge plate removed.
Figure 18:
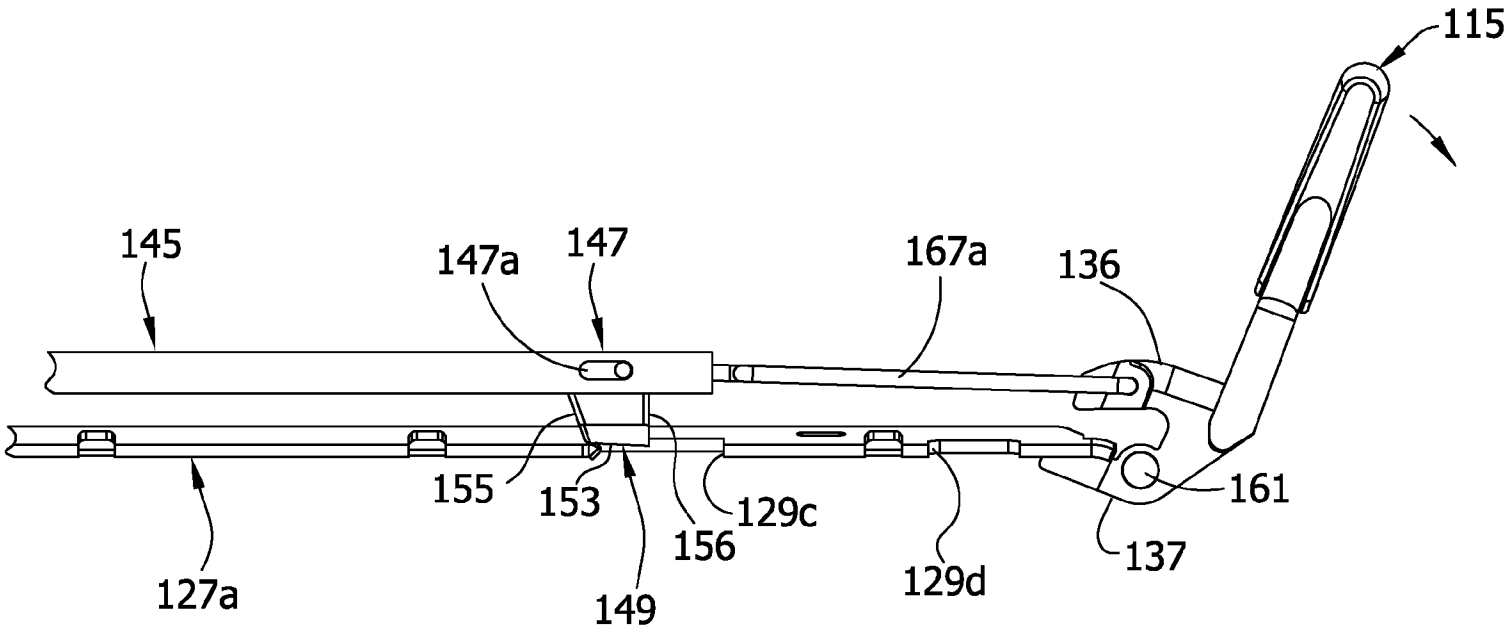
FIG. 18 is an enlarged fragmentary side elevation similar to FIG. 17 but with the lever at a first deformed position.
Figure 19:
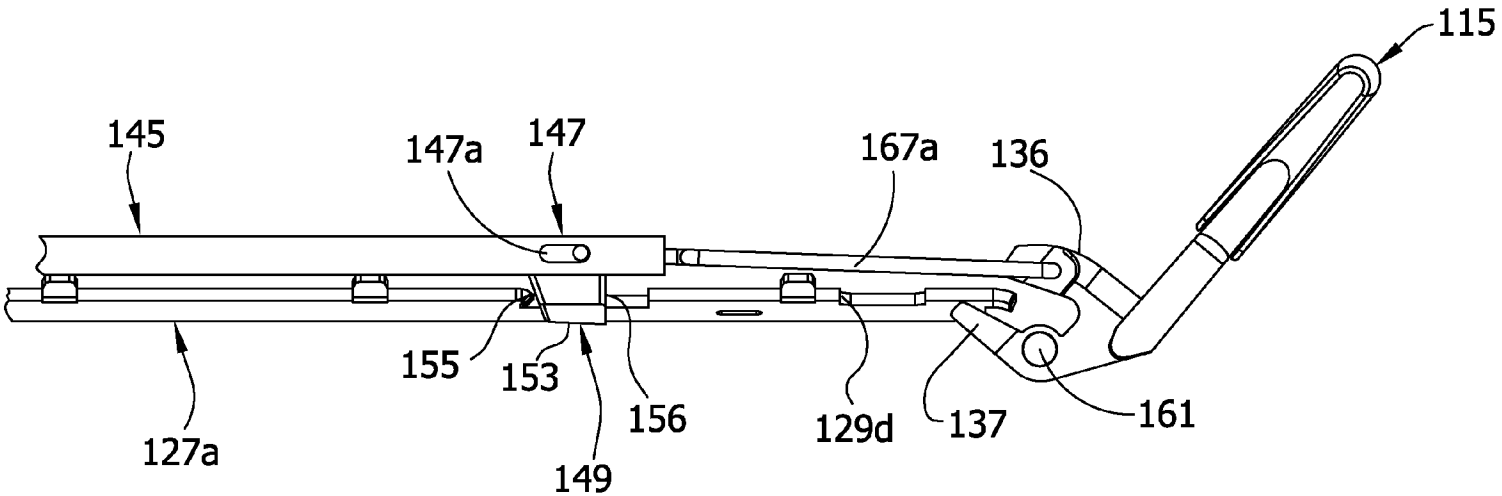
FIG. 19 is an enlarged fragmentary side elevation similar to FIG. 18 but with the ring binder mechanism at the opened position and with the lever in a second deformed position.
Figure 20A:
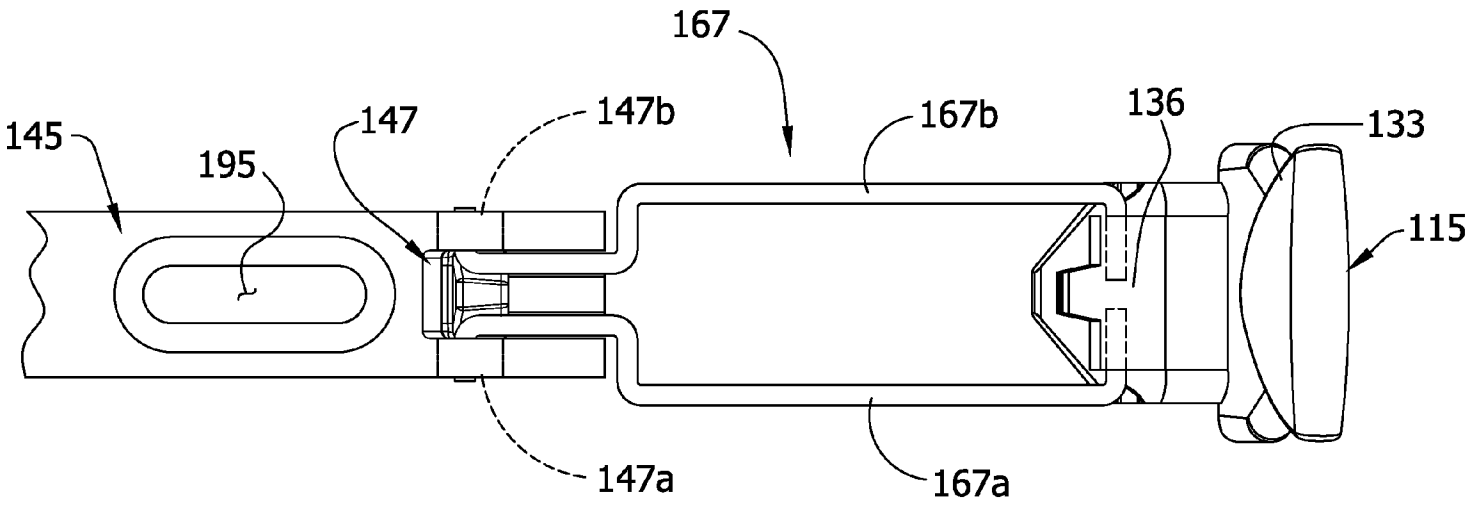
FIGS. 20A and 20B are top plan views illustrating pivoting movement of the lever toward the closed and locked position and the concurrent movement of the intermediate connector.
Figure 20B:
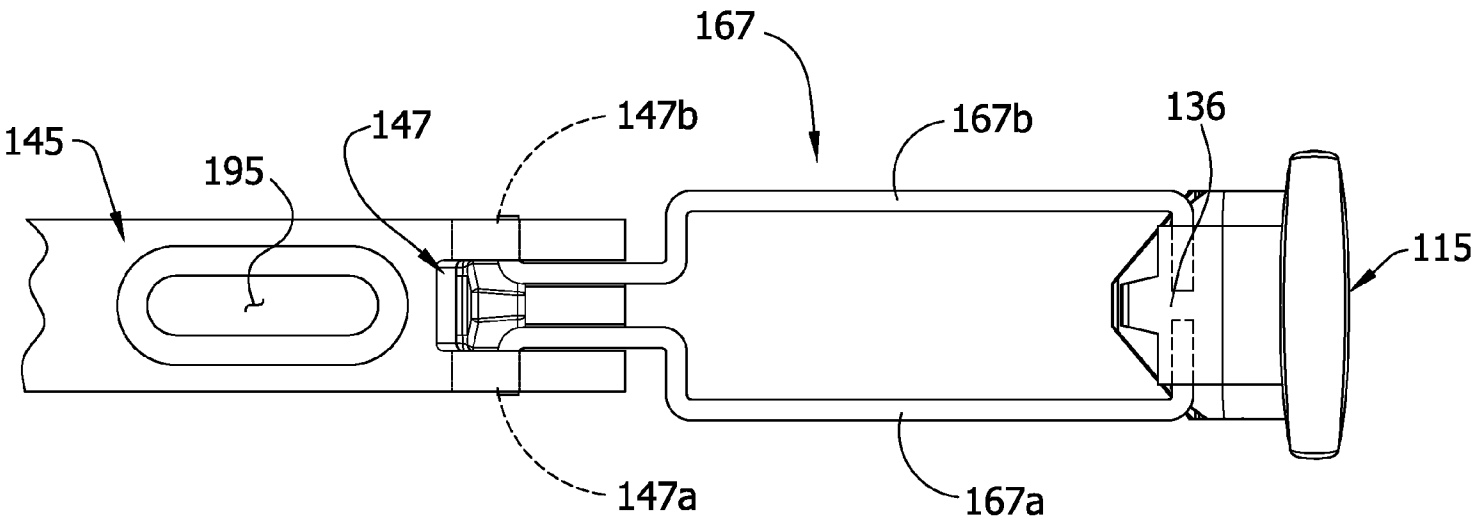
Figure 21:
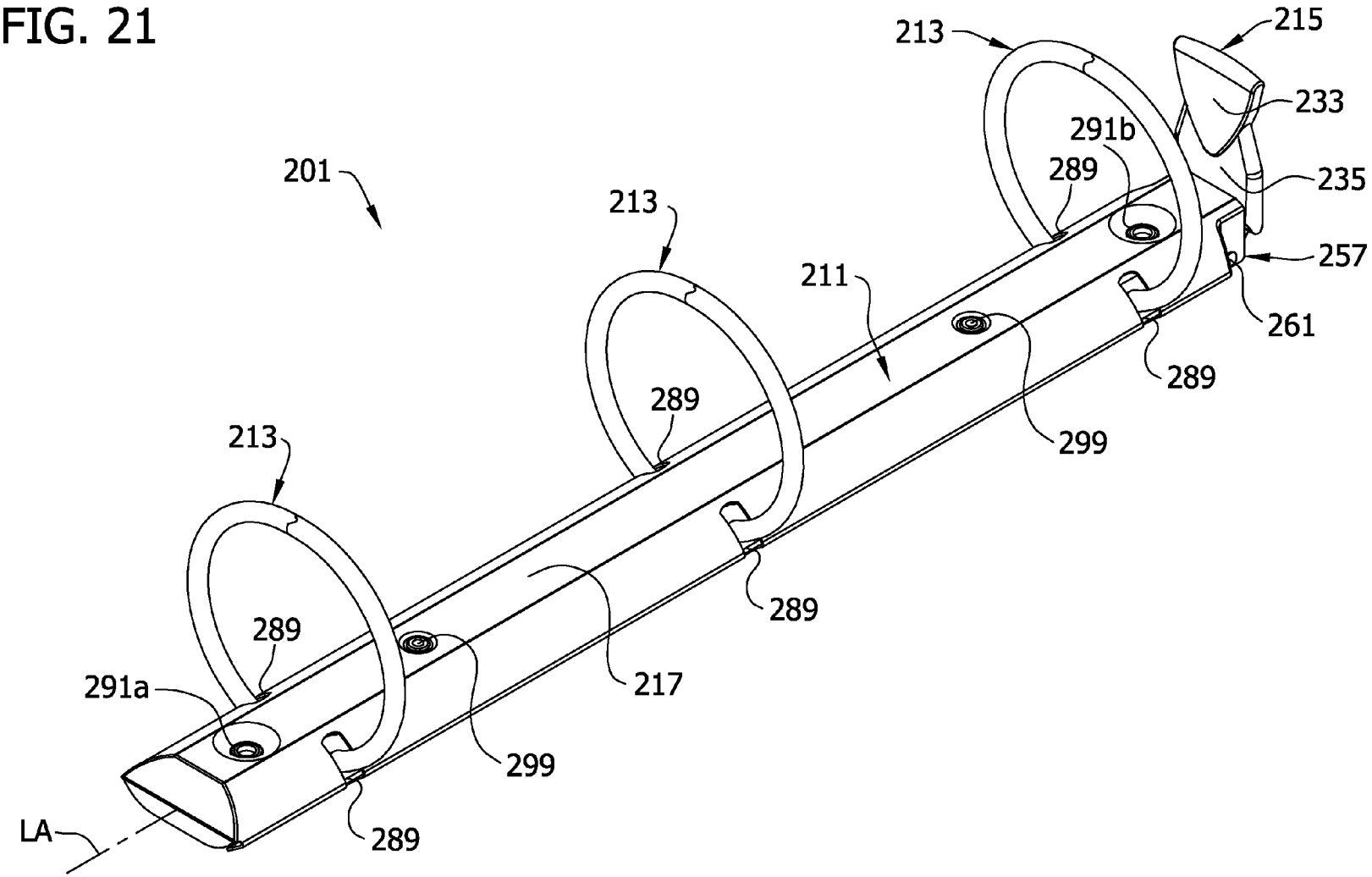
FIG. 21 is a top side perspective of a third embodiment of a ring binder mechanism at a closed and locked position and with the lever in a first relaxed position.
Figure 22:
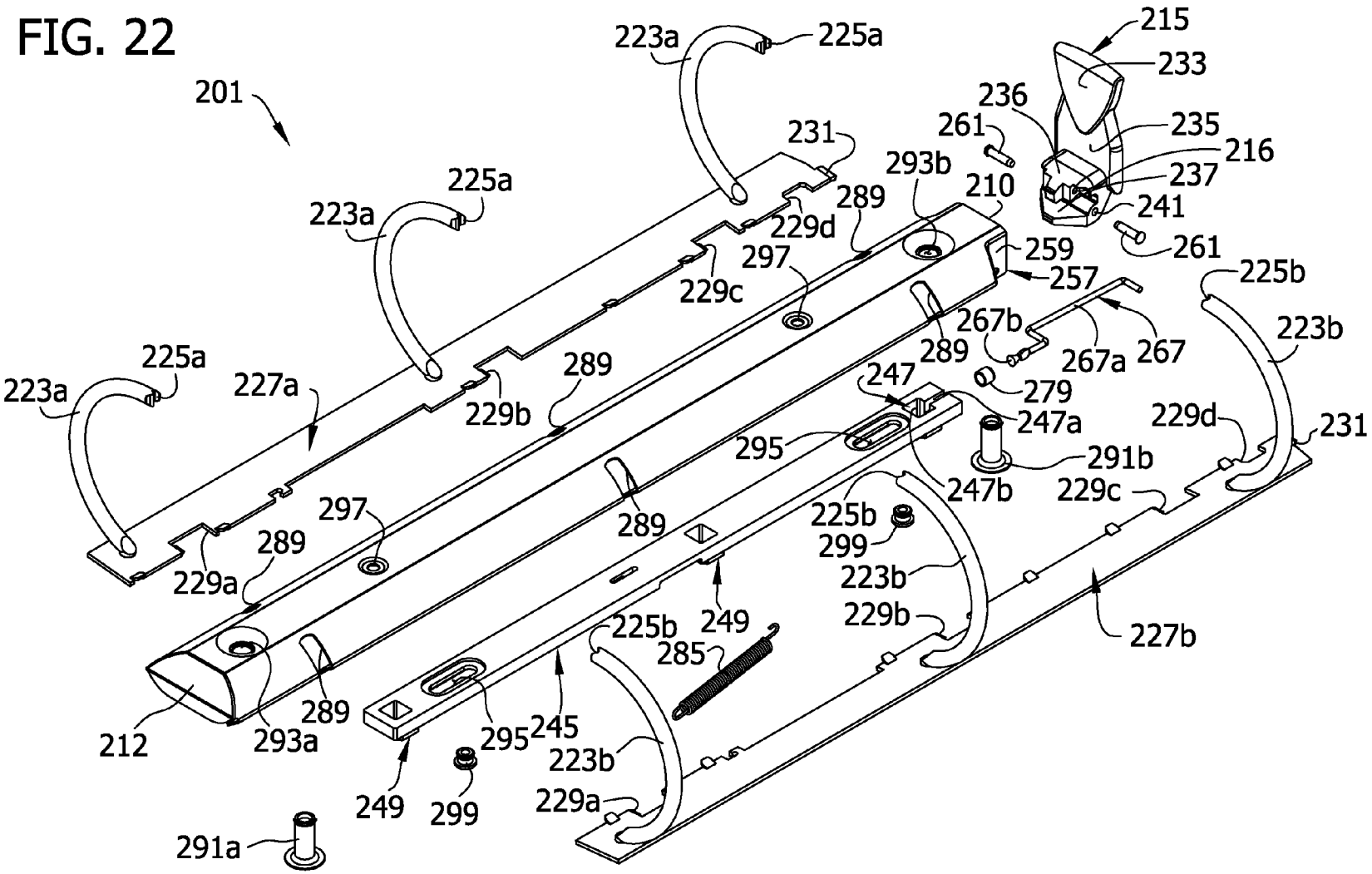
FIG. 22 is an exploded perspective of the ring binder mechanism.
Figure 23:
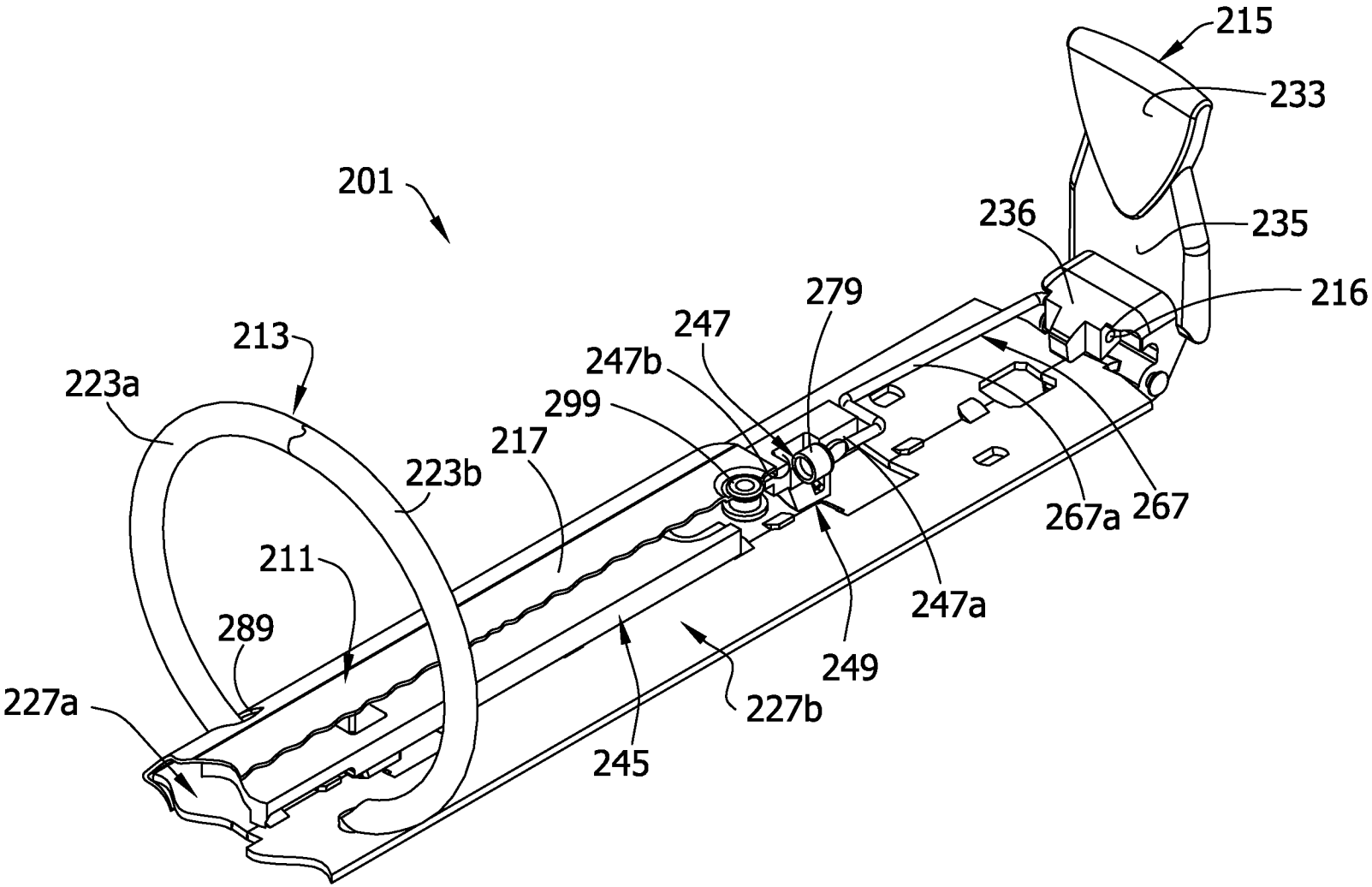
FIG. 23 is an enlarged fragmentary perspective of the ring binder mechanism of FIG. 21 with a portion of a housing broken away to reveal internal construction.

Operation for this embodiment is substantially the same as previously described embodiment illustrated in FIGS. 1-13B. When ring members 123*a*, 123*b* are in the closed position, the wires 167*a*, 167*b* are seated at a rearward end of the elongate openings 147*a*, 147*b* in the mounting groove 147 of the travel bar 145 (FIGS. 16, 17, and 20B). When the lever 115 pivots to open the ring members 123*a*, 123*b* (FIG. 18), the wires 167*a*, 167*b* immediately pull the travel bar 145 and locking elements 149 from a locked position behind hinge plates 127*a*, 127*b* to an unlocked position in registration with openings 129*a*, 129*b*, 129*c* in the hinge plates (FIG. 19). When the lever 115 pivots to close the ring members 123*a*, 123*b* (FIG. 20A), the wires 167*a*, 167*b* move forward within the elongate openings 147*a*, 147*b* relative to the travel bar 145. When the hinge plates 127*a*, 127*b* pivot downward and over the locking elements 149, a tension spring 185 (broadly, a "biasing member") urges the travel bar 145 and locking elements 149 back to the locked position with the locking elements behind the hinge plates.

Figure 24:
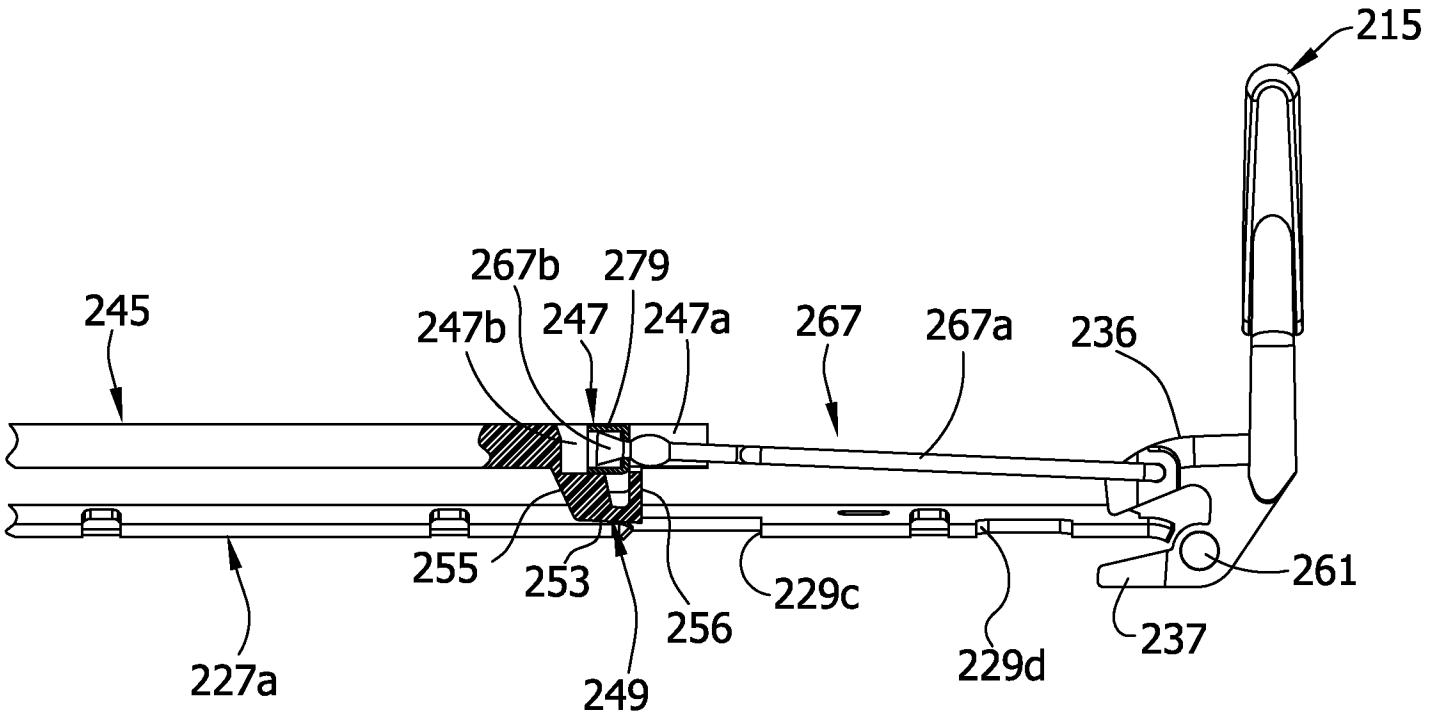
FIG. 24 is an enlarged fragmentary side elevation of the ring binder mechanism with the housing and a hinge plate removed.
Figure 25:
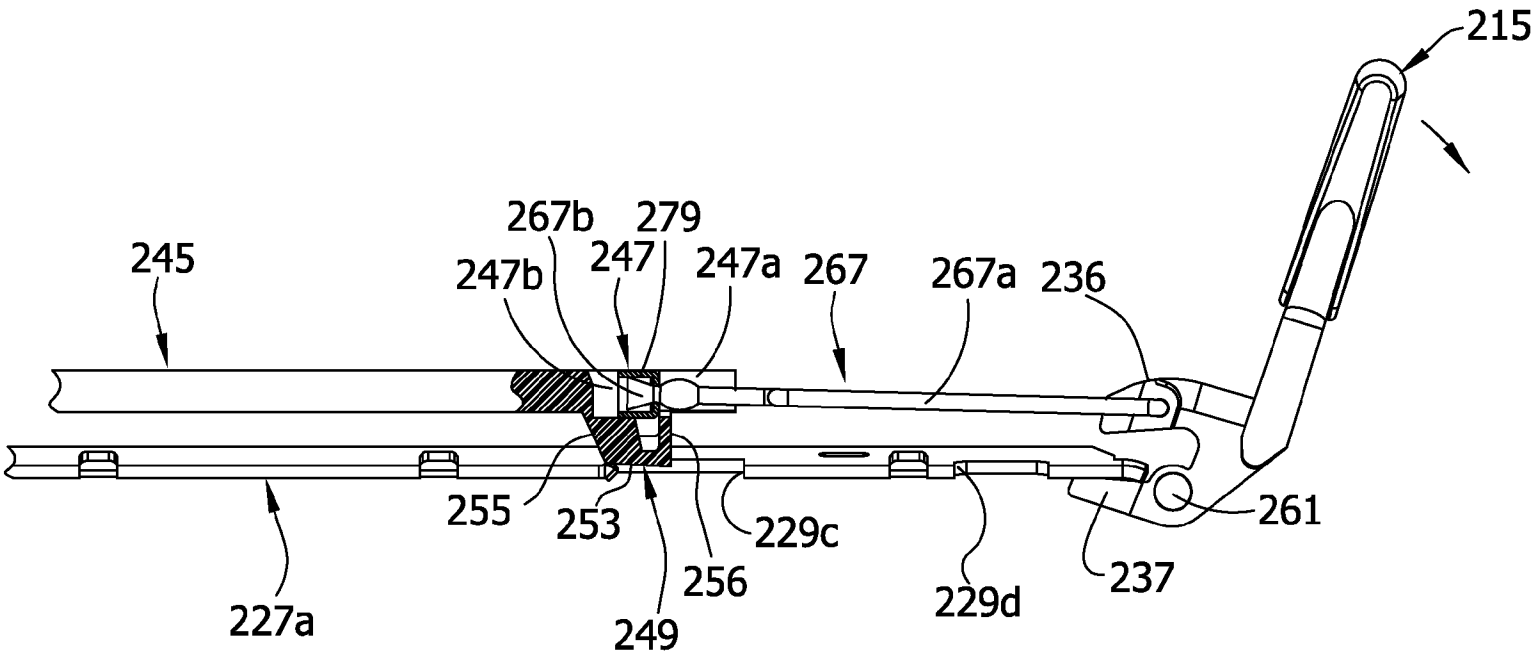
FIG. 25 is an enlarged fragmentary side elevation similar to FIG. 24 but with the lever at the first deformed position.
Figure 26:
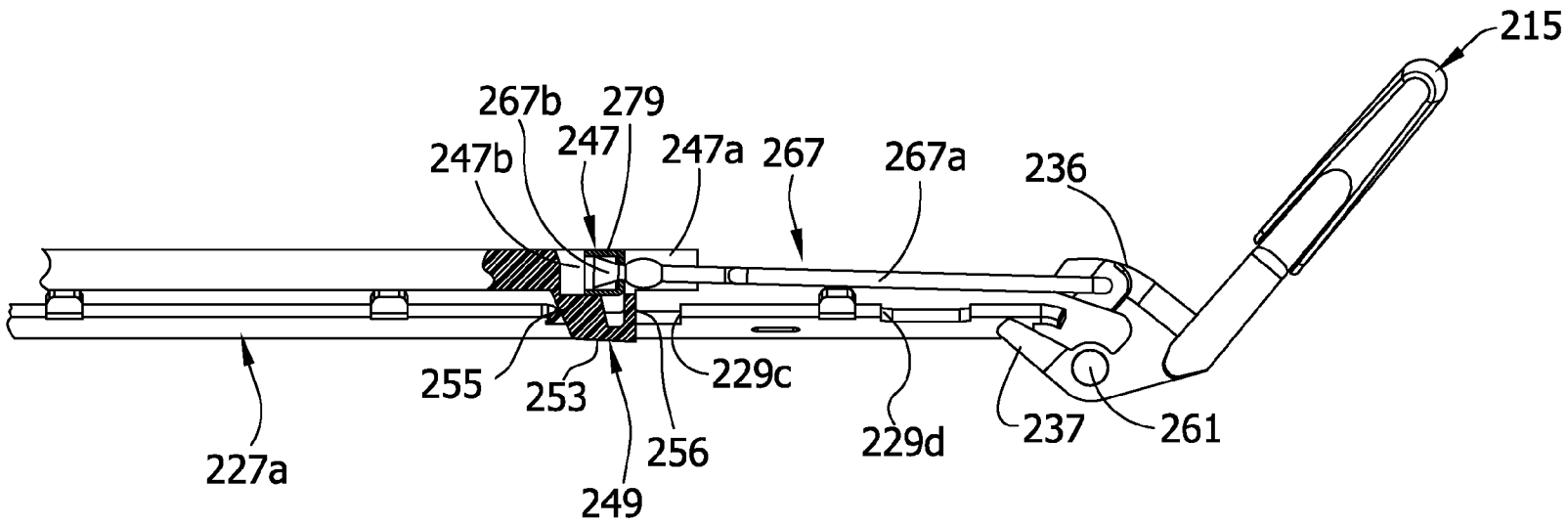
FIG. 26 is an enlarged fragmentary side elevation similar to FIG. 25 but with the ring binder mechanism at the opened position and with the lever in a second deformed position.
Figure 27A:
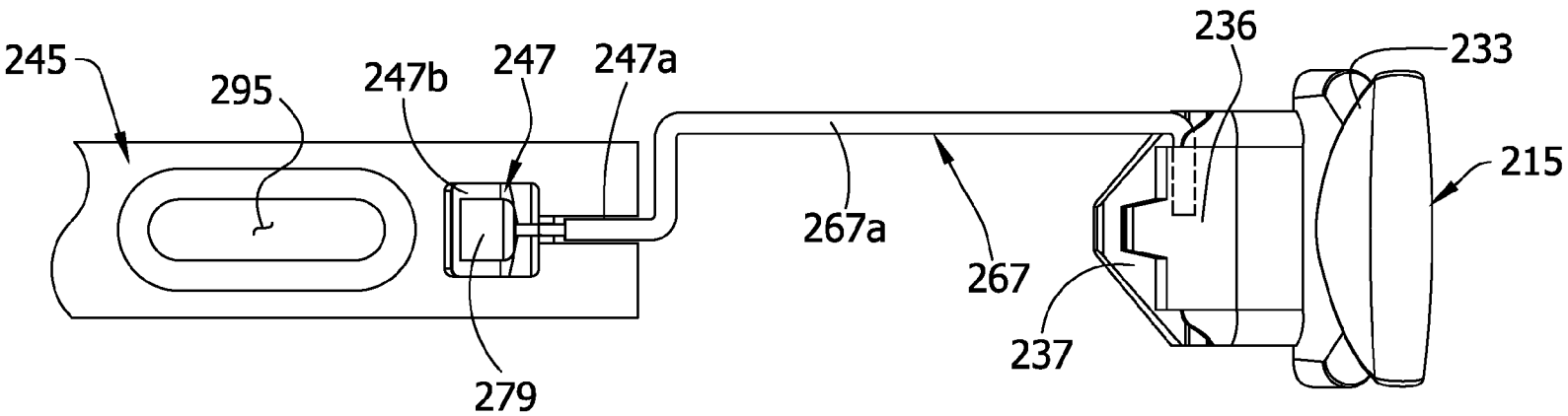
FIGS. 27A and 27B are top plan views illustrating pivoting movement of the lever toward the closed and locked position and the concurrent movement of the intermediate connector.
Figure 27B:
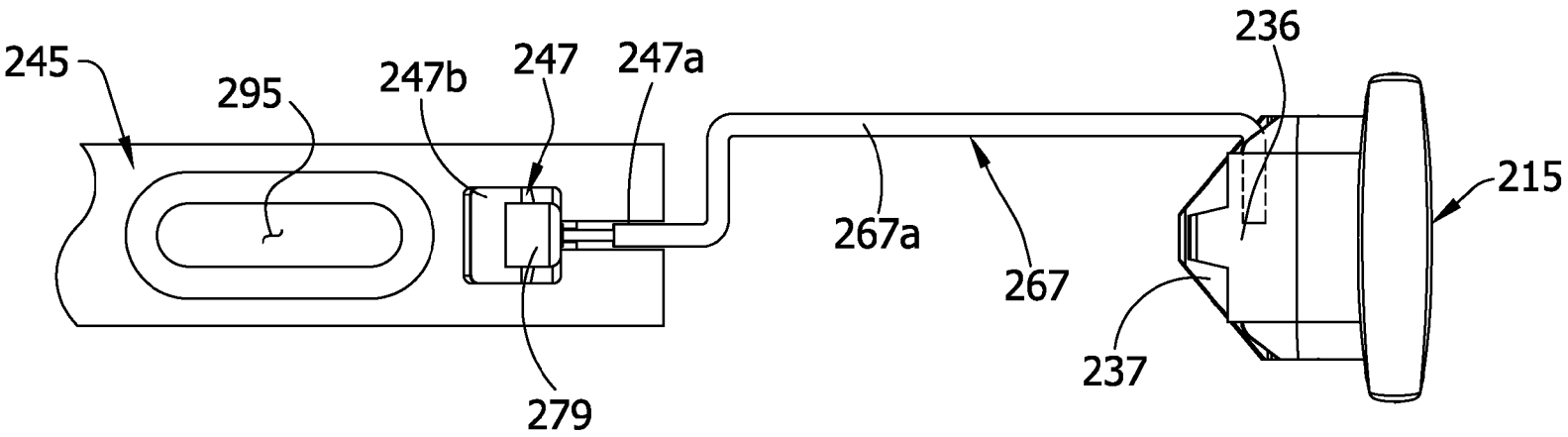
Figure 28:
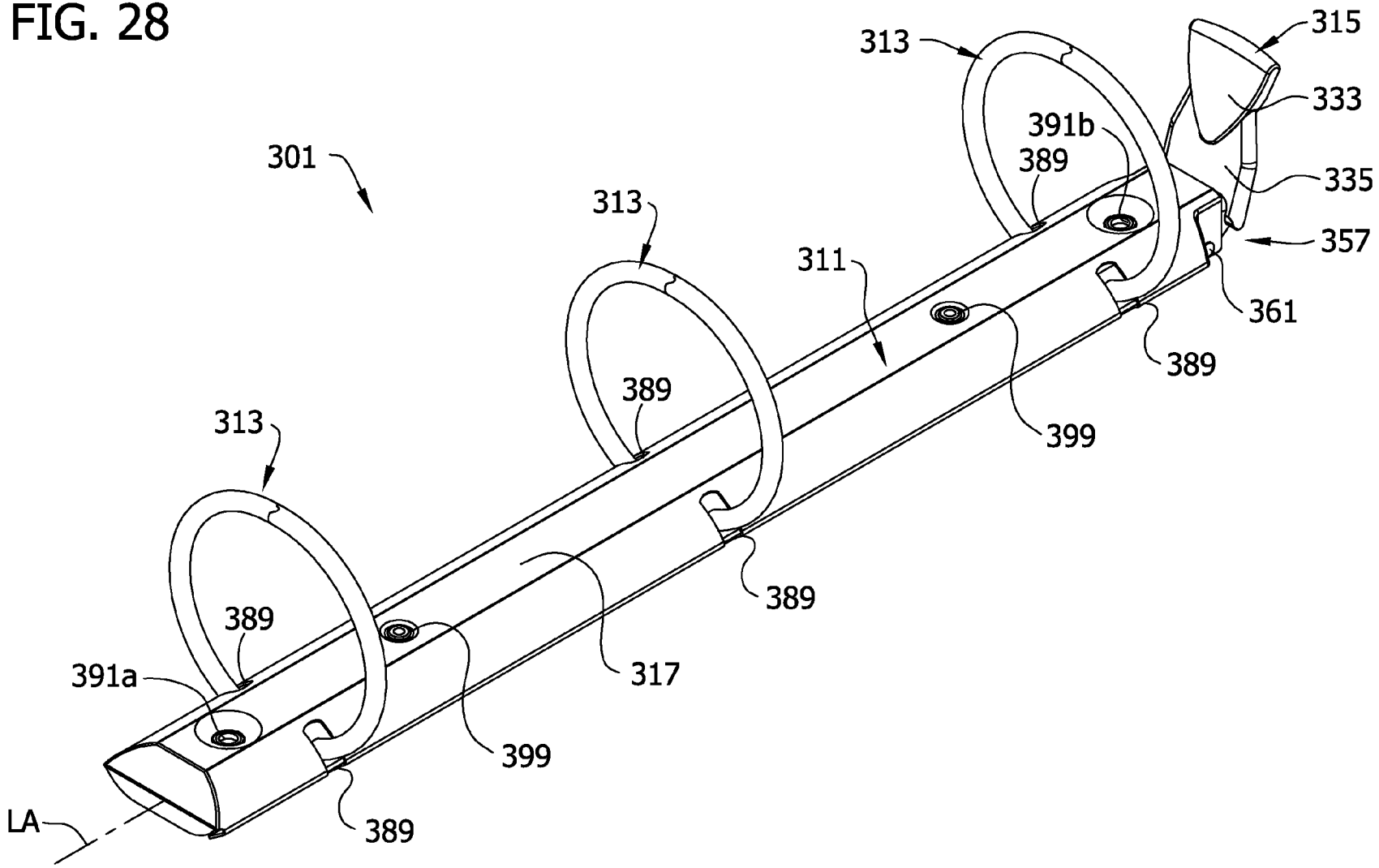
FIG. 28 is a top side perspective of a fourth embodiment of a ring binder mechanism at a closed and locked position and with the lever in a first relaxed position.
Figure 29:
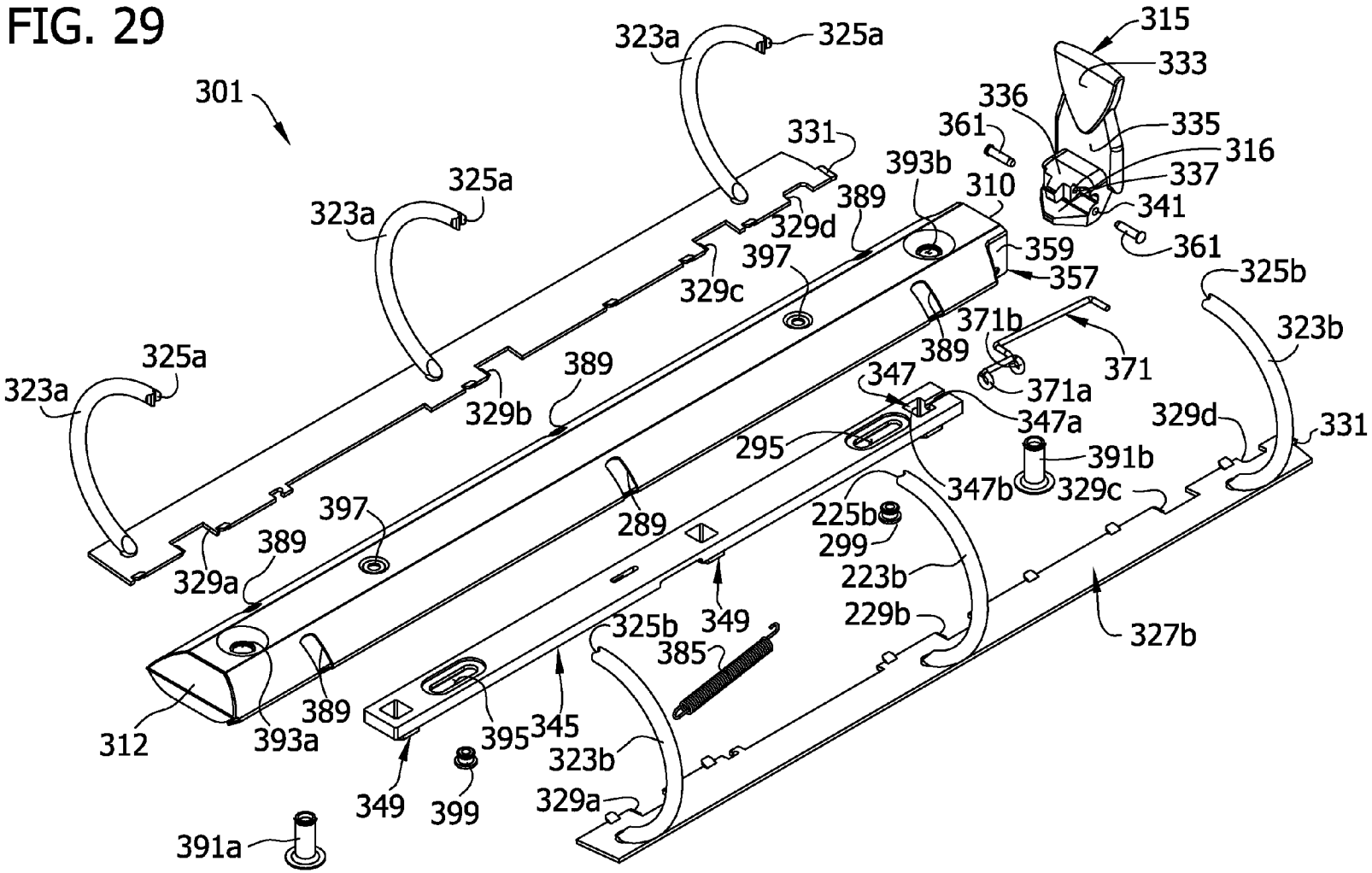
FIG. 29 is an exploded perspective of the ring binder mechanism.

FIGS. 21-27B illustrate a third embodiment of a ring binder mechanism 201 in which an intermediate connector 167 comprises a cup 279 and a wire 267*a* having an enlarged head 267*b*. The wire 267*a* connects to a lever 215 at an opening 216 in one side of an upper lip 236 of the lever. The cup 279 is located in a wider section 247*b* of a mounting groove 247 of a travel bar 245. A narrower section 247*a* of the mounting groove 247 receives the wire 267*a* therethrough and into the wider section 247*b* so the enlarged head 267*b* is seated in the cup 279 when ring members 223*a*, 223*b* are closed (FIGS. 24 and 27B). The wire 267*a* is crimped behind the cup 279 to secure the cup on the wire. As a result, the cup 279 moves conjointly with the wire 267*a*.

Operation is again substantially the same as previously described embodiments. When the lever 215 pivots to open the ring members 223*a*, 223*b* (FIG. 25), the wire 267*a* immediately pulls on the cup 279 and travel bar 245 and moves locking elements 249 of the travel bar to an unlocked position. When the lever 215 pivots to close the ring members 223*a*, 223*b*, the wire 267*a* and cup 279 move inward relative to the travel bar 245 (FIG. 27A). Once hinge plates 227*a*, 227*b* mounting the ring members 223*a*, 223*b* pivot downward and over the locking elements 249, a tension spring 285 (broadly, a "biasing member") urges the travel bar 245 and locking elements to the locked position.

Figure 30:
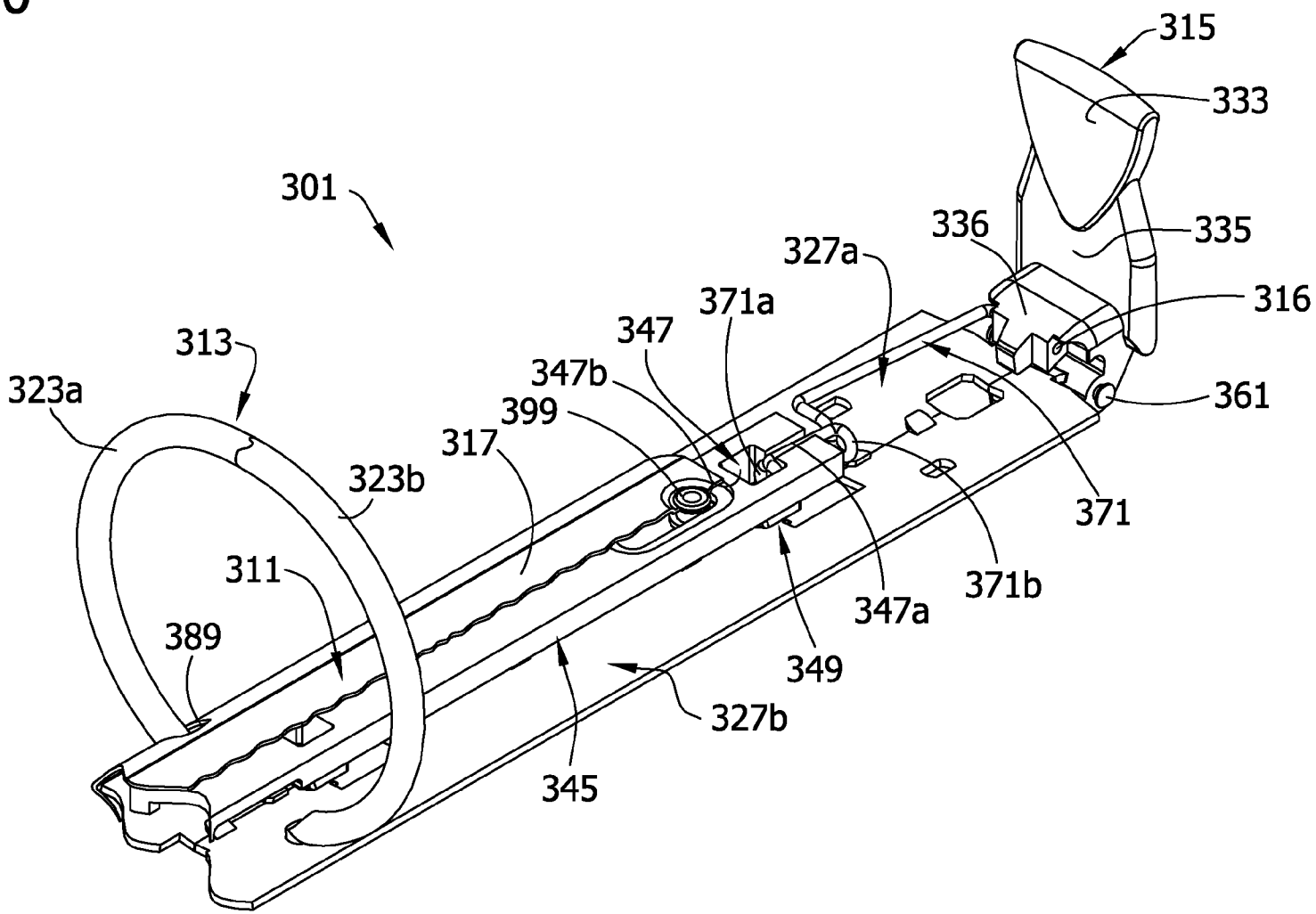
FIG. 30 is an enlarged fragmentary perspective of the ring binder mechanism of FIG. 28 with a portion of a housing broken away to reveal internal construction.
Figure 31:
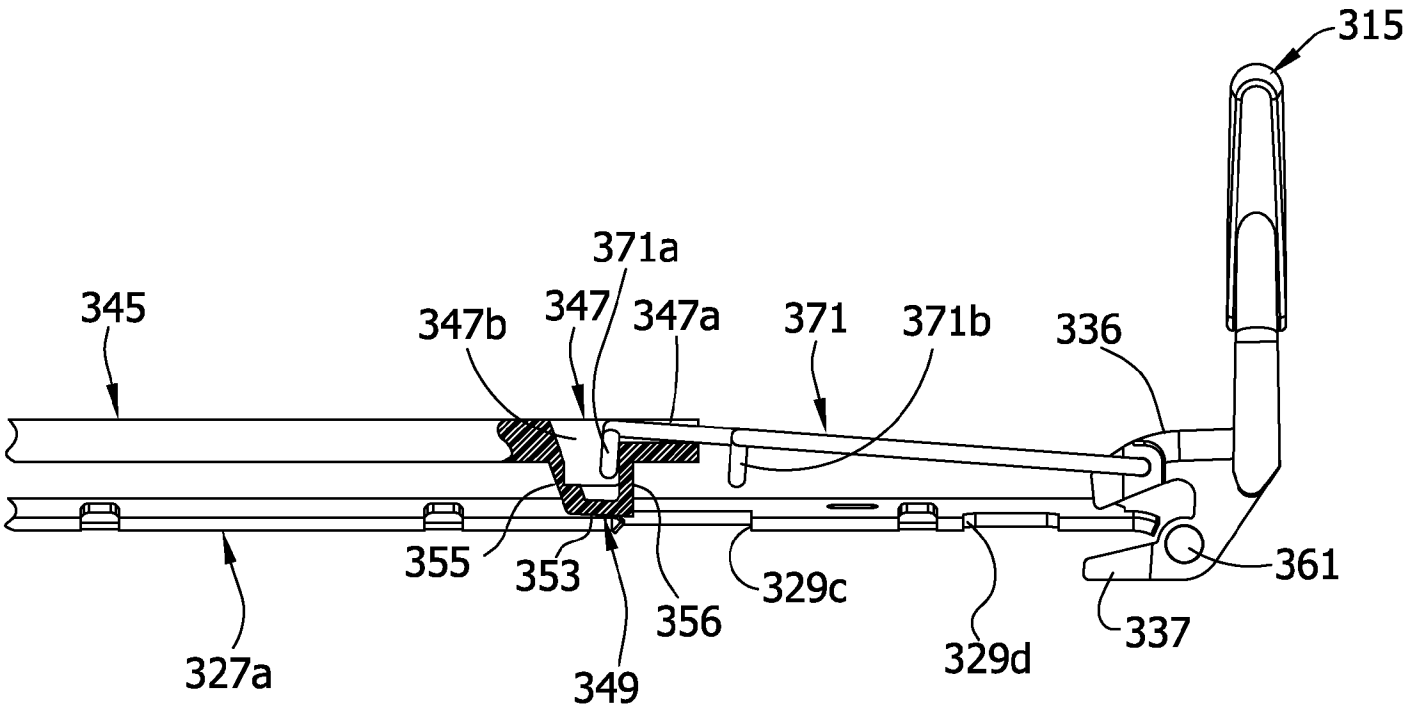
FIG. 31 is an enlarged fragmentary side elevation of the ring binder mechanism with the housing and a hinge plate removed.
Figure 32:
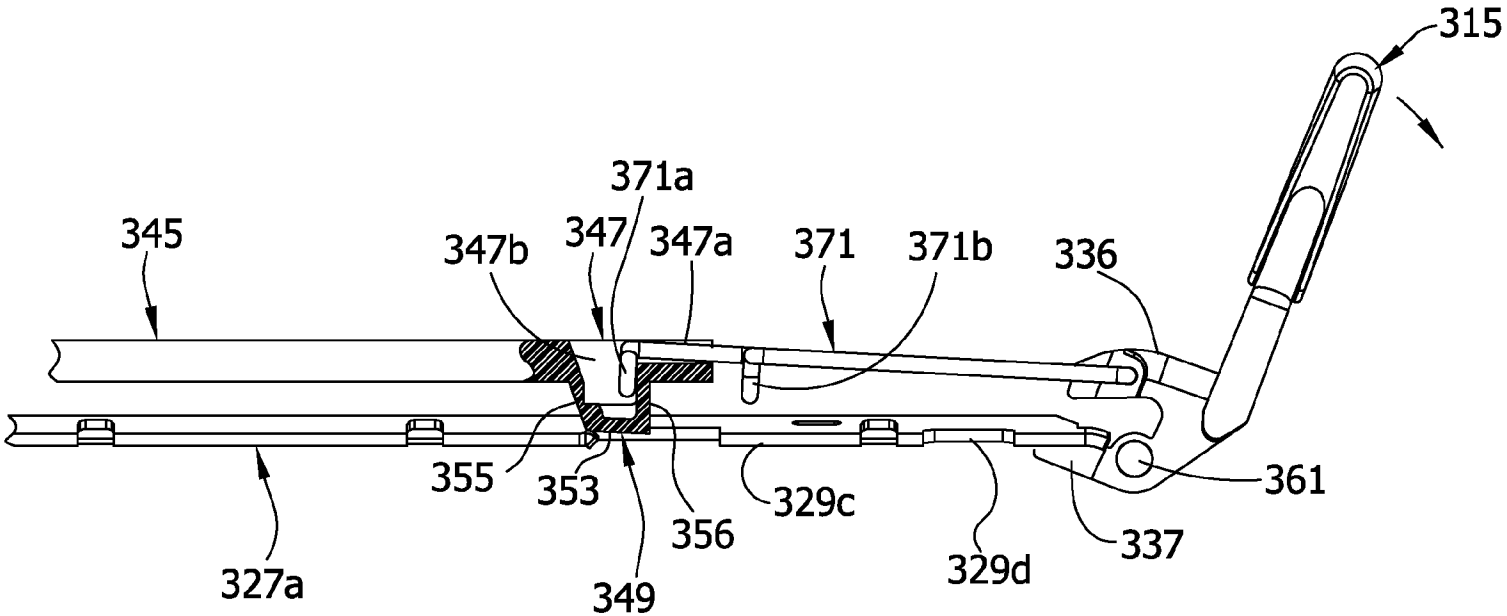
FIG. 32 is an enlarged fragmentary side elevation similar to FIG. 31 but with the lever at the first deformed position.
Figure 33:
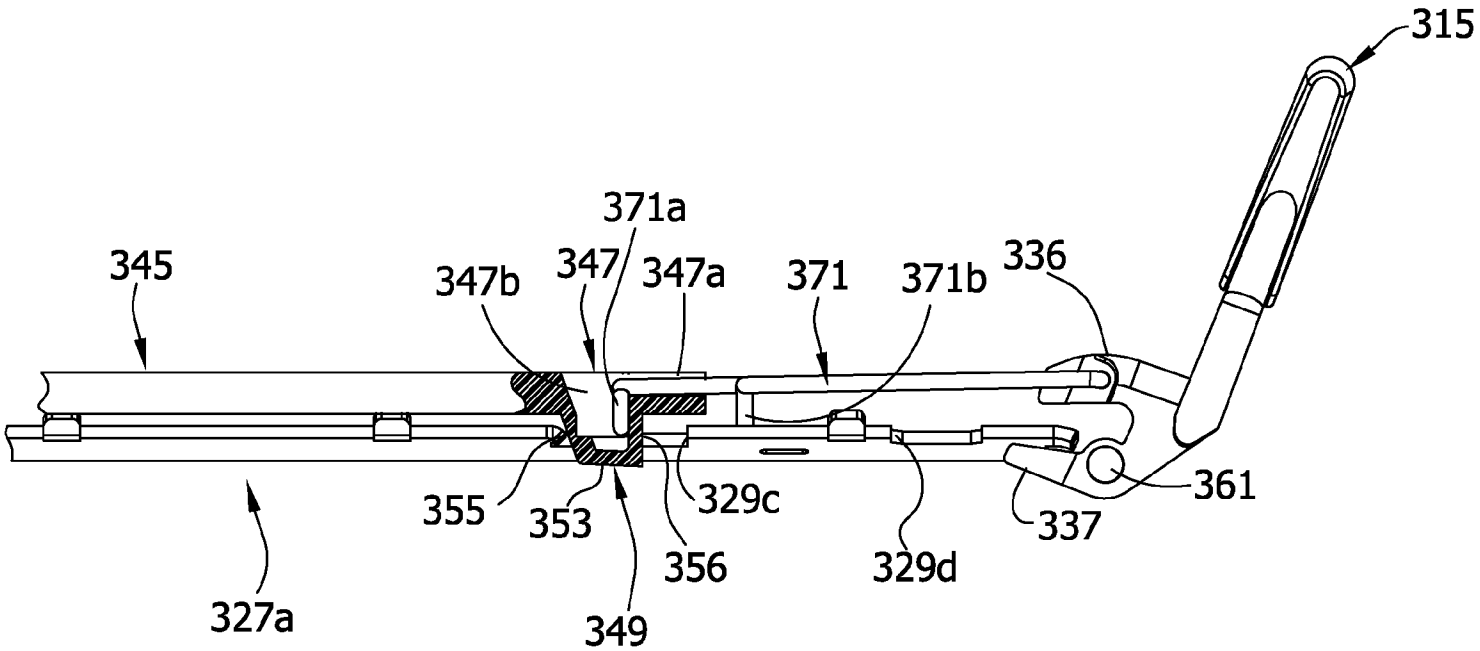
FIG. 33 is an enlarged fragmentary side elevation similar to FIG. 32 but with the ring binder mechanism at the opened position and with the lever in a second deformed position.
Figure 34A:
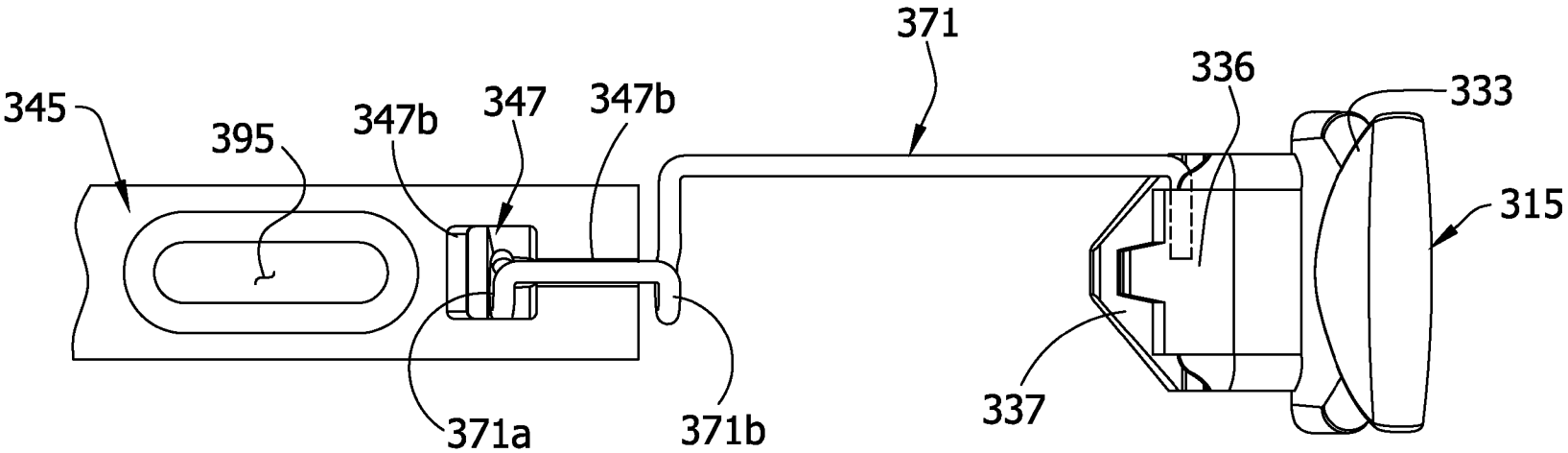
FIGS. 34A and 34B are top plan views illustrating pivoting movement of the lever toward the closed and locked position and the concurrent movement of the intermediate connector.
Figure 34B:
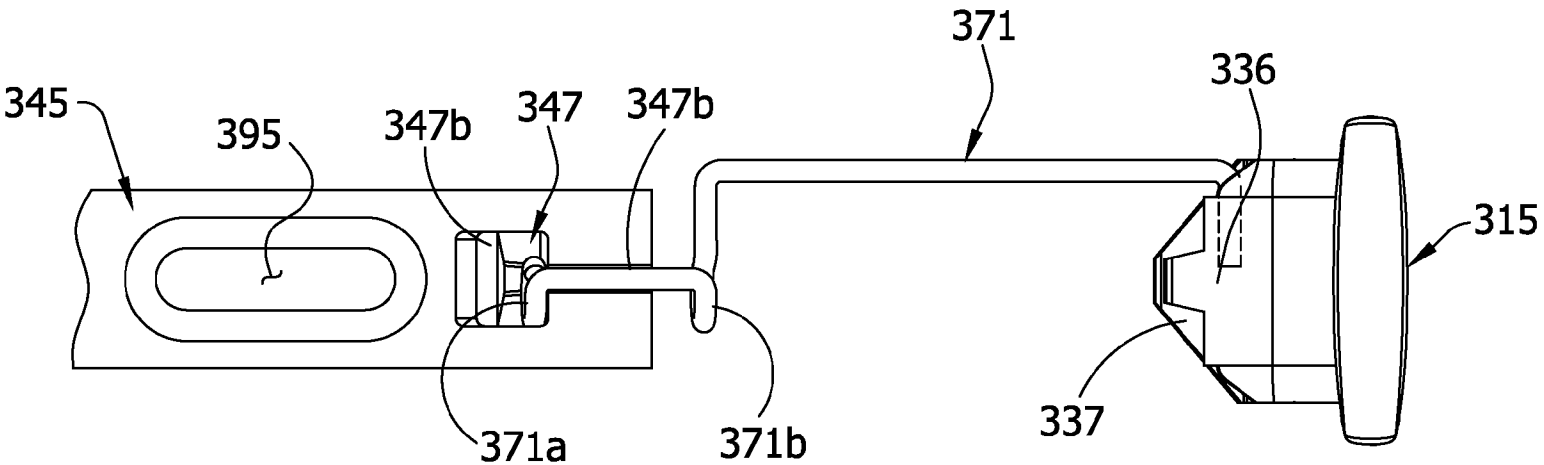

FIGS. 28-34B illustrate a fourth embodiment of a ring binder mechanism 301 in which an intermediate connector 367 comprises a wire 371 bent to form a pair of spaced apart loops 371*a*, 371*b* (broadly, "stops"). The wire 371 connects to a lever 315 at an opening 316 in one side of an upper lip 336 of the lever. A first of the loops 371*a* is positioned in a wider section 347*b* of a mounting groove 347 of a travel bar 345, and a second of the loops 371*b* is outside the mounting groove. More specifically, the second loop 371*b* is located adjacent an end of the travel bar 345. As a result, a portion of the travel bar 345 between its end and the mounting groove 347 is captured by the loops 371*a*, 371*b* thereby securing the intermediate connector 367 to the travel bar. The first loop 347*a* within the mounting groove 347 is positioned adjacent the outward end of the mounting groove when ring members 323*a*, 323*b* are closed (FIGS. 30, 31 and 34B). Operation is again substantially the same as previously described embodiments. When the lever 315 pivots to open the ring members 323*a*, 323*b*, the end loop 371*a* of the wire 371 simultaneously pulls on the travel bar 345 and moves locking elements 349 to the unlocked position (FIGS. 32 and 33). When the lever 315 pivots to close the ring members 323*a*, 323*b*, the loop 371*a* of the wire 371 moves forward within the mounting groove 347 relative to the travel bar 345 (FIG. 34A). Once hinge plates 327*a*, 327*b* pivot downward and over the locking elements 349, an extension spring 385 (broadly, a "biasing member")

urges the travel bar 345 and locking elements 349 to the locked position (FIGS. 30 and 31).

Figure 35:
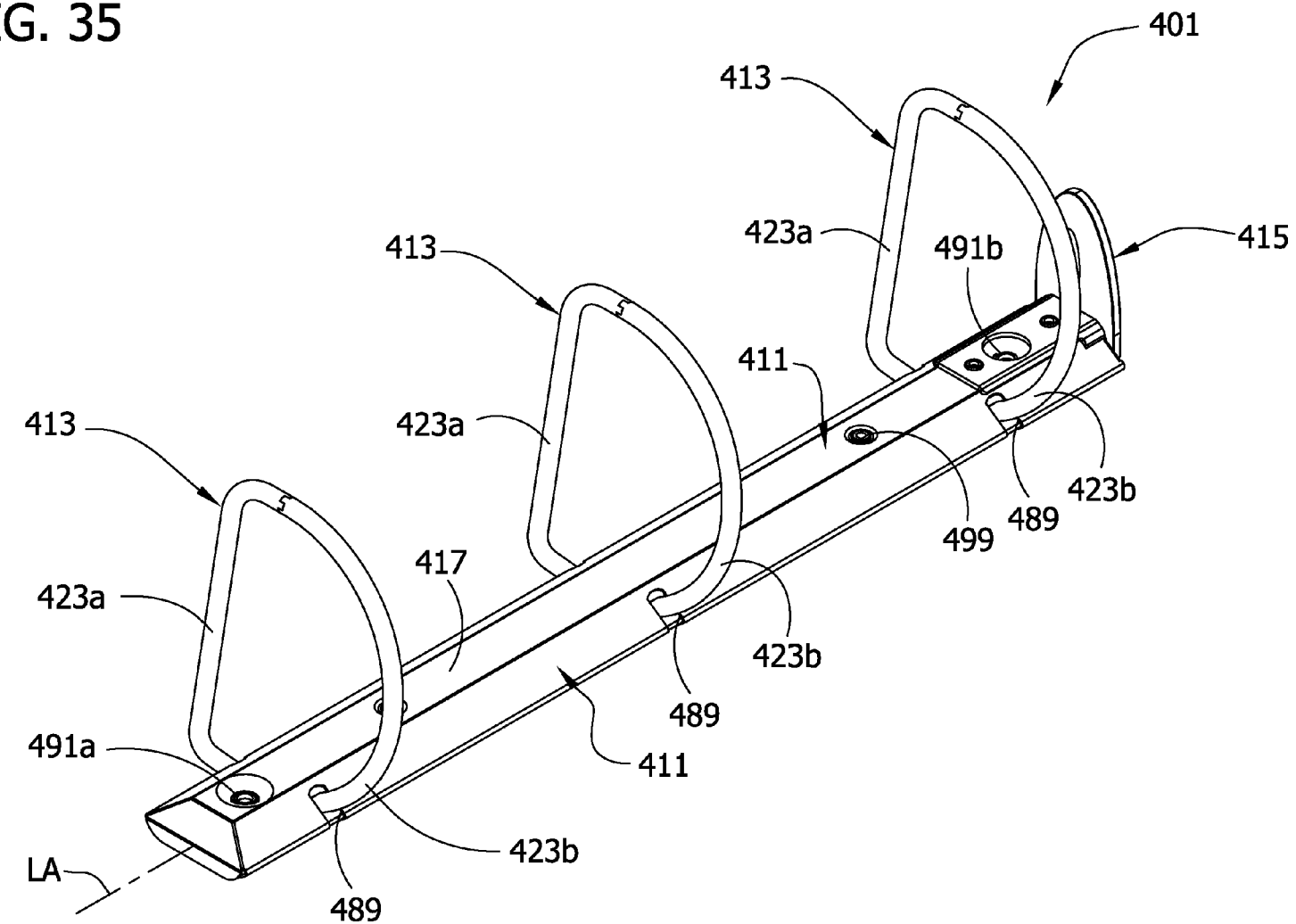
FIG. 35 is a top side perspective of a fifth embodiment of a ring binder mechanism at a closed and locked position and with the lever in a first relaxed position.
Figure 36:
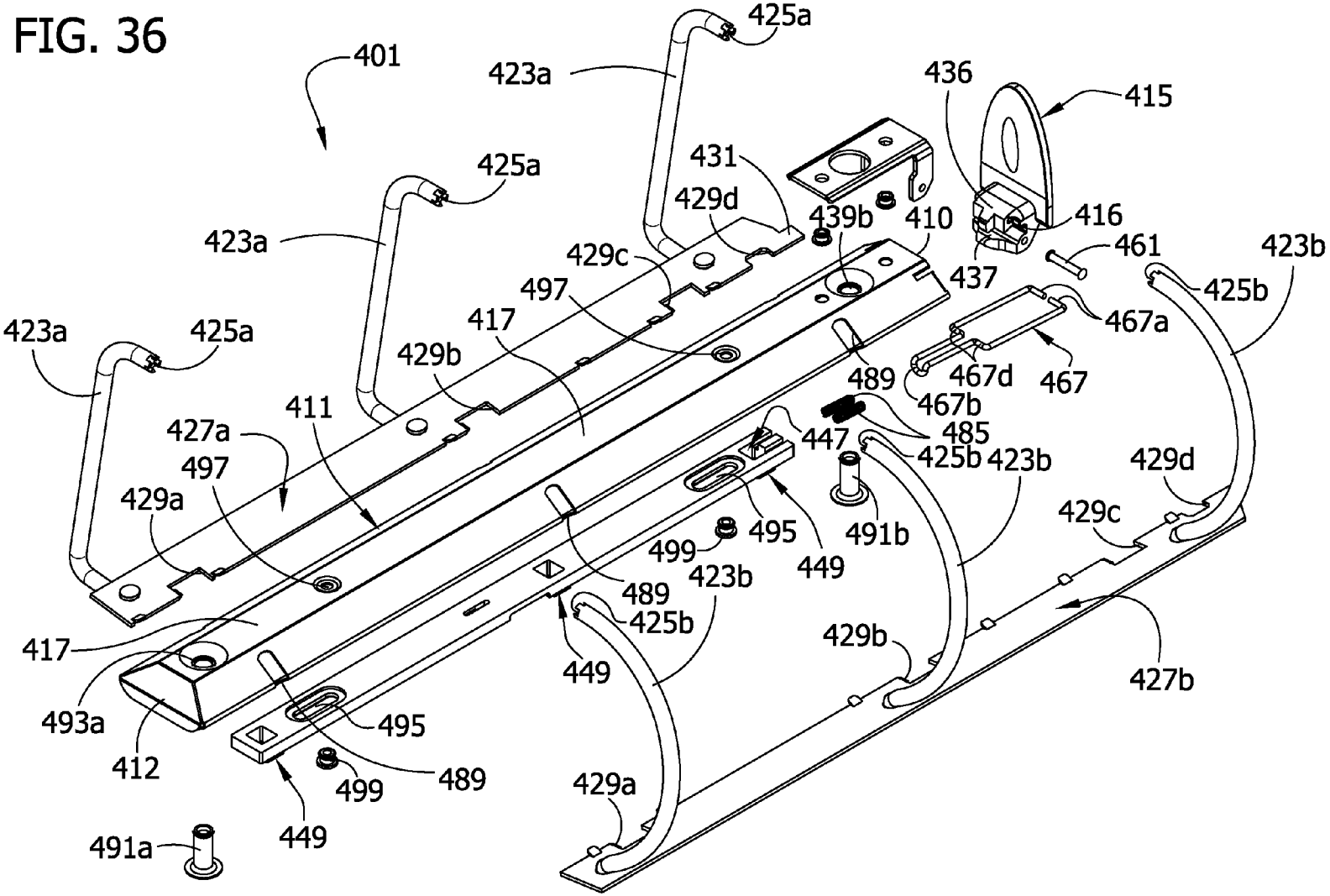
FIG. 36 is an exploded perspective of the ring binder mechanism.
Figure 37:
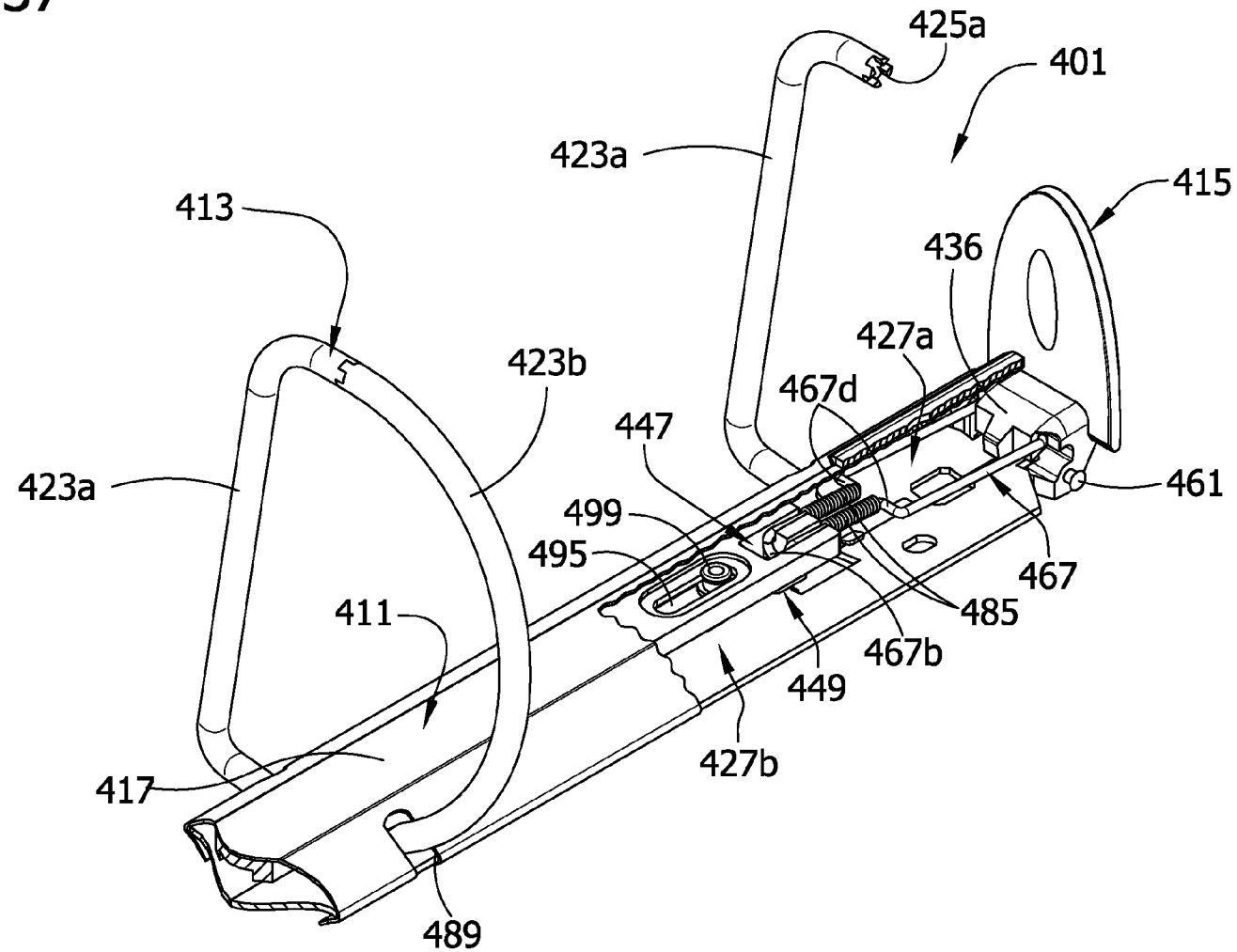
FIG. 37 is an enlarged fragmentary perspective of the ring binder mechanism of FIG. 35 with a portion of a housing broken away to reveal internal construction.
Figure 38:
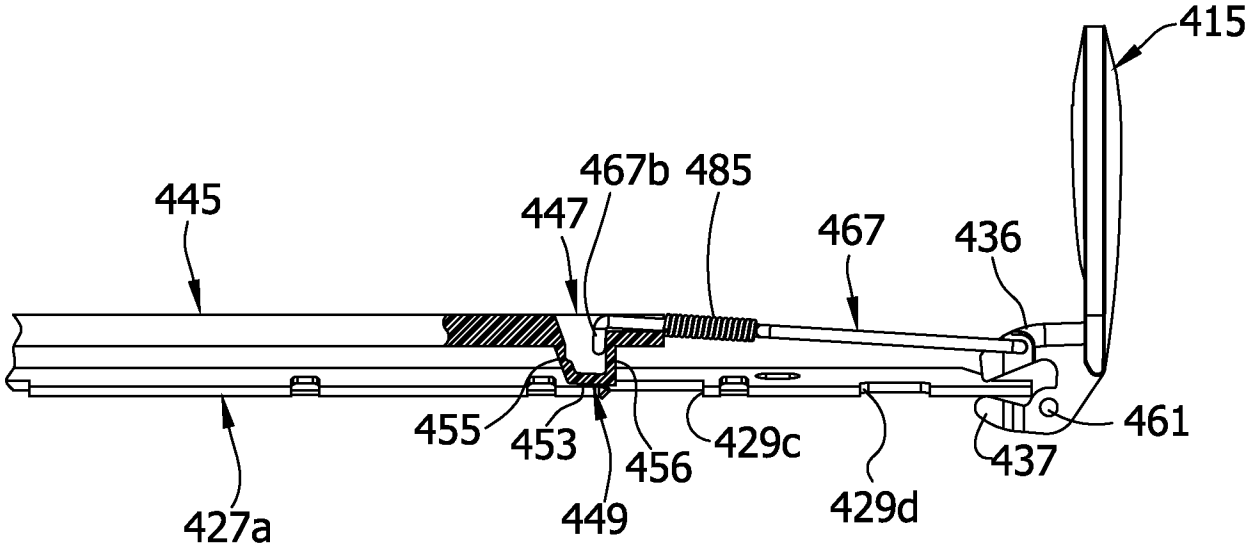
FIG. 38 is an enlarged fragmentary side elevation of the ring binder mechanism with the housing and a hinge plate removed.

FIGS. 35-41B illustrate a ring binder mechanism 401 according to a fifth embodiment. The mechanism 401 of this embodiment is similar to the previously described mechanism, with the following exceptions. As shown in FIG. 35, ring members 423*a*, 423*b* of this embodiment cooperatively form rings 413 having a slanted D-shape when closed. As shown in FIG. 36, an intermediate connector 467 of this embodiment is a wire bent into an elongate, roughly rectangular form. A first end of the intermediate connector 467 is open and includes two free ends 467*a* that fit within openings 416 in an upper lip 436 of a lever 415 to form a pivoting connection. A second, closed end of the intermediate connector 467 is narrowed and includes a downwardly bent end 467*b* that fits within a mounting groove 447 of a travel bar 445. The bent end 467*b* secures the intermediate connector 467 to the travel bar 445 within the mounting groove 447 to pull on the travel bar while still allowing the intermediate connector to move relative to the travel bar in a linear direction along a longitudinal axis of the travel bar. The bent end 467*b* is positioned adjacent an inward end of the mounting groove 447 when the ring members are closed (FIGS. 37 and 38). The mounting groove 447 is generally U-shaped with the arms of the "U" receiving respective sections of the bent end 467*b* of the intermediate connector 467. The bent end 467*b* also allows the intermediate connector 467 to pivot relative to the travel bar 445 to accommodate small vertical movements of the intermediate connector that occur when the lever 415 pivots.

As can be seen with reference to FIGS. 36 and 37, two compression springs 485 (broadly, "biasing members") are located over sections of a narrowed portion 467*c* of the intermediate connector 467. When the intermediate connector 467 is connected to the travel bar 445, the springs 485 are positioned between an end of the travel bar and shoulders 467*c* of the intermediate connector. The bias of the springs 485 urges the travel bar 445 away from the lever 415 and intermediate connector 467. This seats the bent end 467*b* of the intermediate connector 467 against the outward end of the mounting groove 447 of the travel bar 445 when the ring members 423*a*, 423*b* are closed (FIGS. 37 and 38).

Figure 39:
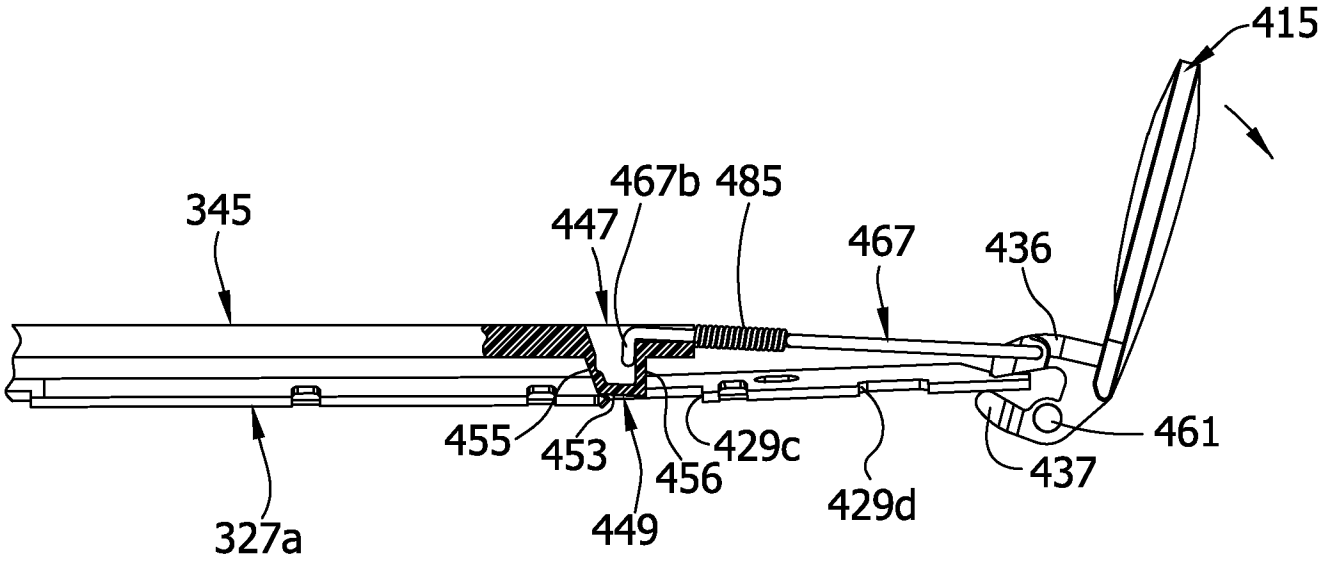
FIG. 39 is an enlarged fragmentary side elevation similar to FIG. 38 but with the lever at the first deformed position.

Operation of the mechanism 401 of this embodiment is also substantially similar to the operation described for the above provided embodiments. FIGS. 37 and 38 illustrate the mechanism 401 in a closed and locked position with the lever 415 in an upright position. To unlock the ring binder mechanism 401 and open the ring members 423*a*, 423*b*, an operator pivots the lever 415 outward and downward (clockwise as indicated by the arrow in FIG. 39). As shown in FIG. 39, a lower lip 437 of the lever 415 is in contact with lower surfaces of hinge plates 427*a*, 427*b* and immediately pushes upward on the hinge plates, flexing them upward at their ends adjacent the lever. The hinge plates 427*a*, 427*b* flex because the locking elements 449 are still behind the hinge plates, resisting the upward movement of the plates. The upward flex of the hinge plates 427*a*, 427*b* allows an upper lip 436 to pull the intermediate connector 467 and travel bar 445 and move the locking elements 449 from behind the hinge plates into registration with openings 429*a*, 429*b*, 429*c* in the hinge plates. The lower lip 437 of the lever 415 pushes the hinge plates 427*a*, 427*b* to the co-planar position, at which point the spring force of the housing pivots them fully upward over the locking elements 449, and the ring members 423*a*, 423*b* open as shown in FIG. 40.

Figure 40:
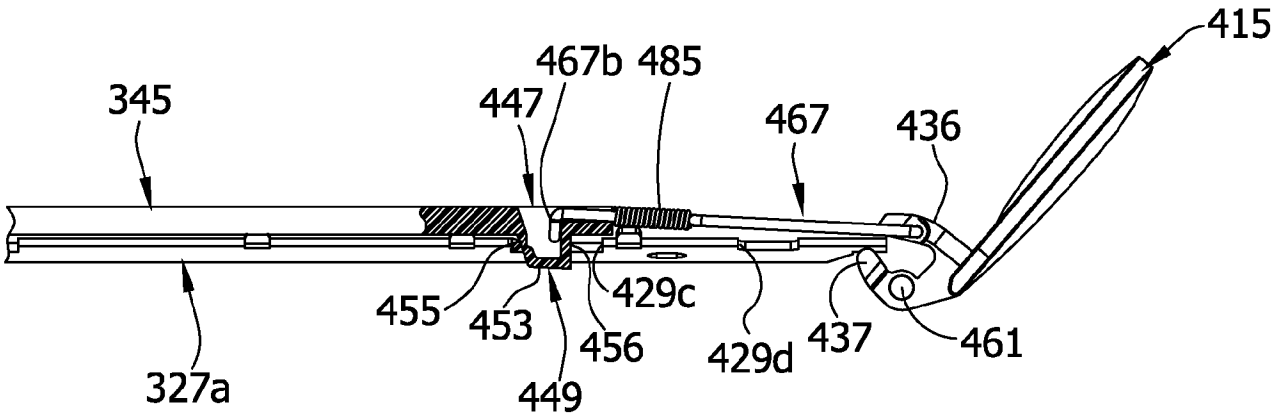
FIG. 40 is an enlarged fragmentary side elevation similar to FIG. 39 but with the ring binder mechanism at the opened position and with the lever in a second deformed position.
Figure 41A:
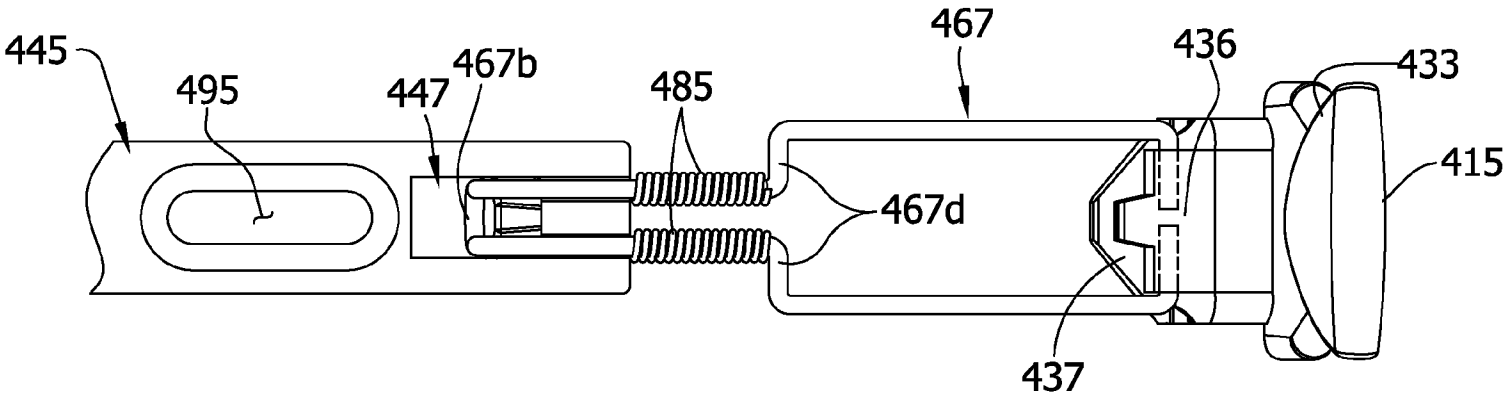
FIGS. 41A and 41B are top plan views illustrating pivoting movement of the lever toward the closed and locked position and the concurrent movement of the intermediate connector.
Figure 41B:
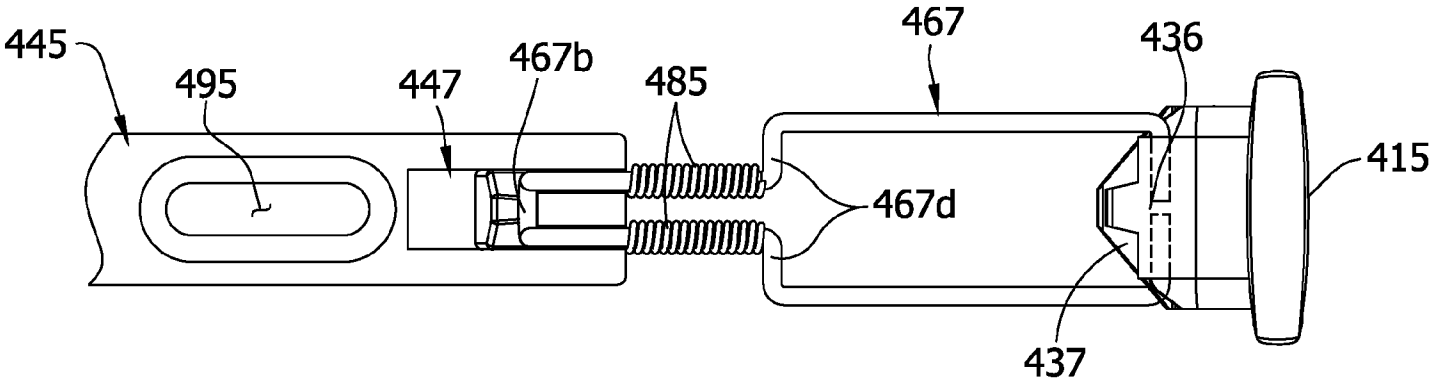
Figure 42:
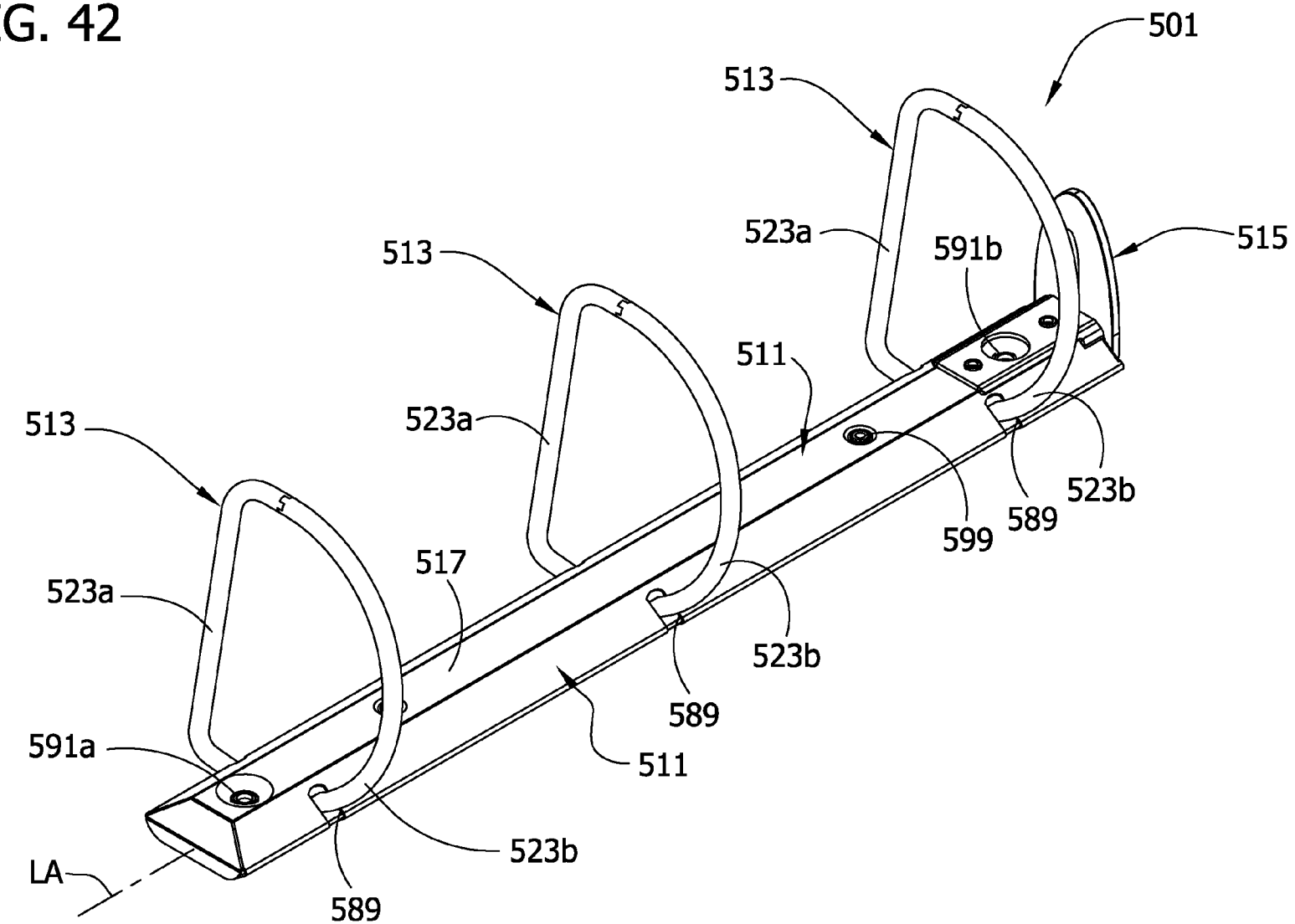
FIG. 42 is a top side perspective of a sixth embodiment of a ring binder mechanism at a closed and locked position and with the lever in a first relaxed position.
Figure 43:
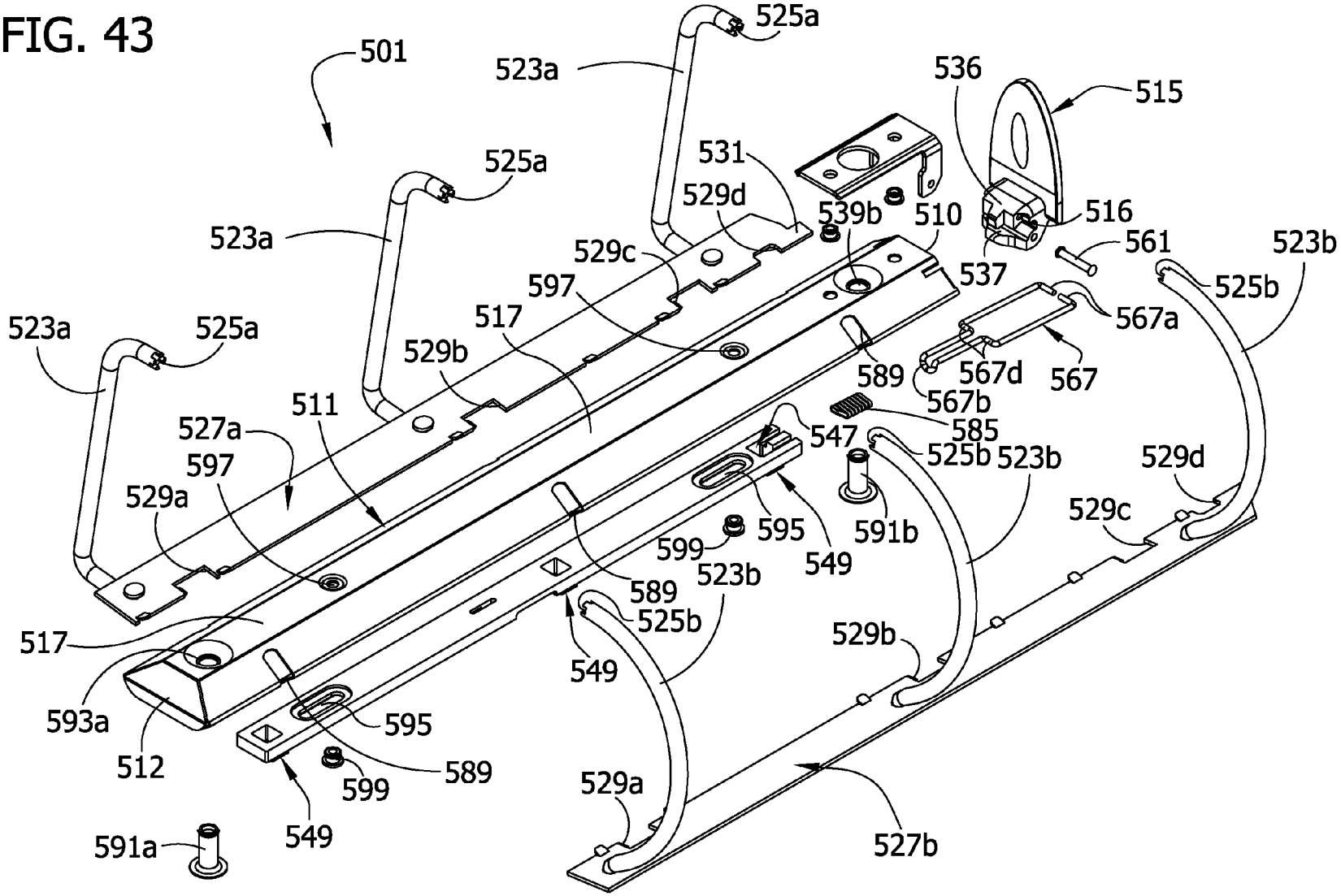
FIG. 43 is an exploded perspective of the ring binder mechanism.
Figure 44:
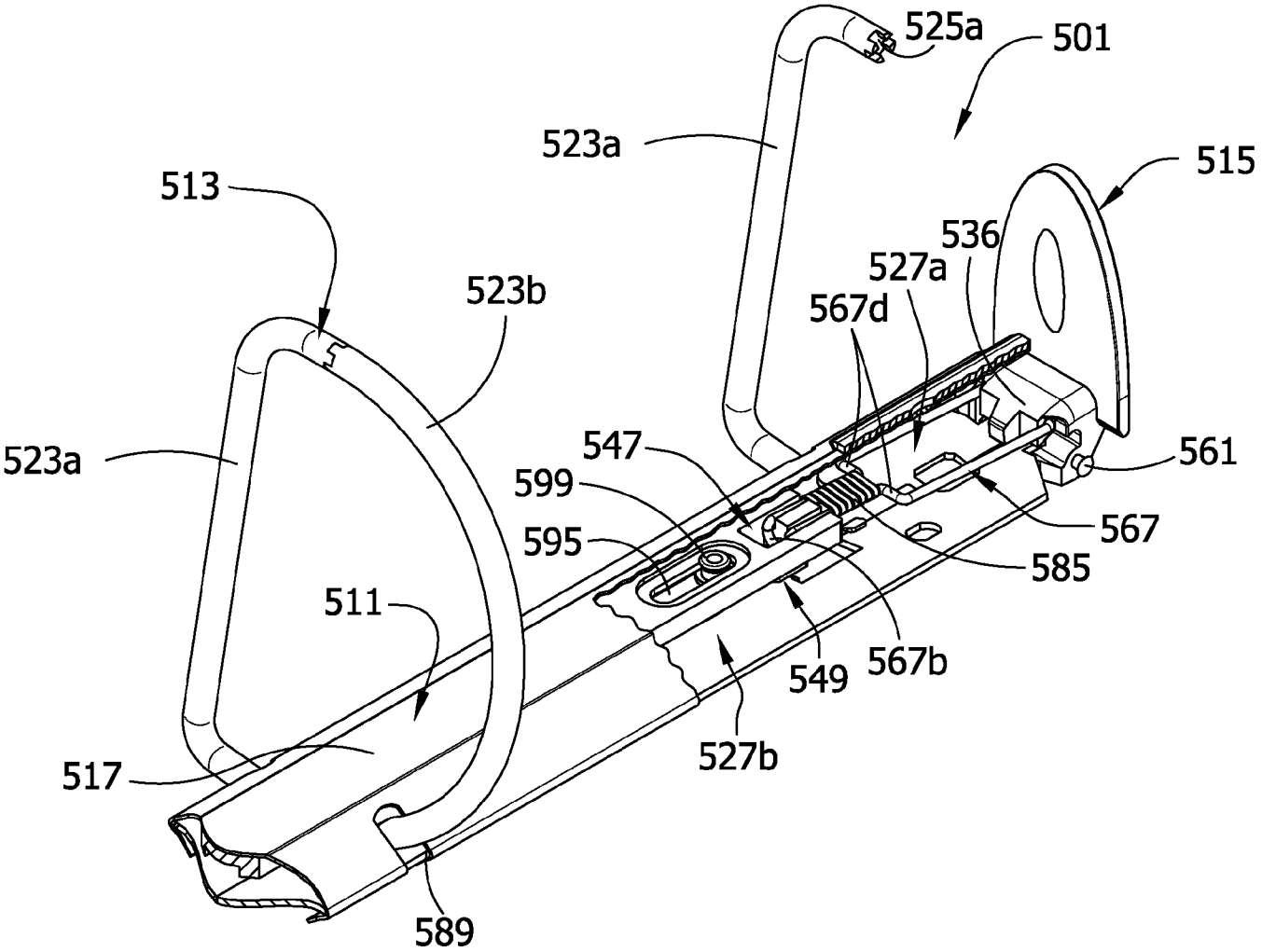
FIG. 44 is an enlarged fragmentary perspective of the ring binder mechanism of FIG. 43 with a portion of a housing broken away to reveal internal construction.
Figure 45:
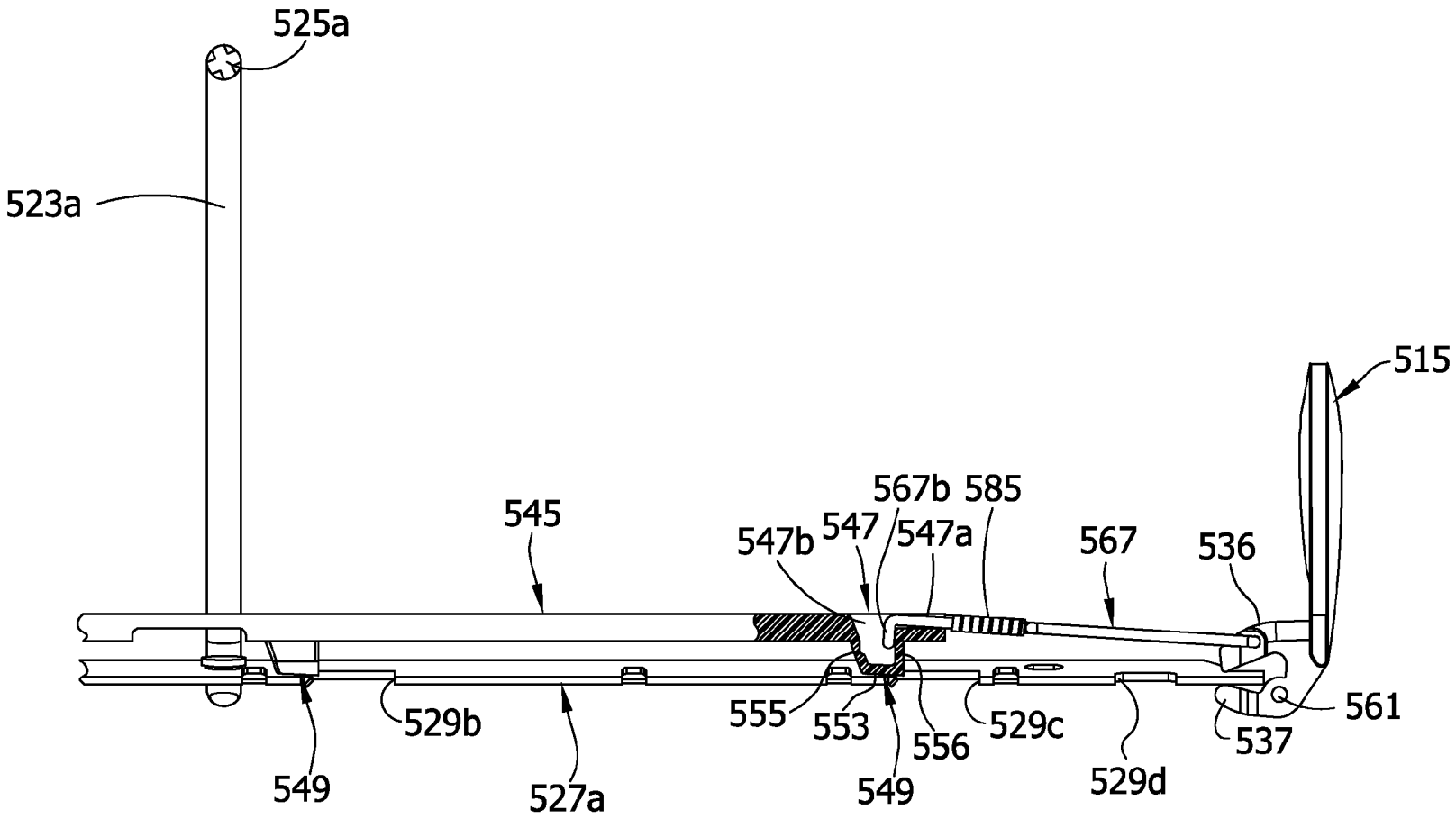
FIG. 45 is an enlarged fragmentary side elevation of the ring binder mechanism with the housing and a hinge plate removed.
Figure 46:
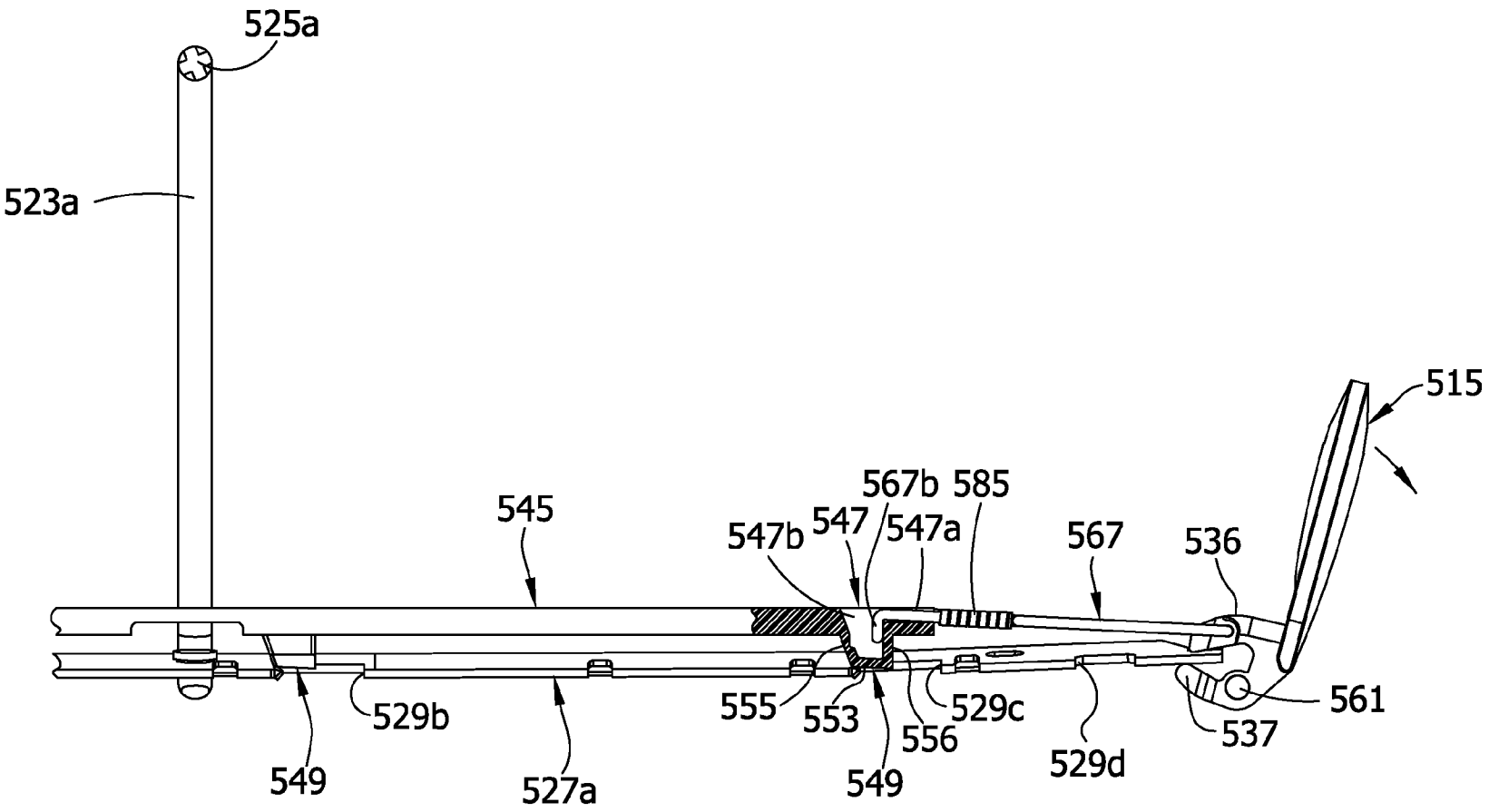
FIG. 46 is an enlarged fragmentary side elevation similar to FIG. 45 but with the lever at the first deformed position.
Figure 47:
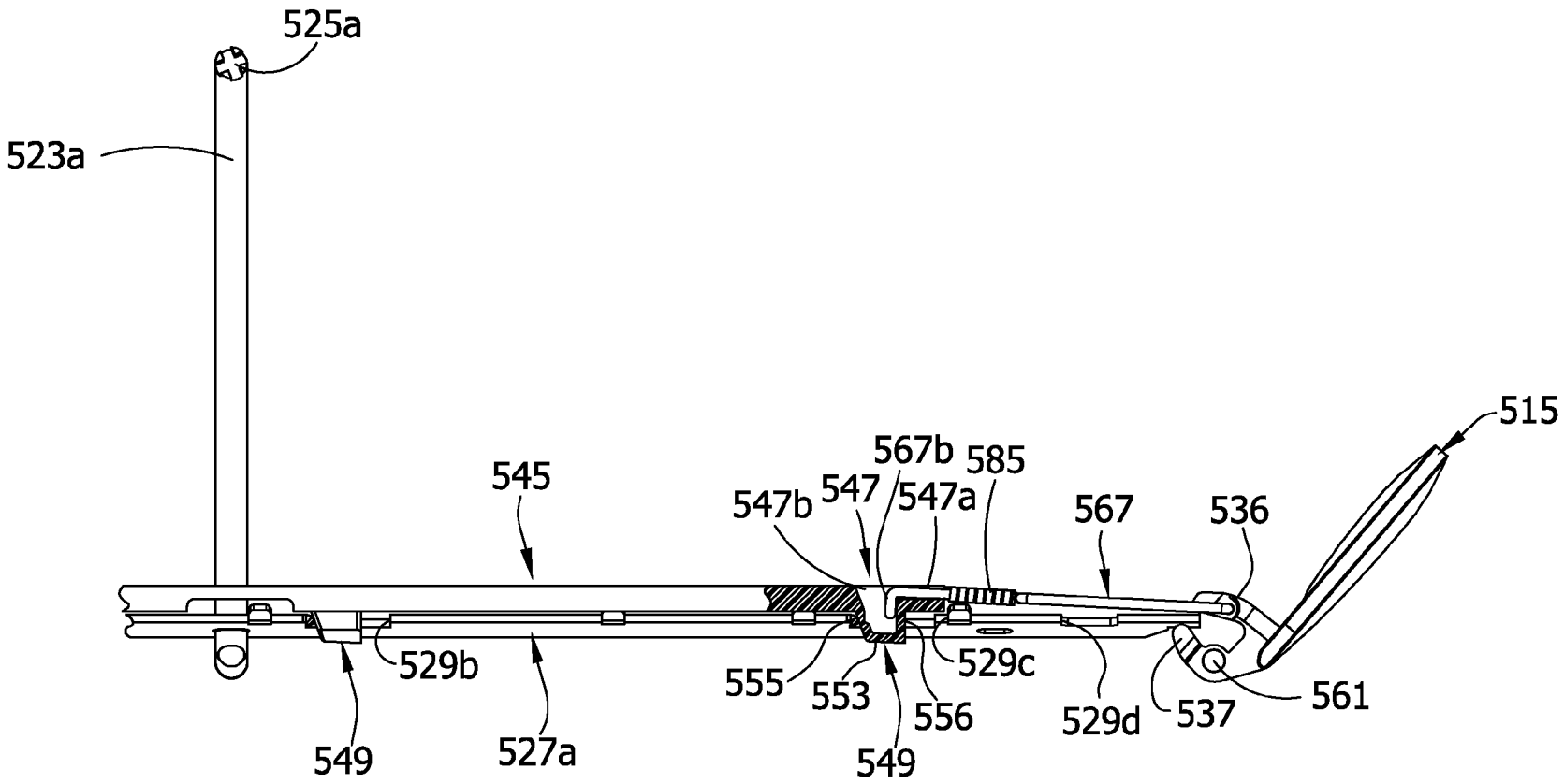
FIG. 47 is an enlarged fragmentary side elevation similar to FIG. 46 but with the ring binder mechanism at the opened position and with the lever in a second deformed position.
Figure 48A:
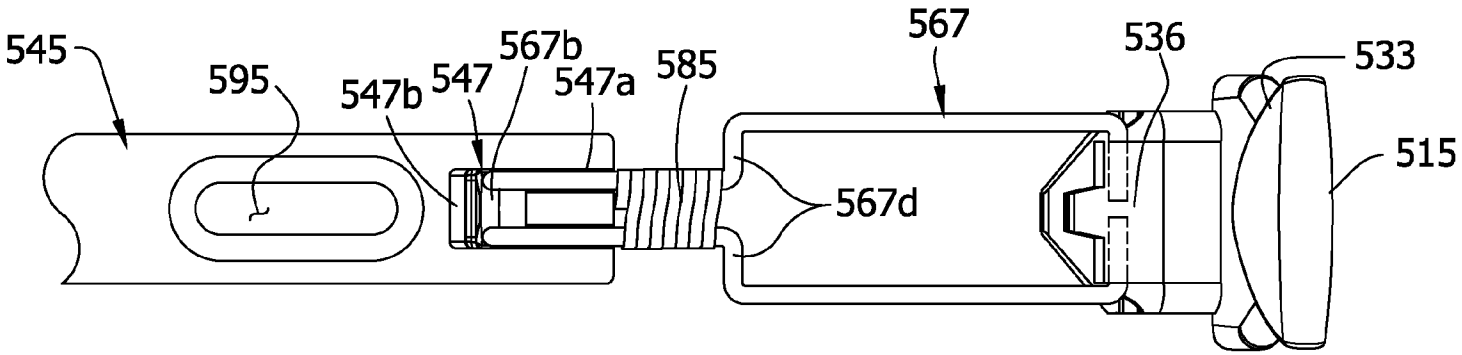
FIGS. 48A and 48B are top plan views illustrating pivoting movement of the lever toward the closed and locked position and the concurrent movement of the intermediate connector.
Figure 48B:
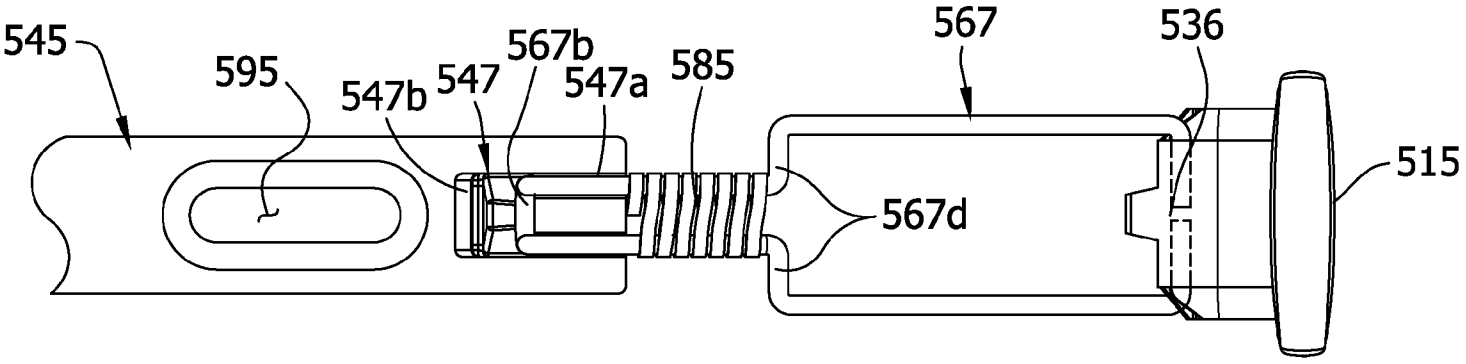
Figure 49:
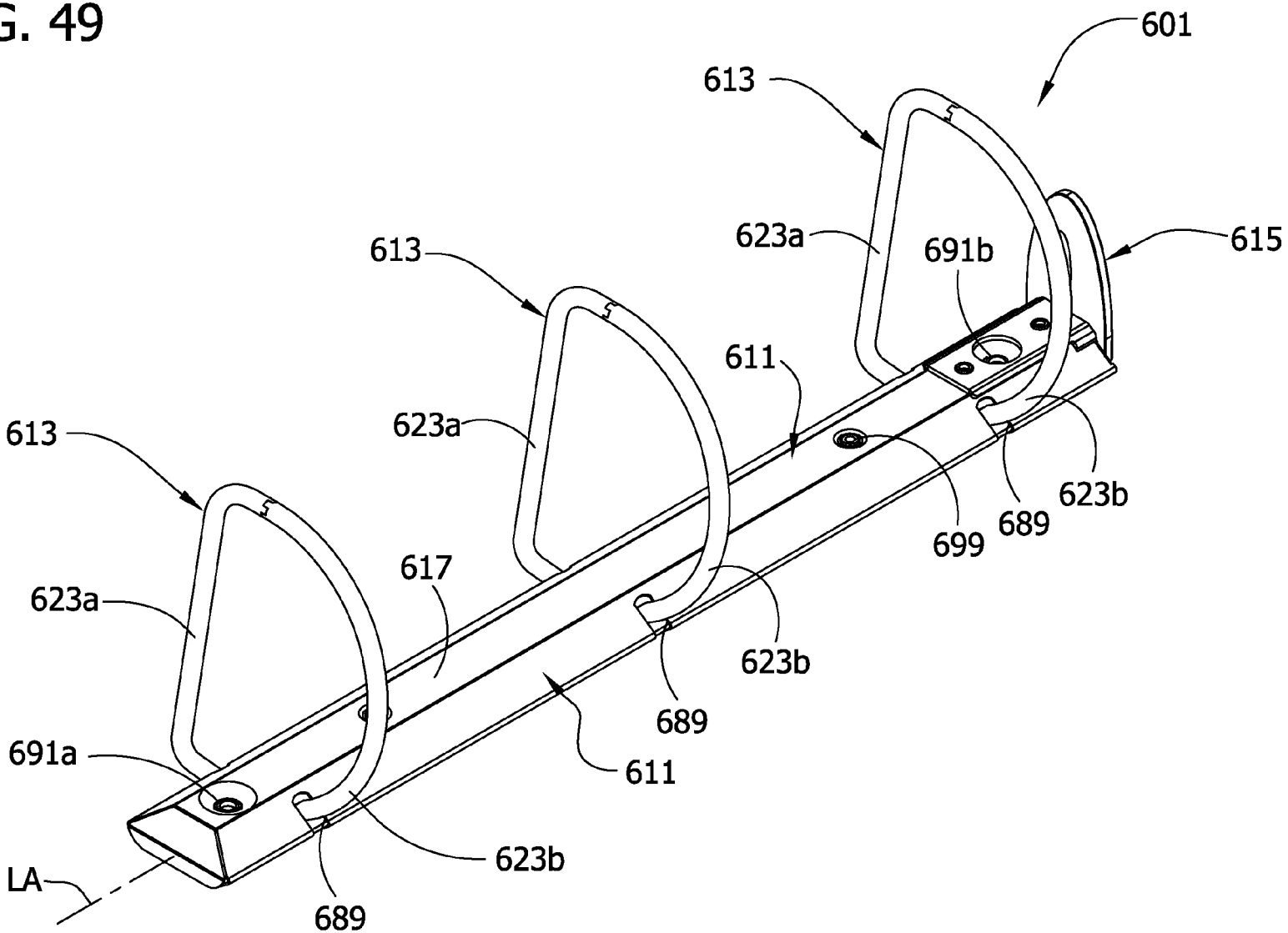
FIG. 49 is a top side perspective of a seventh embodiment of a ring binder mechanism at a closed and locked position and with the lever in a first relaxed position.
Figure 50:
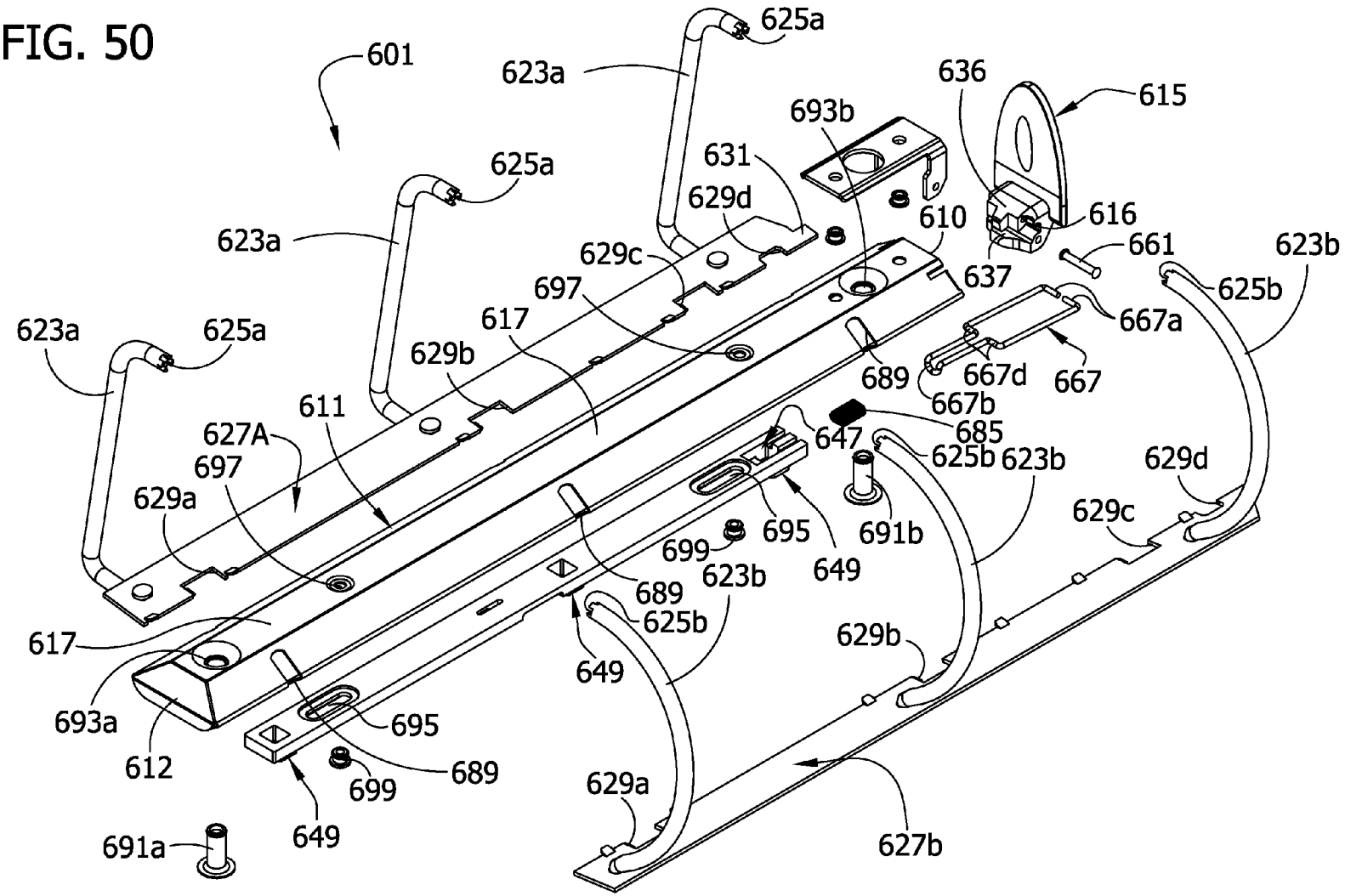
FIG. 50 is an exploded perspective of the ring binder mechanism.

To close the ring members 423*a*, 423*b* and return the mechanism 401 to the locked position, an operator pivots the lever 415 upward and inward as indicated by the arrow in FIG. 40. The upper lip 436 of the lever 415 pushes the intermediate connector 467 forward. The bent end 467*b* of the intermediate connector 467 moves within the mounting groove 447 of the travel bar 445 from the outward end of the mounting groove toward a forward end of the groove (FIG. 41A). The compression springs 485 compress between the shoulders 467*d* of the intermediate connector 467 and the outward end of the travel bar 445, and urge the travel bar forward. However, the travel bar 445 resists this movement because the locking elements 449 are seated in the openings 429*a*, 429*b*, 429*c* in the hinge plates 427*a*, 427*b* against edges of the hinge plates. As the lever 415 continues to pivot, the upper lip 436 moves into engagement with upper surfaces of the hinge plates 427*a*, 427*b* and pivots them downward, through the co-planar position, opening the ring members 423*a*, 423*b*. As soon as the hinge plates 427*a*, 427*b* clear bottom surfaces of the locking elements 449, they move into engagement with the lower lip 437 of the lever 415 and move it to its upright position. The compression springs 485 then urge the travel bar 445 and the locking elements 449 back to the locked position with the locking elements behind the hinge plates 427*a*, 427*b*. The travel bar 445 moves until the bent end 467*b* of the intermediate connector 467 moves back into contact with the outward end of the mounting groove 447 of the travel bar (FIG. 41B). The reaction surfaces against which the compression springs 485 push are the shoulders 467*d* of the intermediate connector 467 which are held in place by the lever 415 in its upright position. The lever 415 is held in its upright position by the hinge plates 427*a*, 427*b* in contact with the lower lip 437 of the lever.

FIGS. 42-48B illustrate a sixth embodiment of a ring binder mechanism 501 that is substantially similar to the fifth embodiment (FIGS. 35-41B) except that a single compression spring 585 (broadly, a "biasing member") is positioned over a narrowed second end of an intermediate connector 567.

Figure 51:
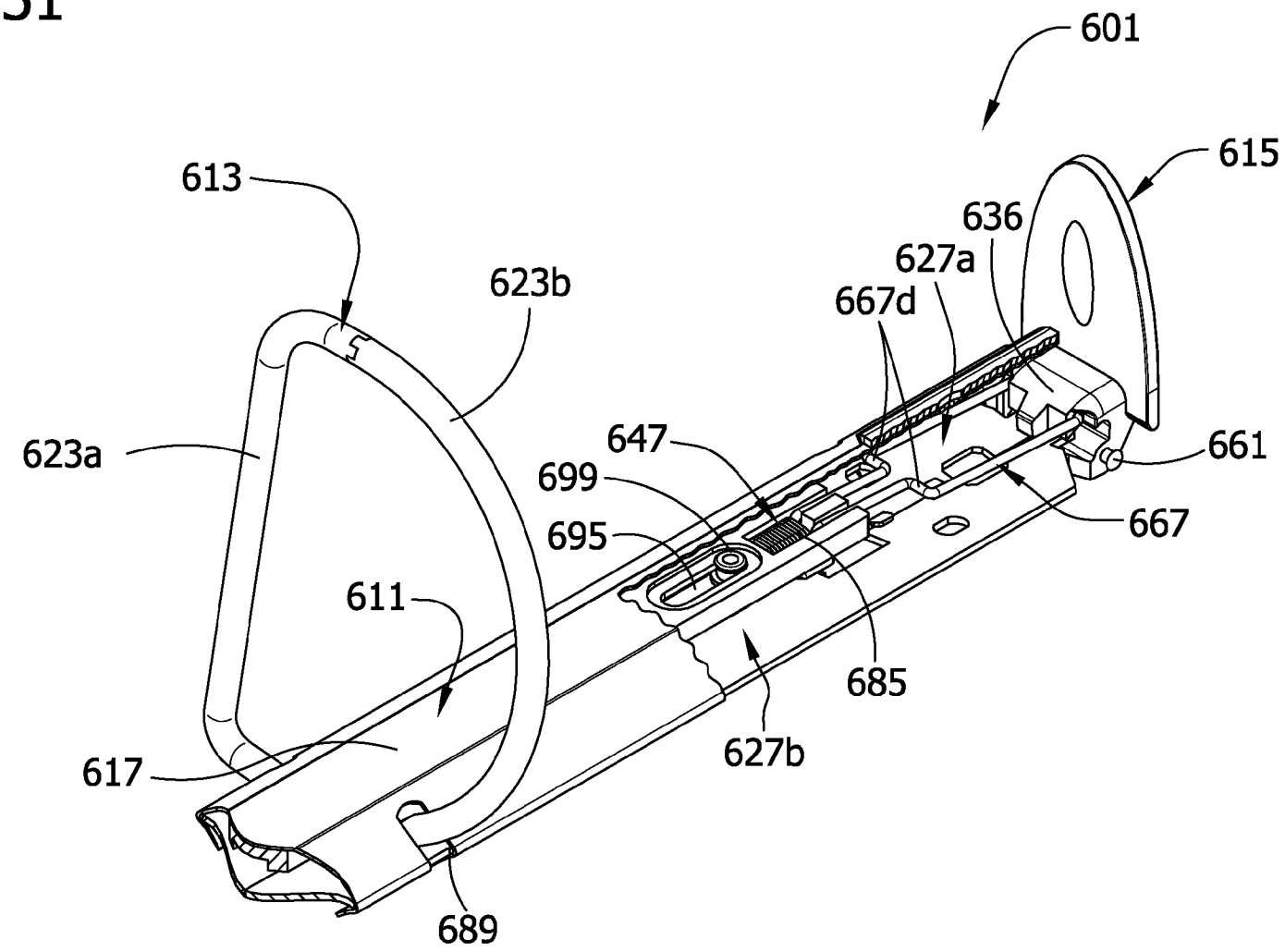
FIG. 51 is an enlarged fragmentary perspective of the ring binder mechanism of FIG. 49 with a portion of a housing broken away to reveal internal construction.
Figure 52:
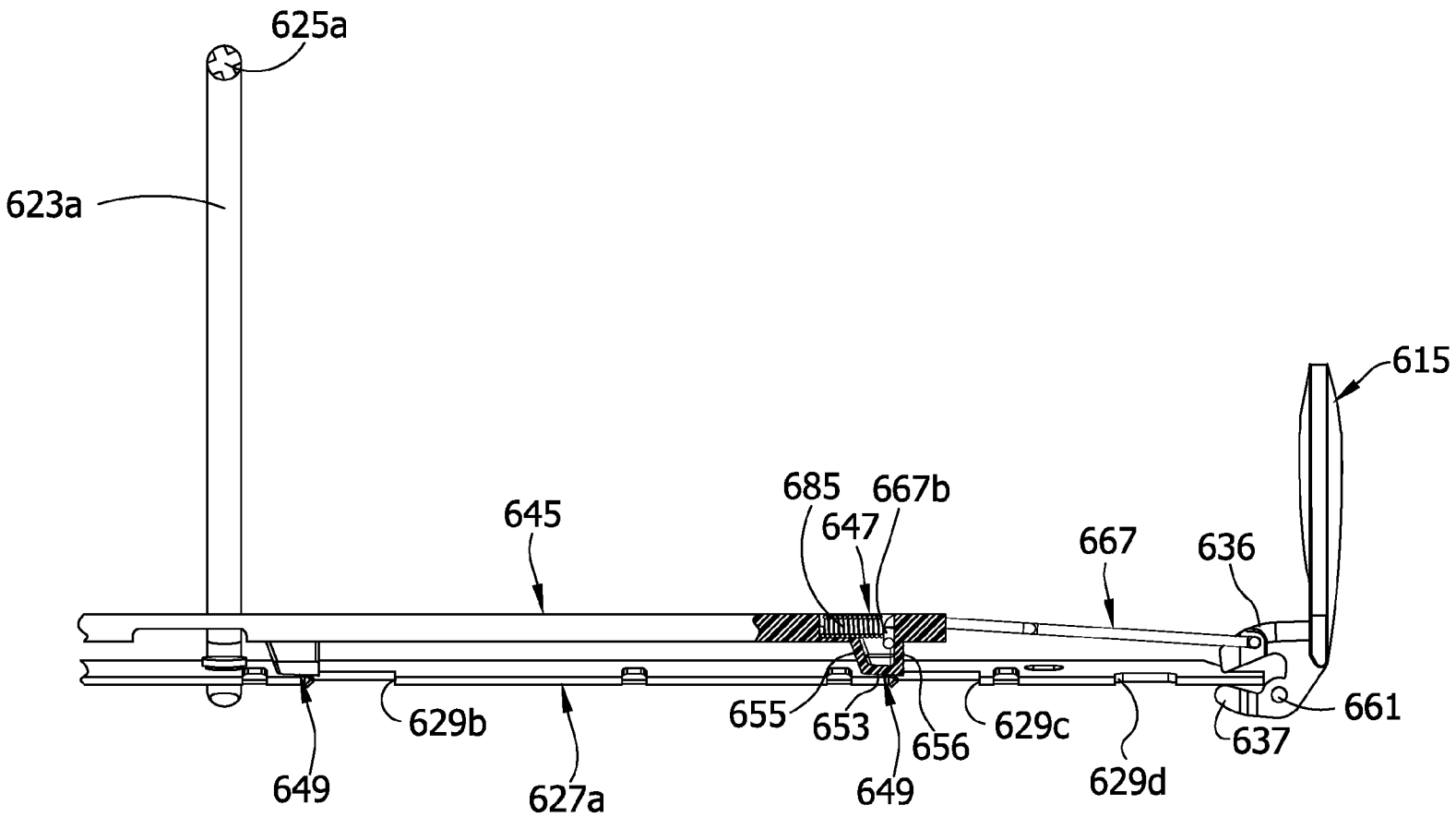
FIG. 52 is an enlarged fragmentary side elevation of the ring binder mechanism with the housing and a hinge plate removed.
Figure 53:
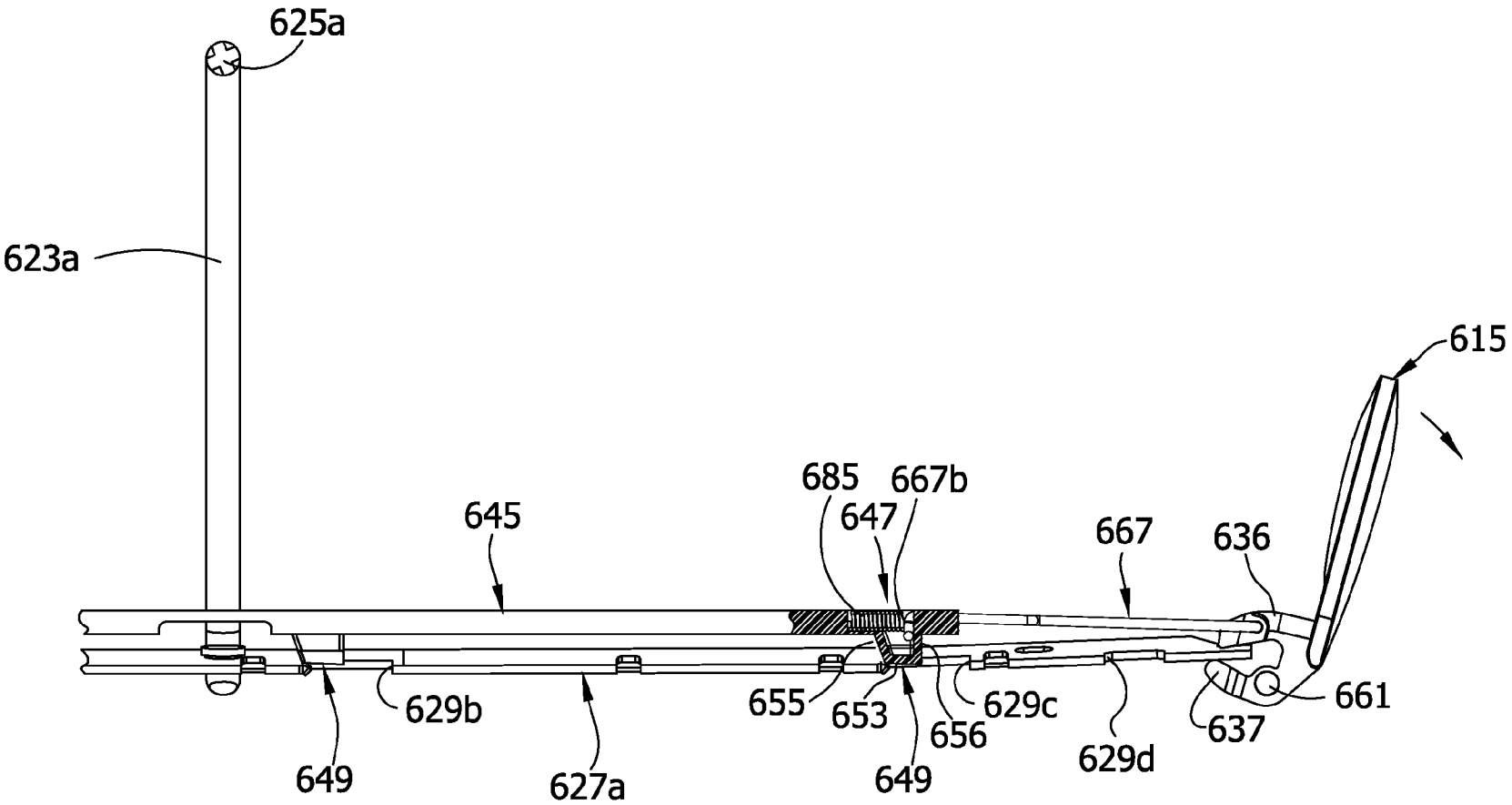
FIG. 53 is an enlarged fragmentary side elevation similar to FIG. 52 but with the lever at the first deformed position.
Figure 54:
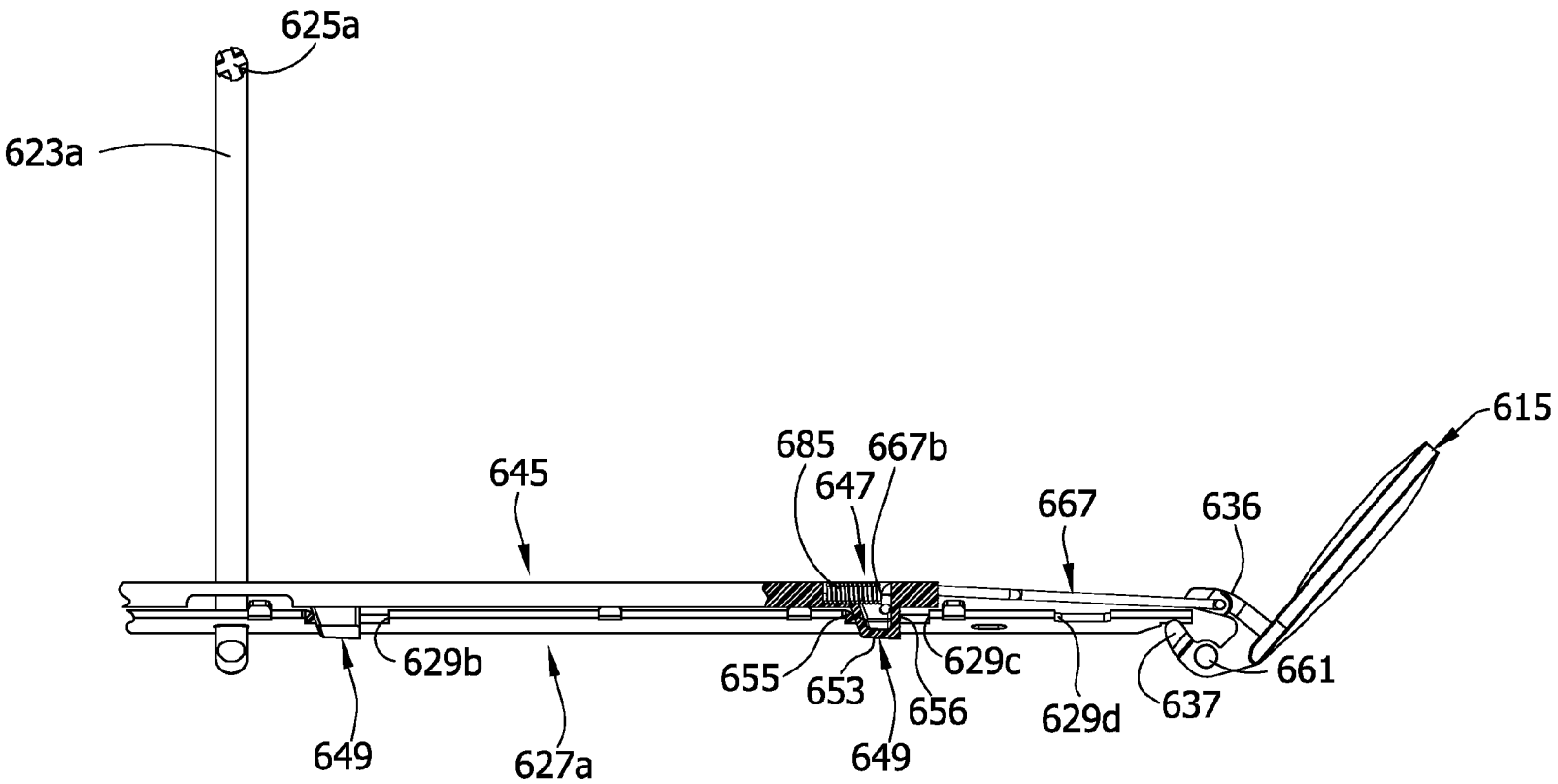
FIG. 54 is an enlarged fragmentary side elevation similar to FIG. 53 but with the ring binder mechanism at the opened position and with the lever in a second deformed position.
Figure 55A:
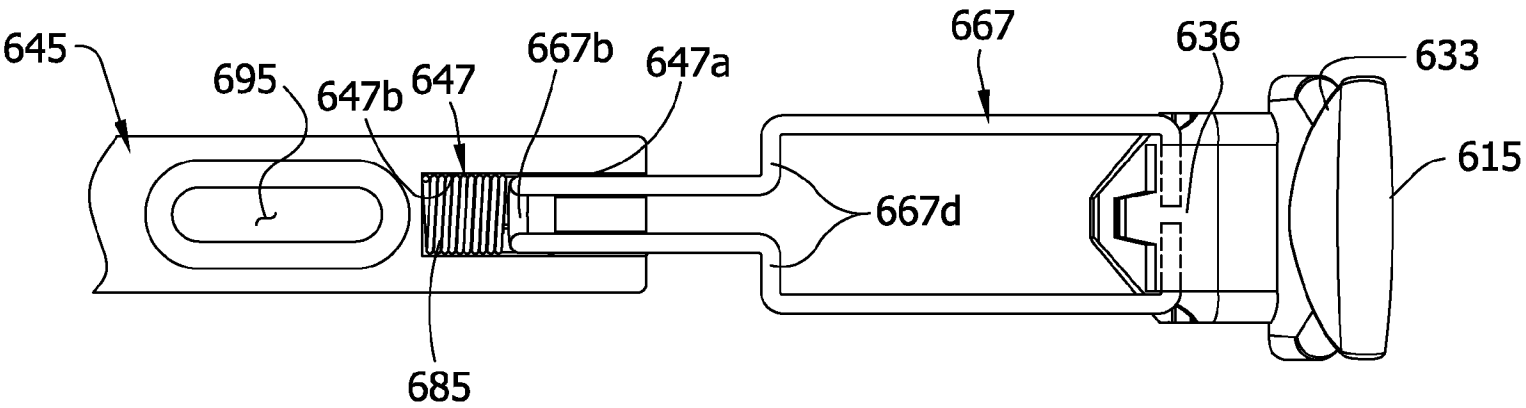
FIGS. 55A and 55B are top plan views illustrating pivoting movement of the lever toward the closed and locked position and the concurrent movement of the intermediate connector.
Figure 55B:
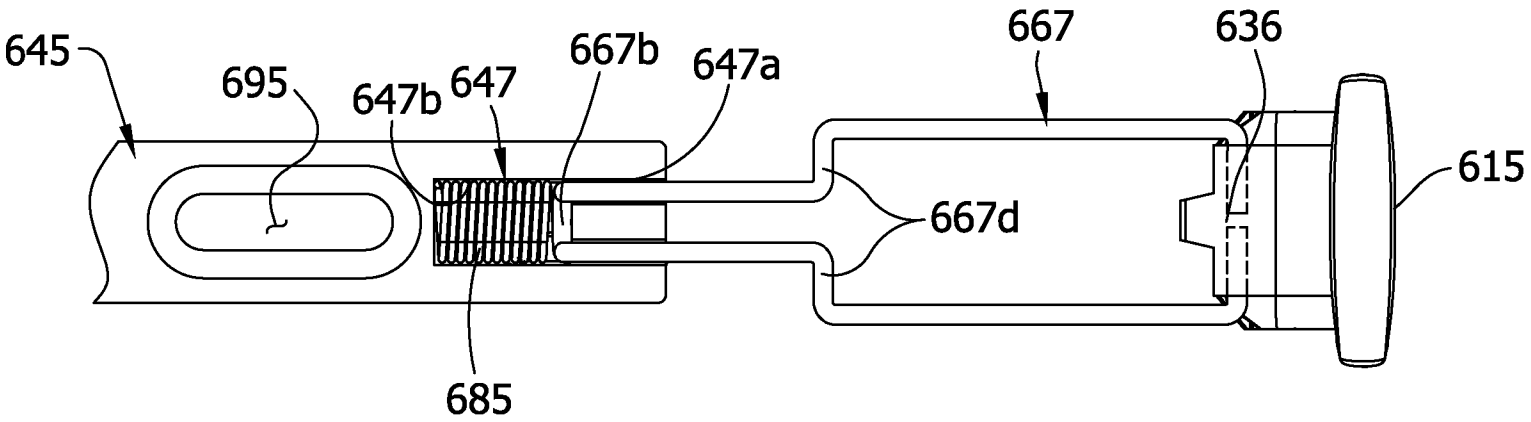
Figure 56:
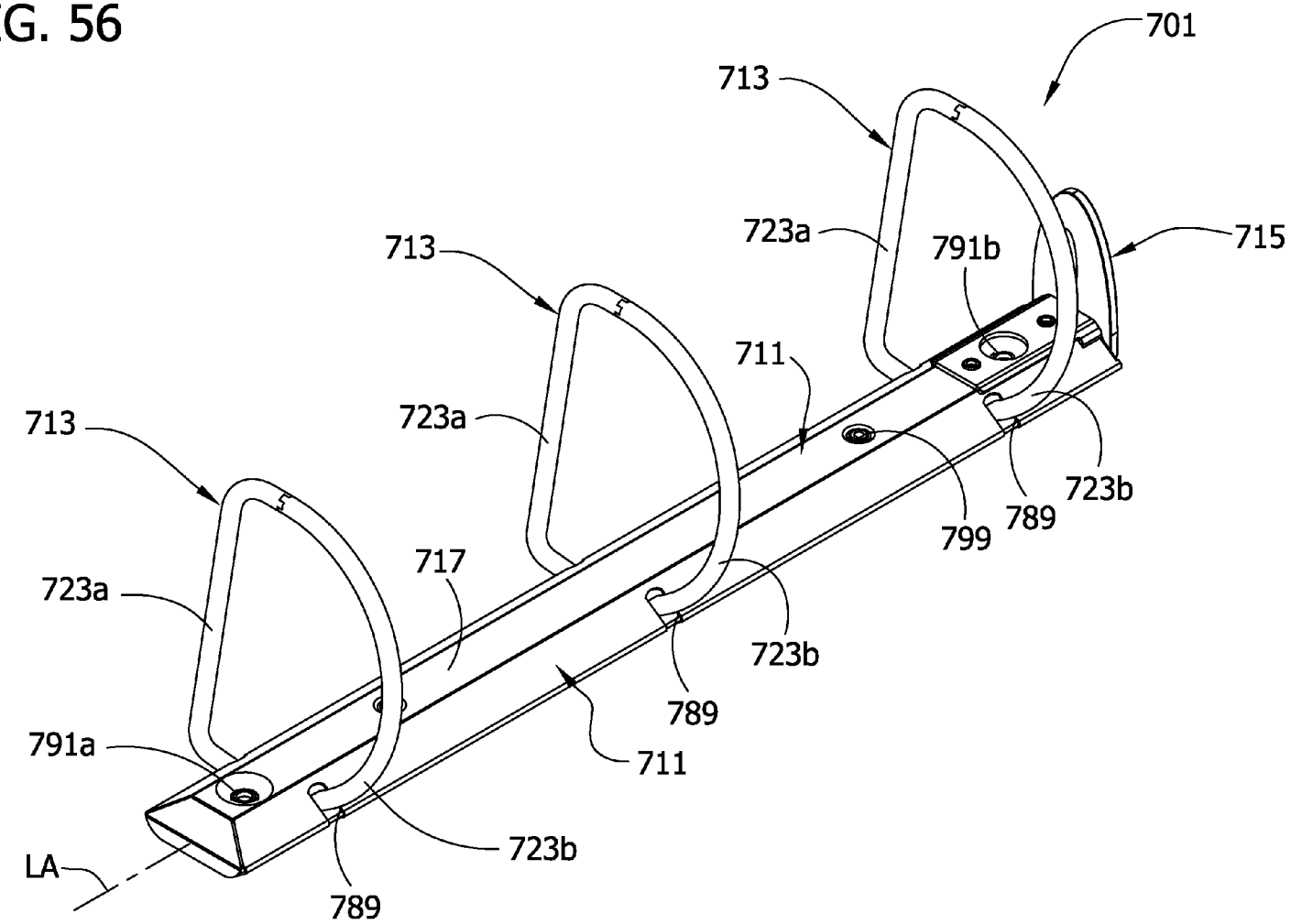
FIG. 56 is a top side perspective of an eighth embodiment of a ring binder mechanism at a closed and locked position and with the lever in a first relaxed position.
Figure 57:
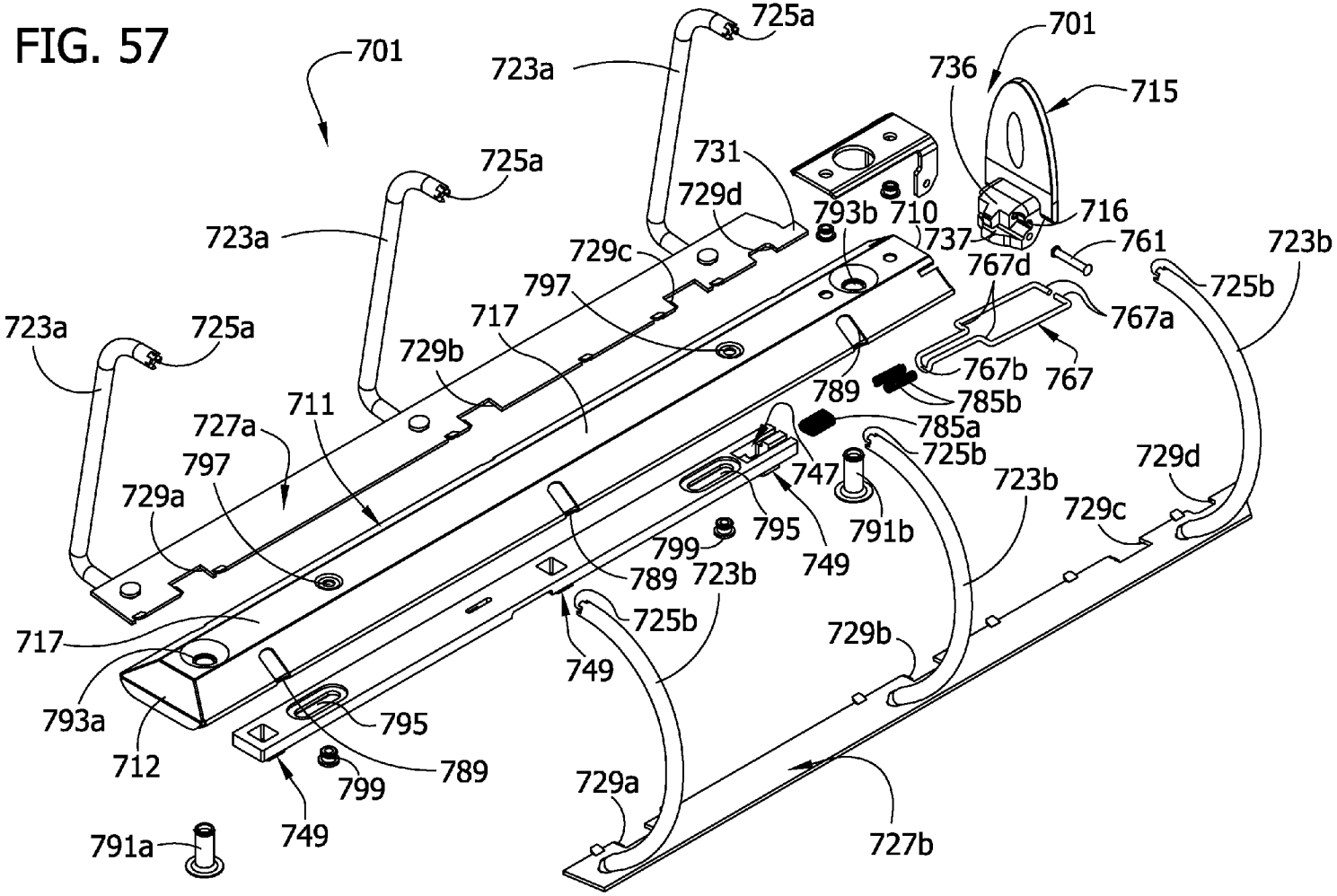
FIG. 57 is an exploded perspective of the ring binder mechanism.
Figure 58:
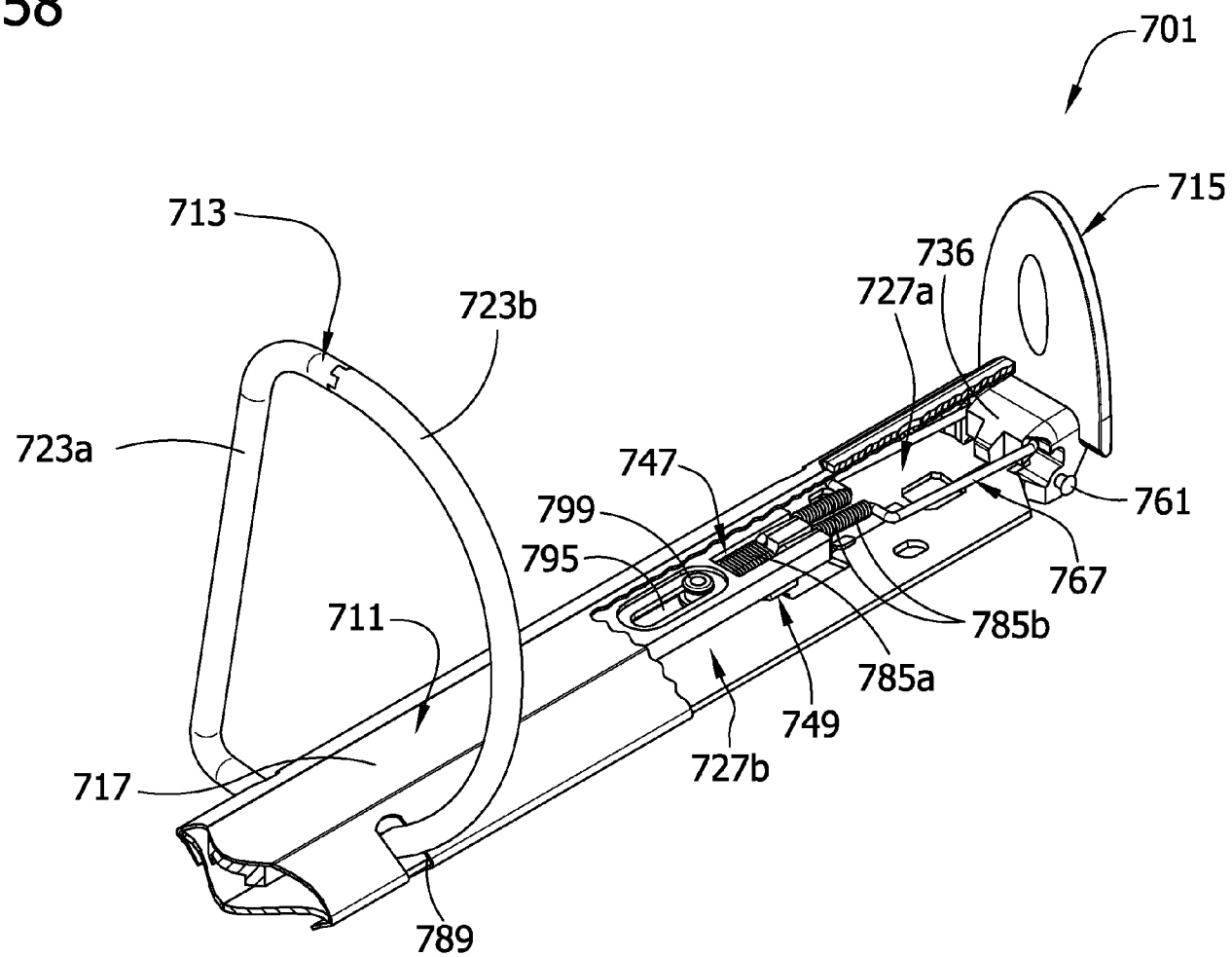
FIG. 58 is an enlarged fragmentary perspective of the ring binder mechanism of FIG. 56 with a portion of a housing broken away to reveal internal construction.
Figure 59:
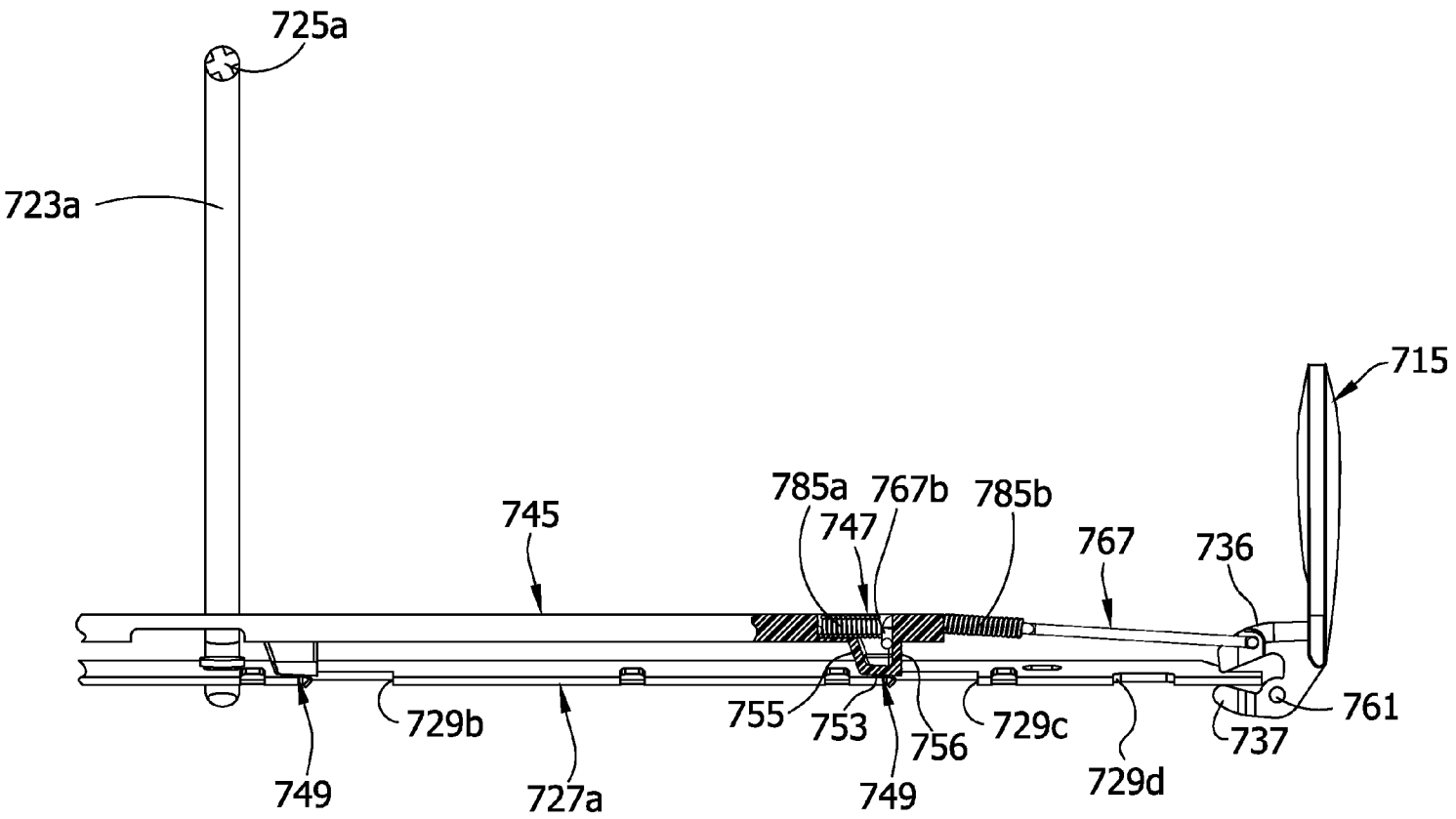
FIG. 59 is an enlarged fragmentary side elevation of the ring binder mechanism with the housing and a hinge plate removed.
Figure 60:
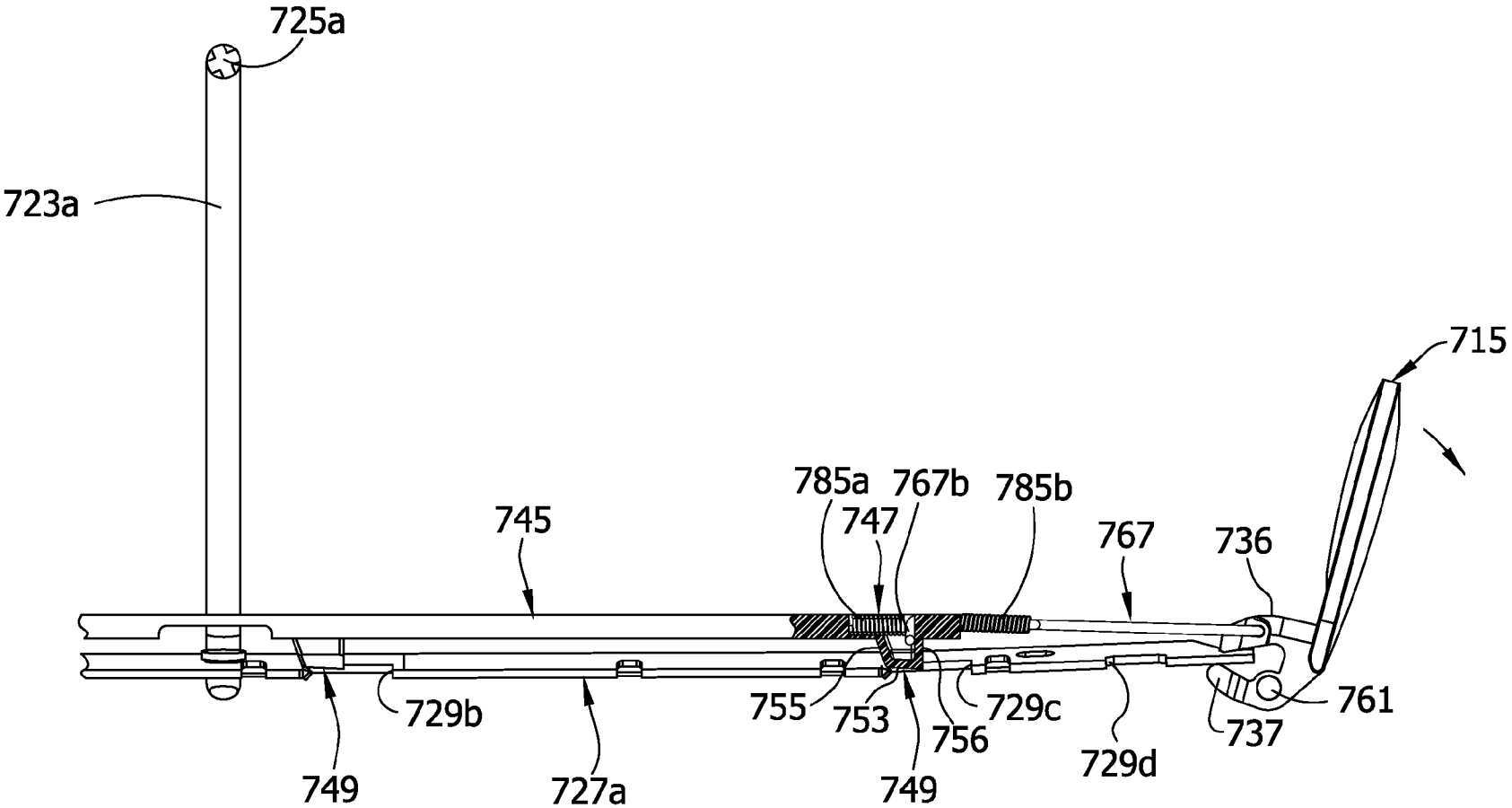
FIG. 60 is an enlarged fragmentary side elevation similar to FIG. 59 but with the lever at the first deformed position.
Figure 61:
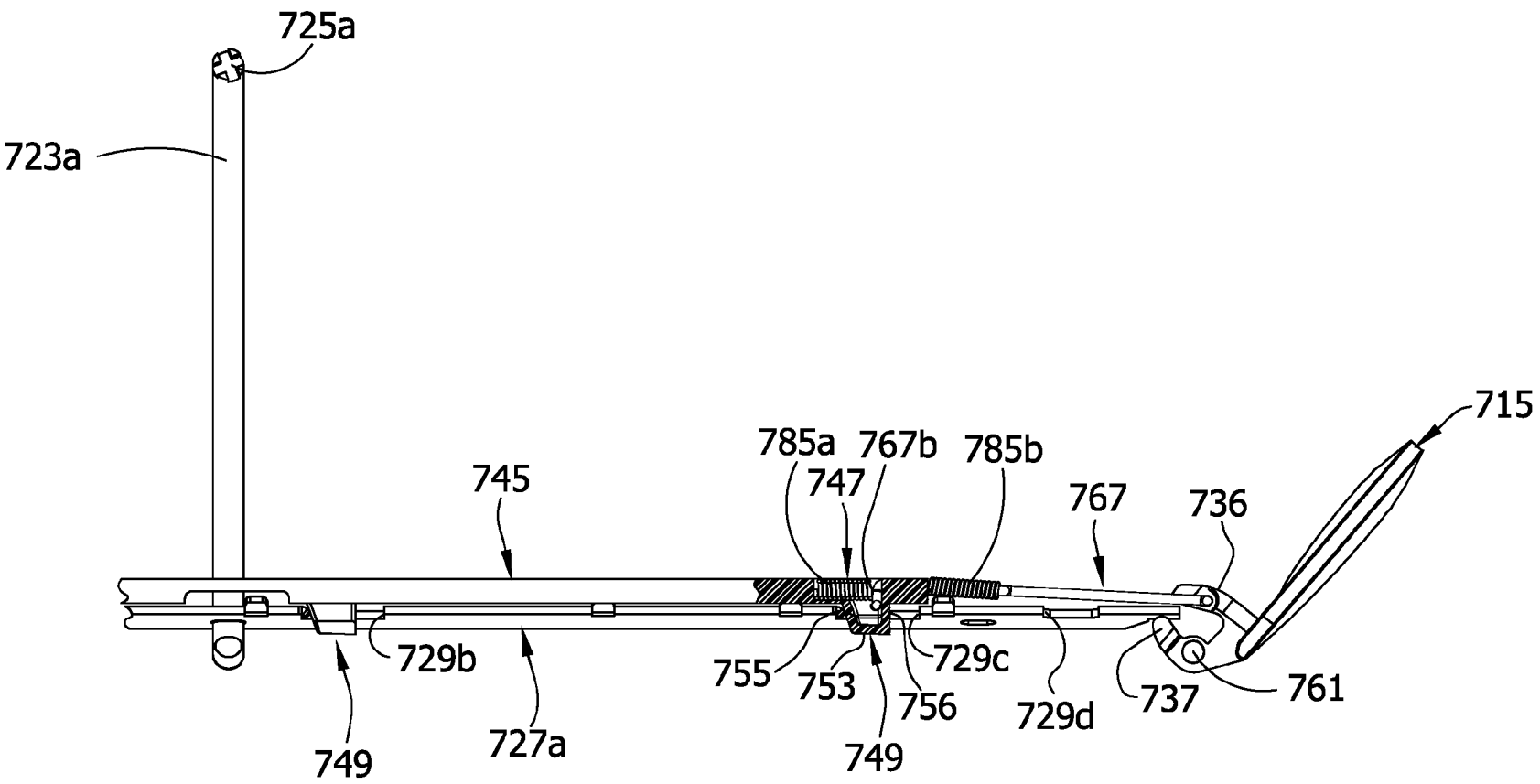
FIG. 61 is an enlarged fragmentary side elevation similar to FIG. 60 but with the ring binder mechanism at the opened position and with the lever in a second deformed position.
Figure 62A:
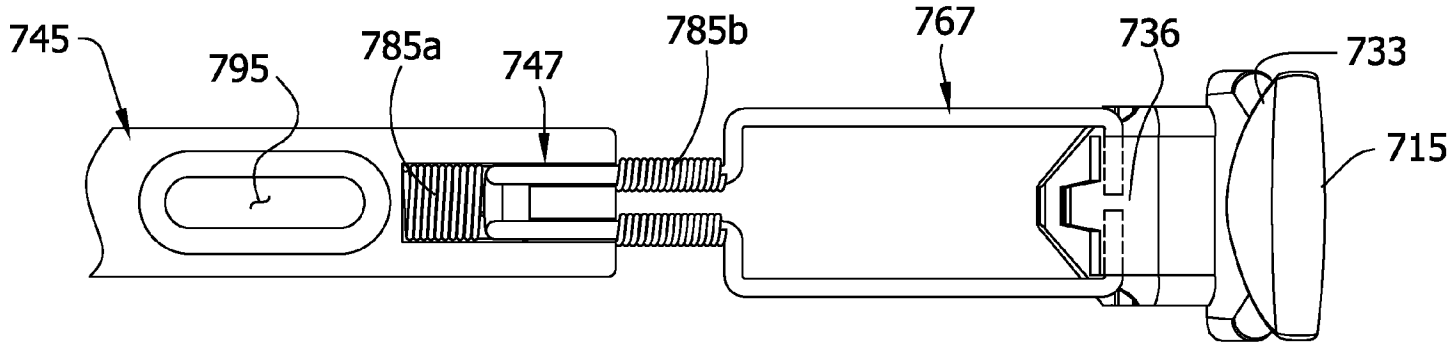
FIGS. 62A and 62B are top plan views illustrating pivoting movement of the lever toward the closed and locked position and the concurrent movement of the intermediate connector.
Figure 62B:
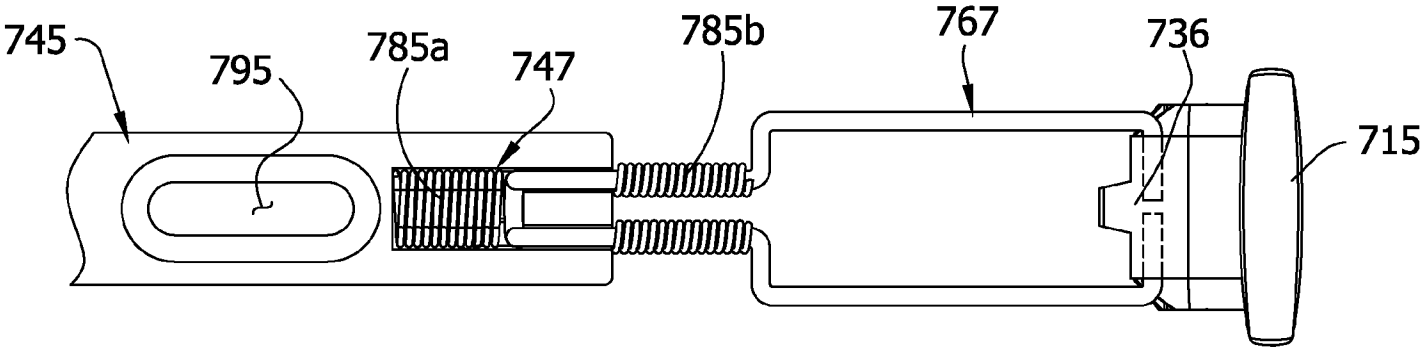

FIGS. 49-55B illustrate a seventh embodiment of a ring binder mechanism 601 in which a single compression spring 685 (broadly, a "biasing member") is positioned inward of a bent end 667*b* of a narrowed second end of an intermediate connector 667. The spring 685 is located within a mounting groove 647 of a travel bar 645 between the bent end 667*b* of the intermediate connector 667 and the forward end of the mounting groove (FIGS. 51 and 52). When a lever 615 pivots to open ring members 623*a*, 623*b*, the intermediate connector 667 simultaneously pulls on the travel bar 645 and moves locking elements 649 to the unlocked position (FIG. 53). When the lever 615 pivots to close the ring members 623*a*, 623*b*, the intermediate connector 667 moves forward relative to the travel bar 645 and compresses the compression spring 685 in the mounting groove 647 (FIGS. 54 and 55A). Once hinge plates 627*a*, 627*b* pivot downward and over the locking elements 649, the lever 615 moves to the upright position and the compression spring 685 pushes the travel bar 645 and locking elements 649 to the locked position (FIGS. 52 and 55B).

FIGS. 56-62B illustrate still an eighth embodiment of a ring binder mechanism 701 that is substantially similar to the fifth, sixth, and seventh embodiments. In this embodiment, however, multiple springs 785*a*, 785*b* (broadly, "biasing members") are used to urge a travel bar 745 to the locked position when ring members 723*a*, 723*b* are closed. Two compression springs 785*b* are located over sections of the narrowed end of an intermediate connector 767 between shoulders 767*d* of the intermediate connector and a rearward end of the travel bar 745 and a single compression spring 785*a* is positioned forward of a bent end 767*b* of the intermediate connector within a mounting groove 747 of the travel bar.

FIGS. 63-69B illustrate a ninth embodiment of the ring binder mechanism 801 in which two compression springs 885 (broadly, "biasing members") are positioned adjacent free ends 867*a* of the intermediate connector 867 for urging a travel bar 845 to a locked position when ring members 823*a*, 823*b* close. More specifically, the compression springs 885 are each received in an opening in a lever 845 and secured therein by threaded plugs 886. Also in this embodiment, a bent end 867*b* of the intermediate connector 867 is received in a mounting groove 847 of the travel bar 845 and held against movement relative to the travel bar. The free ends 867*a* of the intermediate connector 867 are received in elongate openings 816 in an upper lip 836 of the lever 815 so that the lever can move relative to the intermediate connector.

Figure 63:
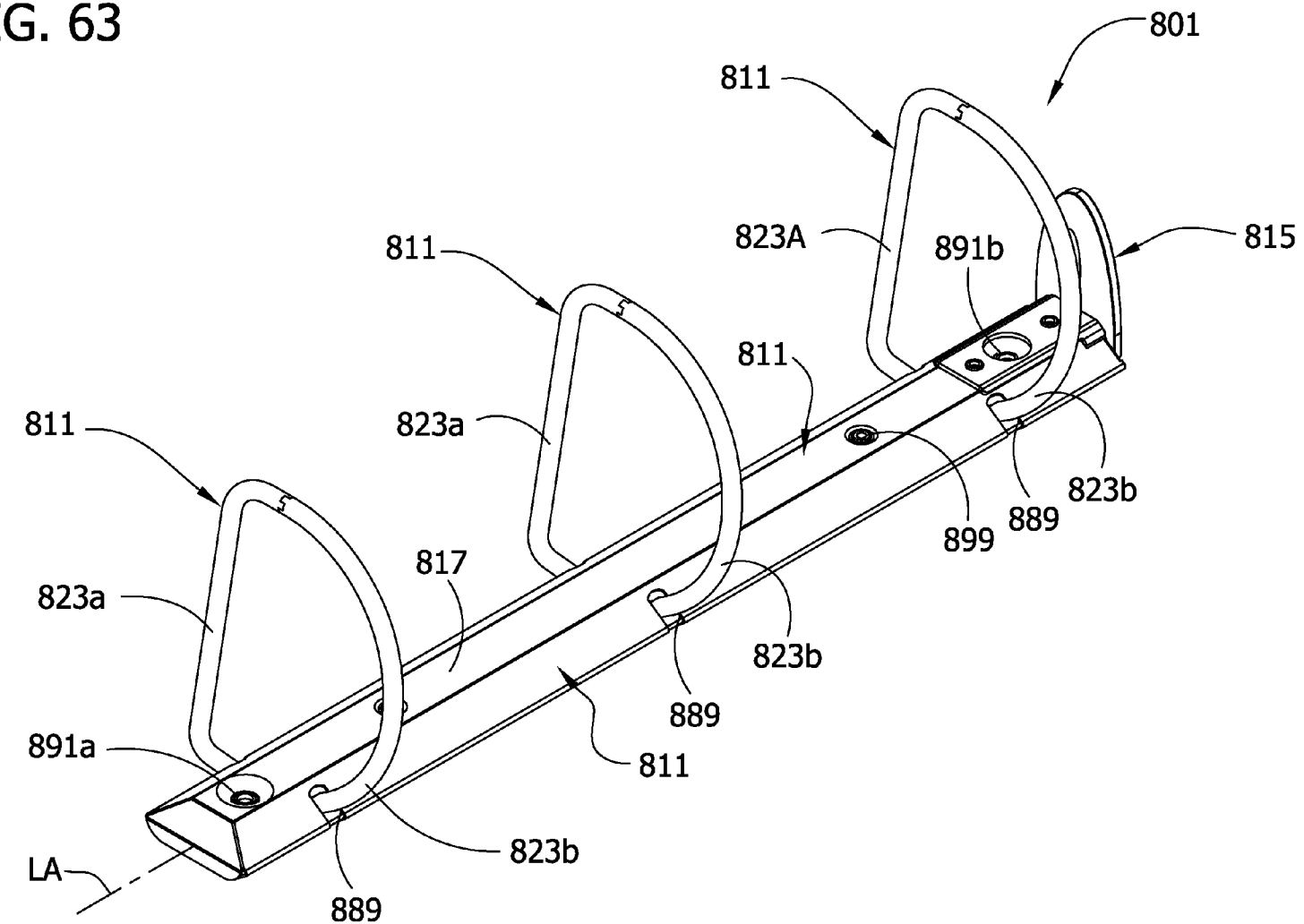
FIG. 63 is a top side perspective of a ninth embodiment of a ring binder mechanism at a closed and locked position and with the lever in a first relaxed position.
Figure 64:
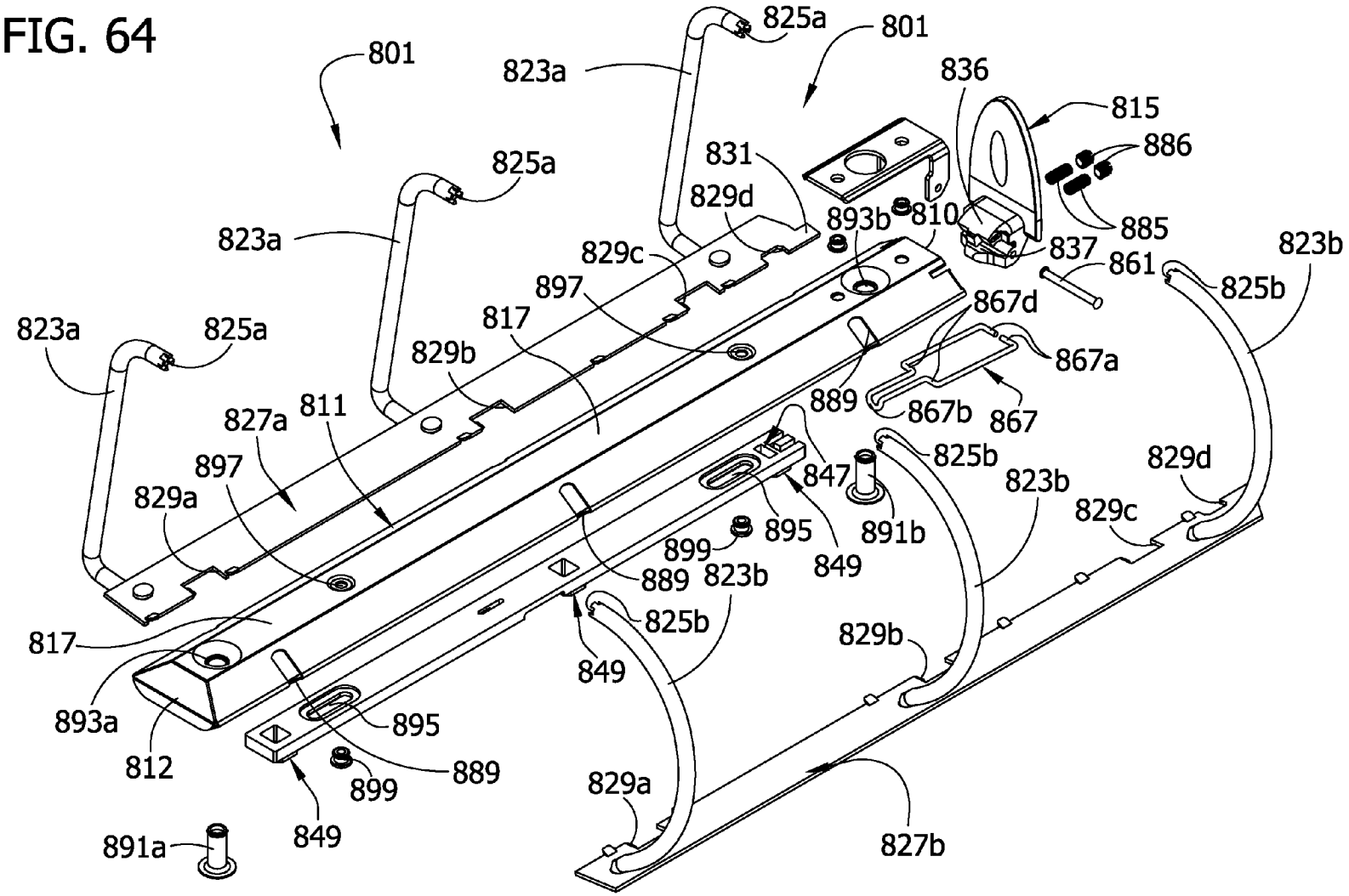
FIG. 64 is an exploded perspective of the ring binder mechanism.
Figure 65:
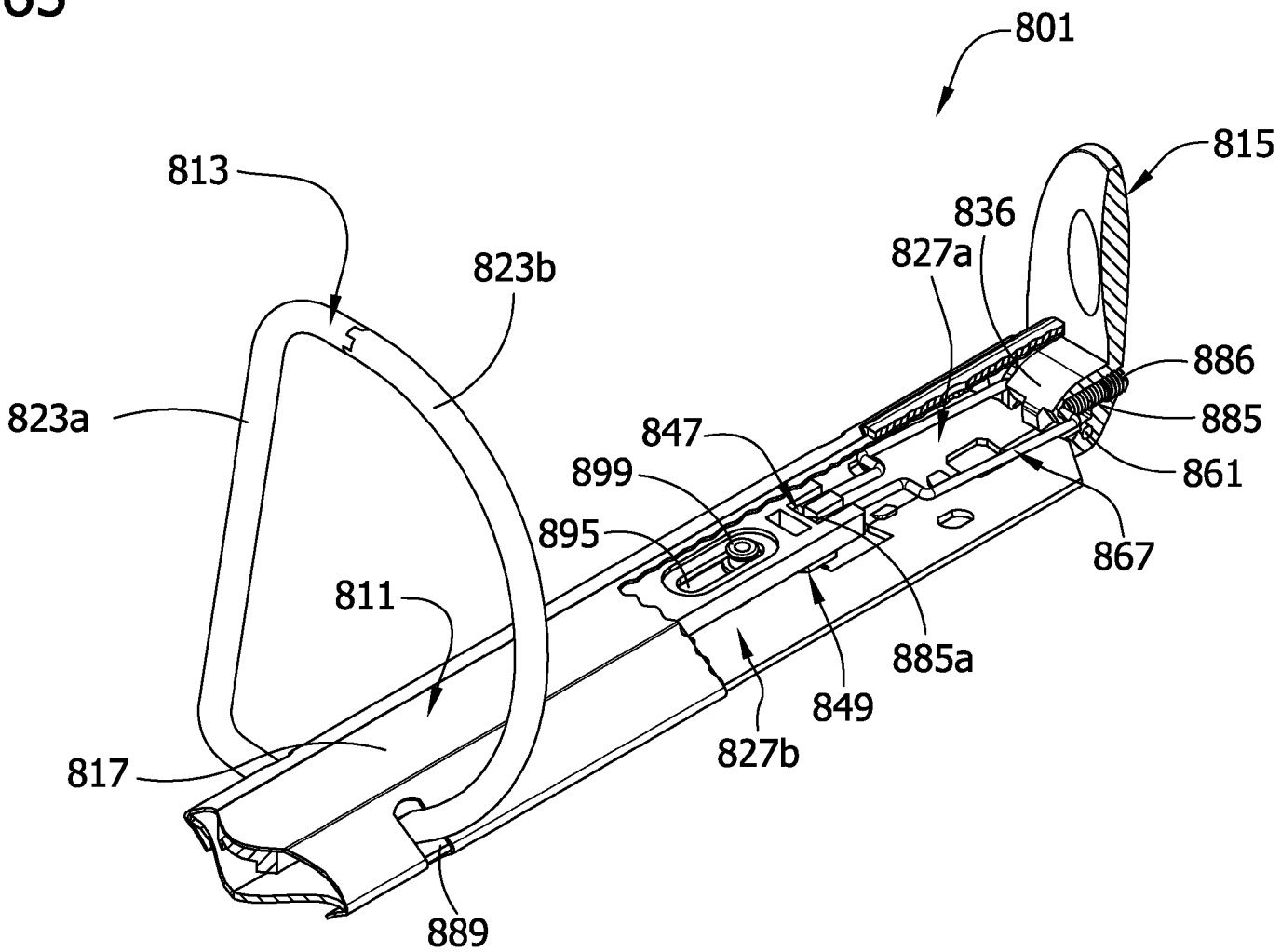
FIG. 65 is an enlarged fragmentary perspective of the ring binder mechanism of FIG. 63 with a portion of a housing broken away to reveal internal construction.
Figure 66:
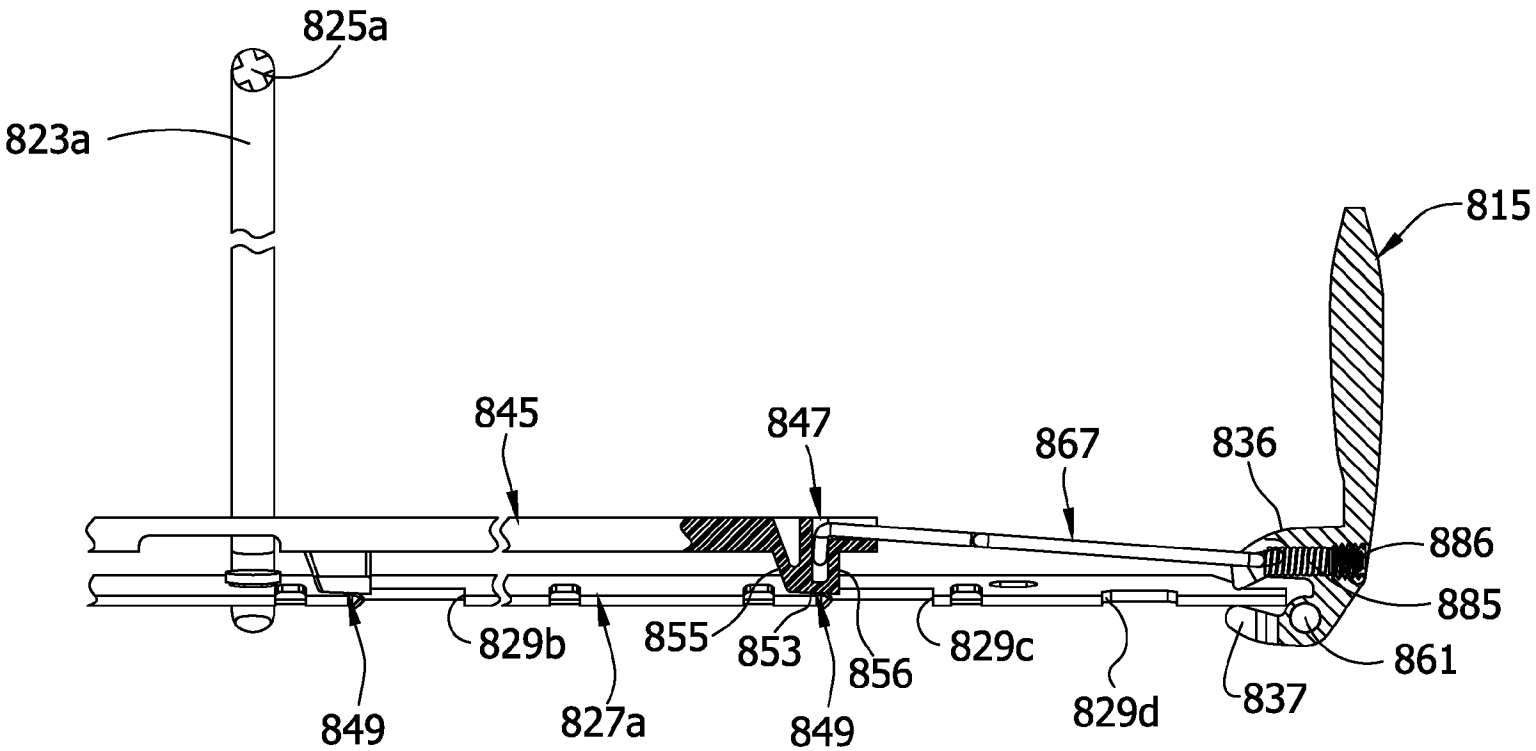
FIG. 66 is an enlarged fragmentary side elevation of the ring binder mechanism with the housing and a hinge plate removed.
Figure 67:
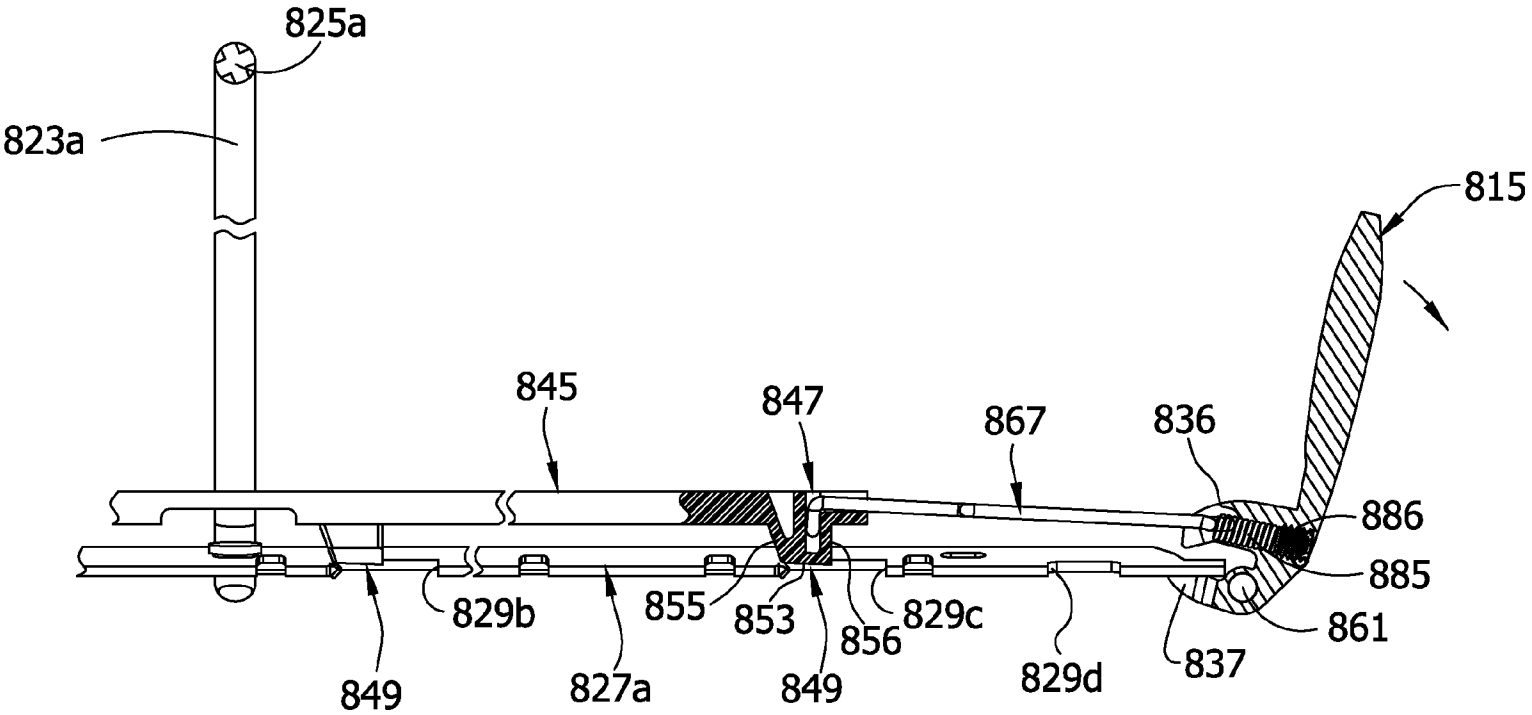
FIG. 67 is an enlarged fragmentary side elevation similar to FIG. 66 but with the lever at the first deformed position.
Figure 68:
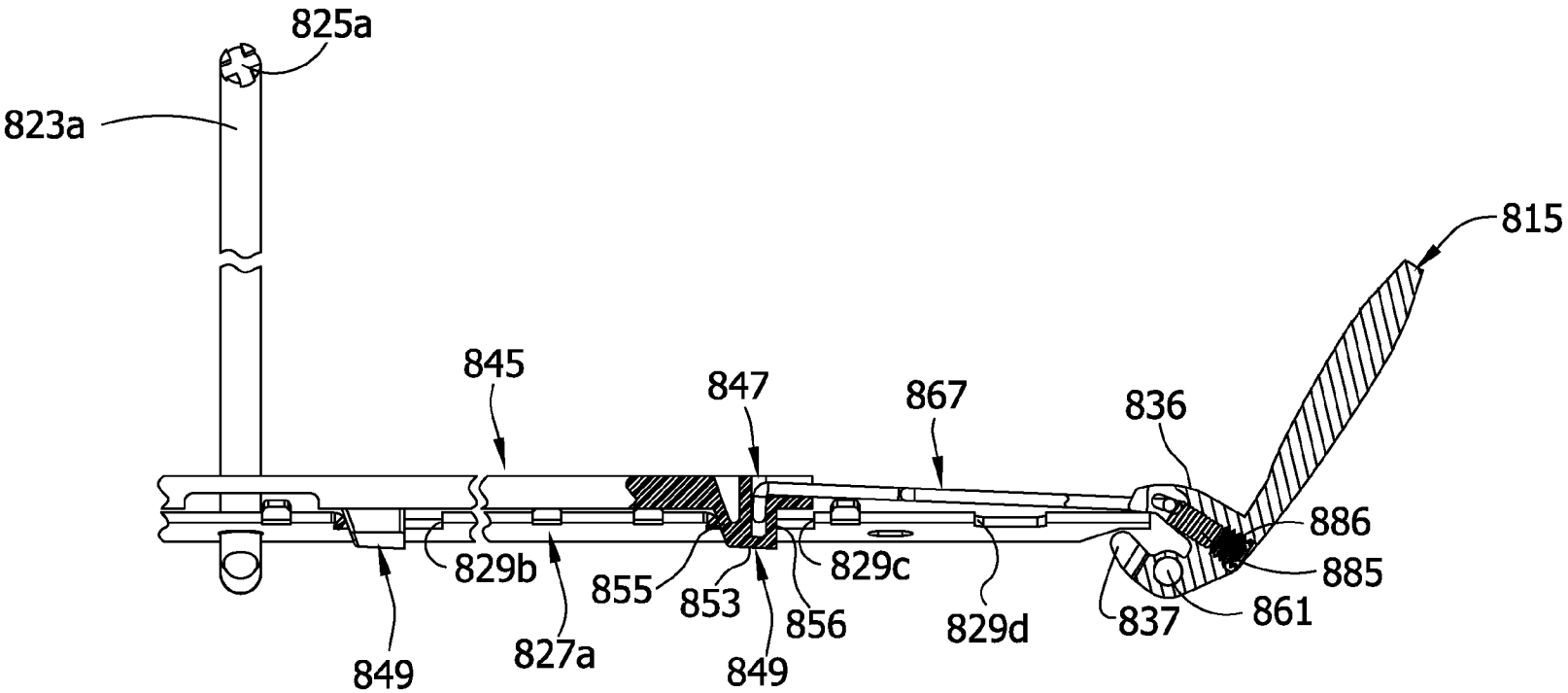
FIG. 68 is an enlarged fragmentary side elevation similar to FIG. 67 but with the ring binder mechanism at the opened position and with the lever in a second deformed position.
Figure 69A:
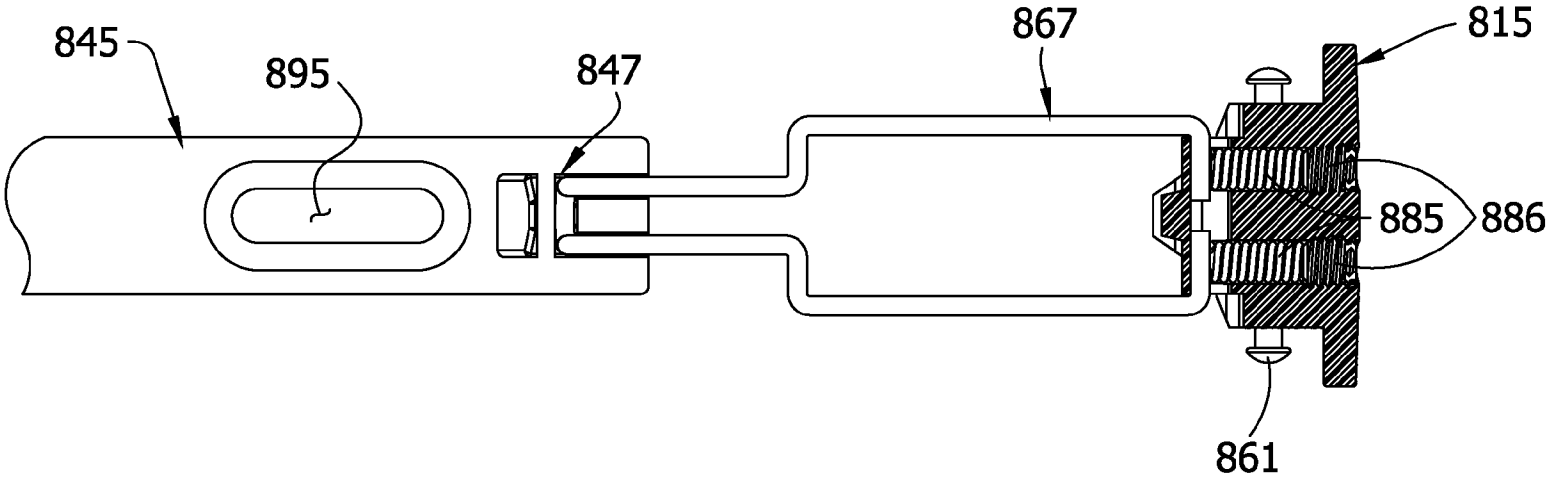
FIGS. 69A and 69B are top plan views illustrating pivoting movement of the lever toward the closed and locked position and the concurrent movement of the intermediate connector.
Figure 69B:
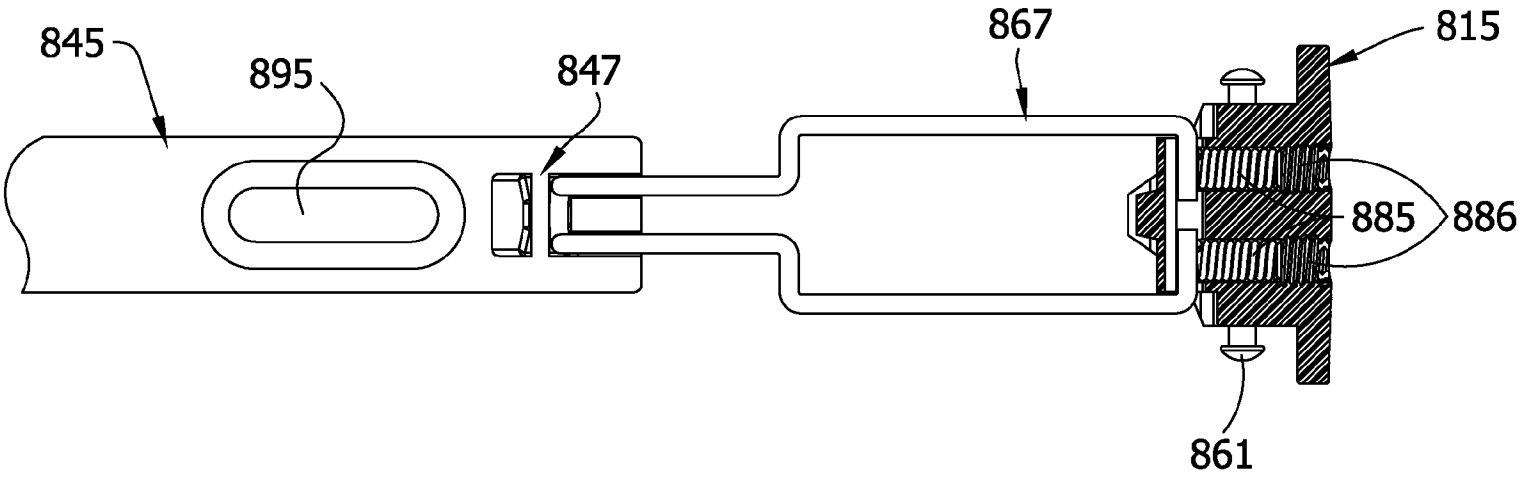

In this variation, when the ring members 823*a*, 823*b* are closed as shown in FIGS. 63, 65, and 66, the free ends 867*a* of the intermediate connector 867 are positioned at a forward end of the elongate openings 816 in the lever 815. When the lever 815 pivots to open the ring members 823*a*, 823*b*, the lever simultaneously pulls the intermediate connector 867 and travel bar 845 and moves locking elements 849 to an unlocked position (FIGS. 67 and 69B). When the lever 815 pivots to close the ring members 823*a*, 823*b*, the lever pivots but the intermediate connector 867 is held stationary (FIG. 68). The locking elements 849 are positioned in the openings 829*a*, 829*b*, 829*c* in the hinge plates 837*a*, 827*b* and are seated against forward edges of hinge plate openings and thereby resist forward movement of the intermediate connector 867. As the lever 815 continues to pivot, it moves relative to the intermediate connector 867 and compresses the compression springs 885 against the plugs 886. The upper lip 836 of the lever 815 engages the hinge plates 827*a*, 827*b* and pivots them toward the co-planar position. Once the hinge plates 827*a*, 827*b* pivot over the locking elements 849, the lever 815 moves to the upright position and moves the intermediate connector 867, travel bar 845 and locking elements 849 to the locked position. The compression springs 885 extend and urge the intermediate connector 867 to the forward end of the elongate openings 816 in the upper lip 836 of the lever 815. This pushes the travel bar 845 and locking elements 849 to the locked position (FIG. 69A).

Figure 70:
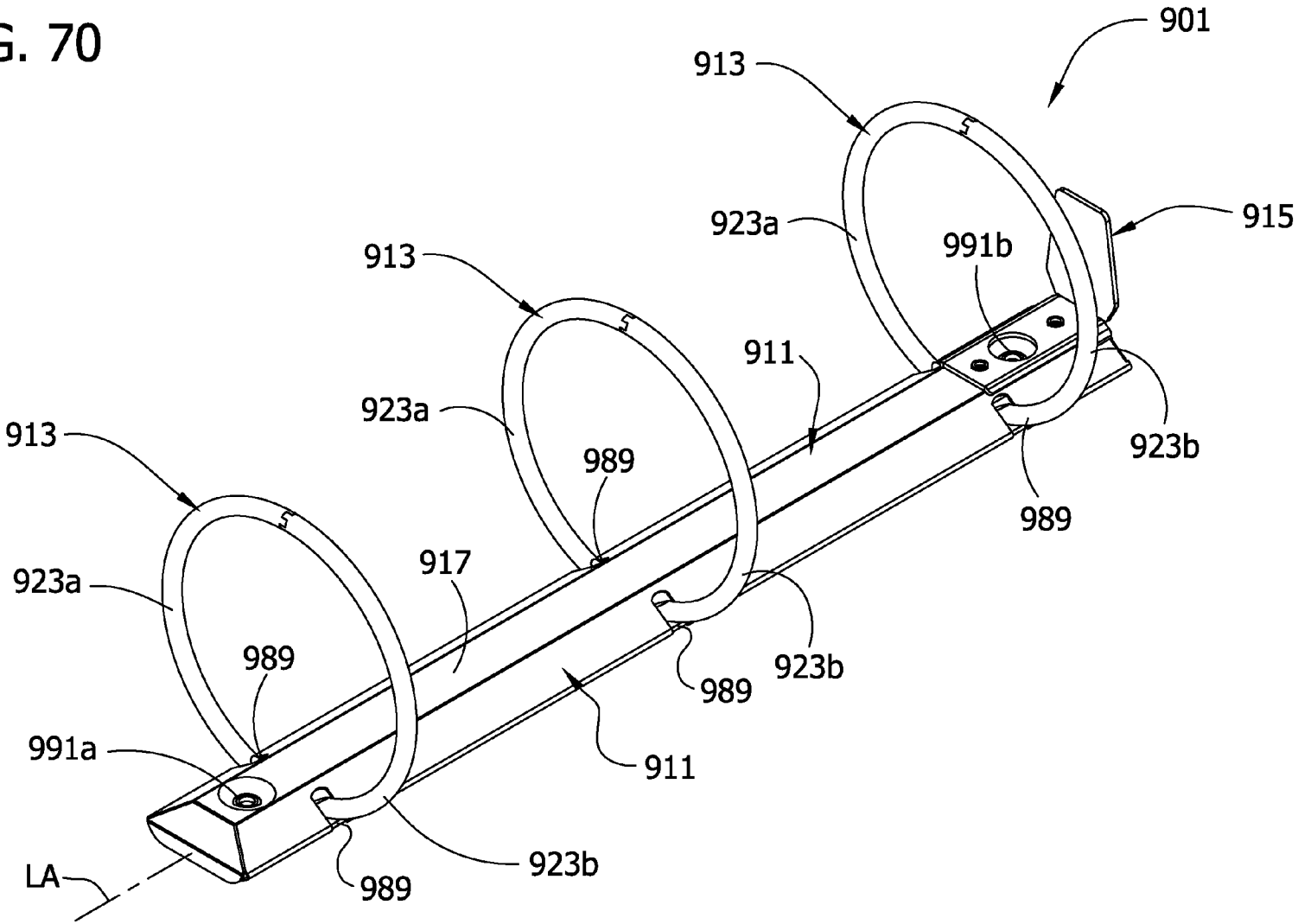
FIG. 70 is a top side perspective of a tenth embodiment of a ring binder mechanism at a closed and locked position and with the lever in a first relaxed position.
Figure 71:
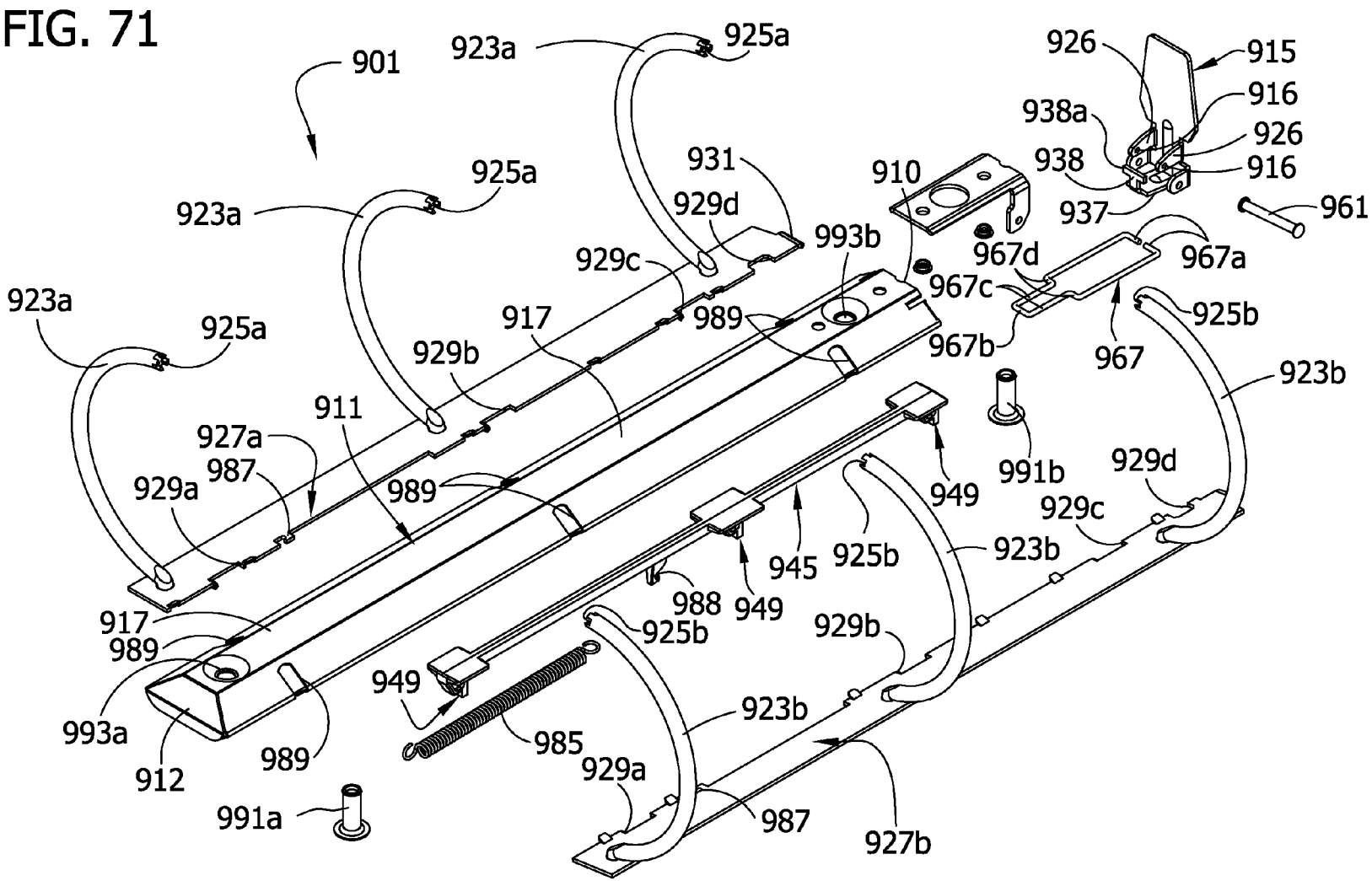
FIG. 71 is an exploded perspective of the ring binder mechanism.
Figure 72:
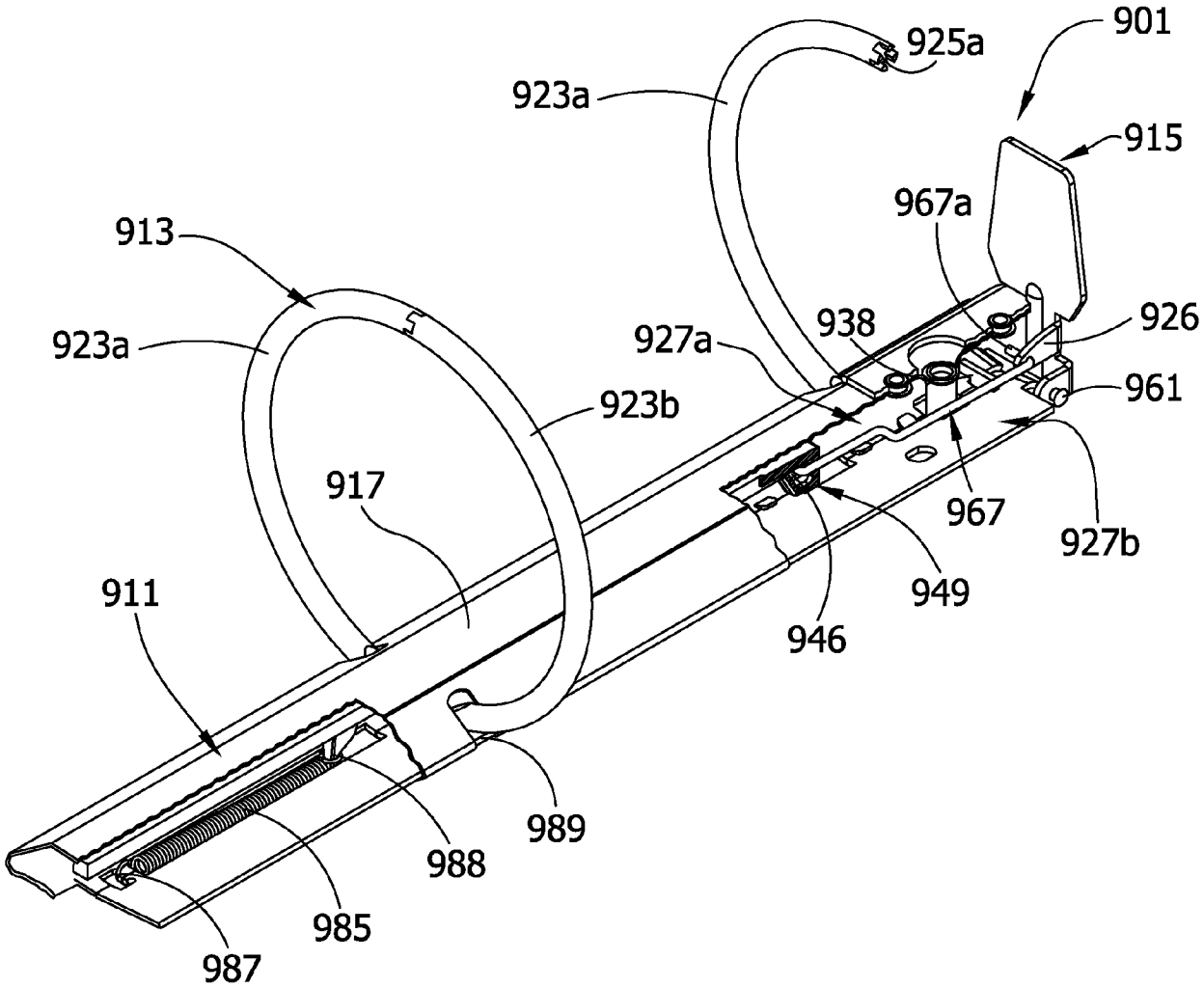
FIG. 72 is an enlarged fragmentary perspective of the ring binder mechanism of FIG. 70 with a portion of a housing broken away to reveal internal construction.

FIGS. 70-76B illustrate a tenth embodiment of a ring binder mechanism 901. As shown in FIG. 71, this mechanism 901 includes a lever 915 that is formed with a lower lip 937 having an I-shaped structure 938. As can be seen in FIG. 72, when the lever 915 is mounted on a housing 911 this I-shaped structure 938 extends through a pair of hinge plates 927*a*, 927*b* so that the hinge plates are trapped by the structure between an upper tab 938*a* and the lower lip 937. As shown in FIG. 71, the lever 915 of this embodiment also includes a pair of opposite upper arms 926. The arms 926 receive an intermediate connector 967 as will be described; the arms do not operate to engage the hinge plates 927*a*, 927*b* or produce pivoting movement of the hinge plates. This lever 915 does not have an upper lip as has been described in prior embodiments.

Figure 73:
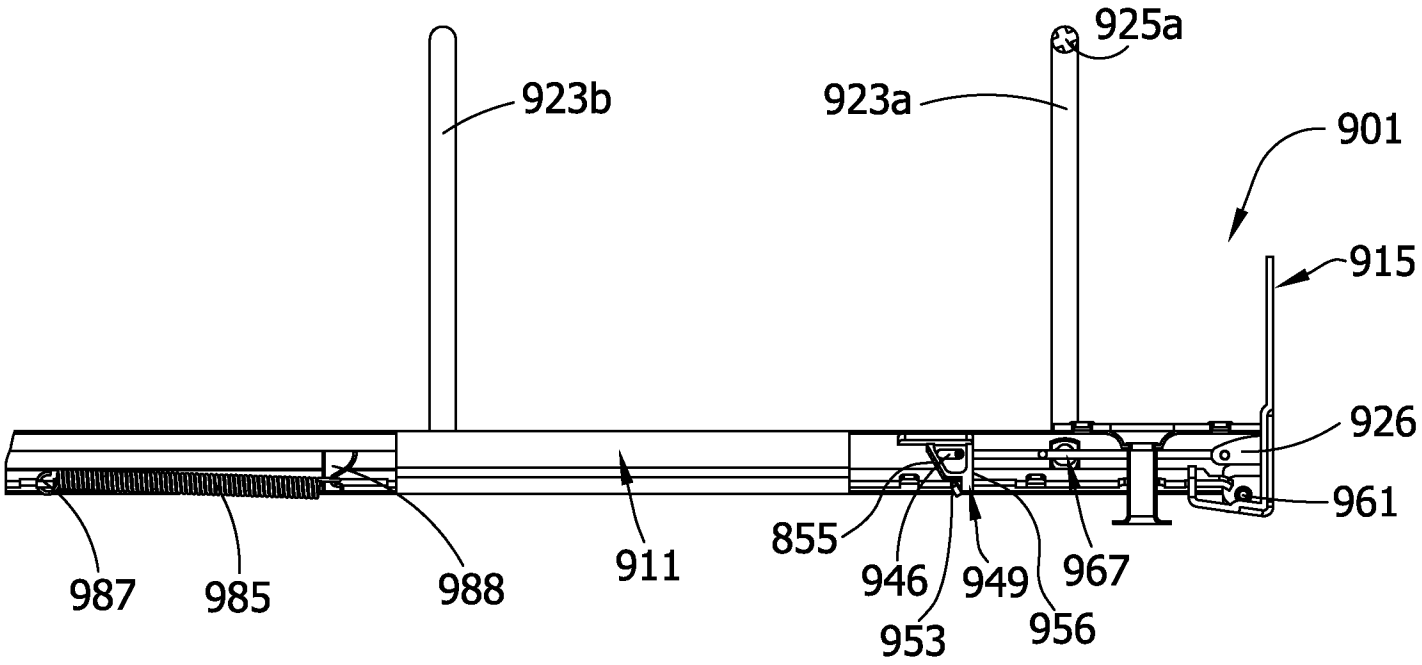
FIG. 73 is an enlarged fragmentary side elevation of the ring binder mechanism with the housing and a hinge plate removed.

A travel bar 945 of this embodiment is operably connected to the lever 915 by the intermediate connector 967. The intermediate connector 967 is illustrated as a wire bent into an elongate, roughly rectangular form. A first end of the intermediate connector 967 is open and includes two free ends 967*a* that fit within respective openings 916 in the upper arms 926 of the lever 915 to form a pivoting connection. A second, closed end 967 of the intermediate connector 967 is narrowed and fits within an elongate opening 946 in a first locking element 949 of the travel bar 945 (FIG. 73). To connect the intermediate connector 967 to the locking element 949, one of the free ends 967*a* of the intermediate connector is threaded through the elongate opening 946 and the intermediate connector is manipulated until the closed end 967*b* is positioned in the elongate opening. The intermediate connector 967 is retained on the locking element 949 for allowing the intermediate connector to pull on the locking element, and thus the travel bar 945, toward the lever 915 while still allowing the intermediate connector to move relative to the locking element, and thus the travel bar, in a forward linear direction away from the lever. The intermediate connector 967 can also pivot relative to the locking element 949, and thus the travel bar 945, to accommodate small vertical movements of the intermediate connector that occur when the lever 915 pivots.

As shown in FIG. 72, this mechanism 901 also includes a tension spring 985 (broadly, a "biasing member") connected to the hinge plates 927*a*, 927*b* at a hook 987 along the inner edge margin of one of the plates and to the travel bar 945 at a downward projecting hook 988 on the travel bar. The bias of the spring 985 urges the travel bar 945 to move away from the lever 915 toward the locked position. This also seats the narrow end 967*b* of the intermediate connector 967 against an outward end of the elongate opening 946 in the first locking element 949 of the travel bar 945 and helps holds the lever 915 in an upright position (FIG. 73).

Figure 74:
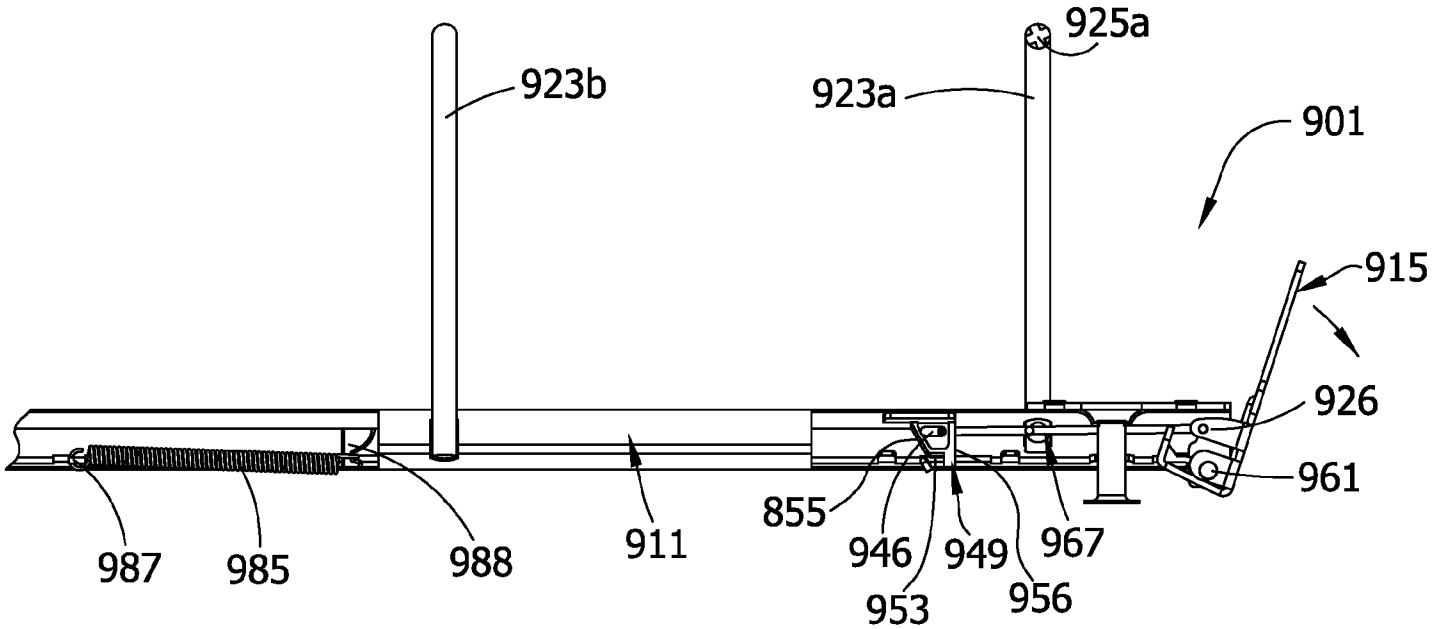
FIG. 74 is an enlarged fragmentary side elevation similar to FIG. 73 but with the lever at the first deformed position.
Figure 75:
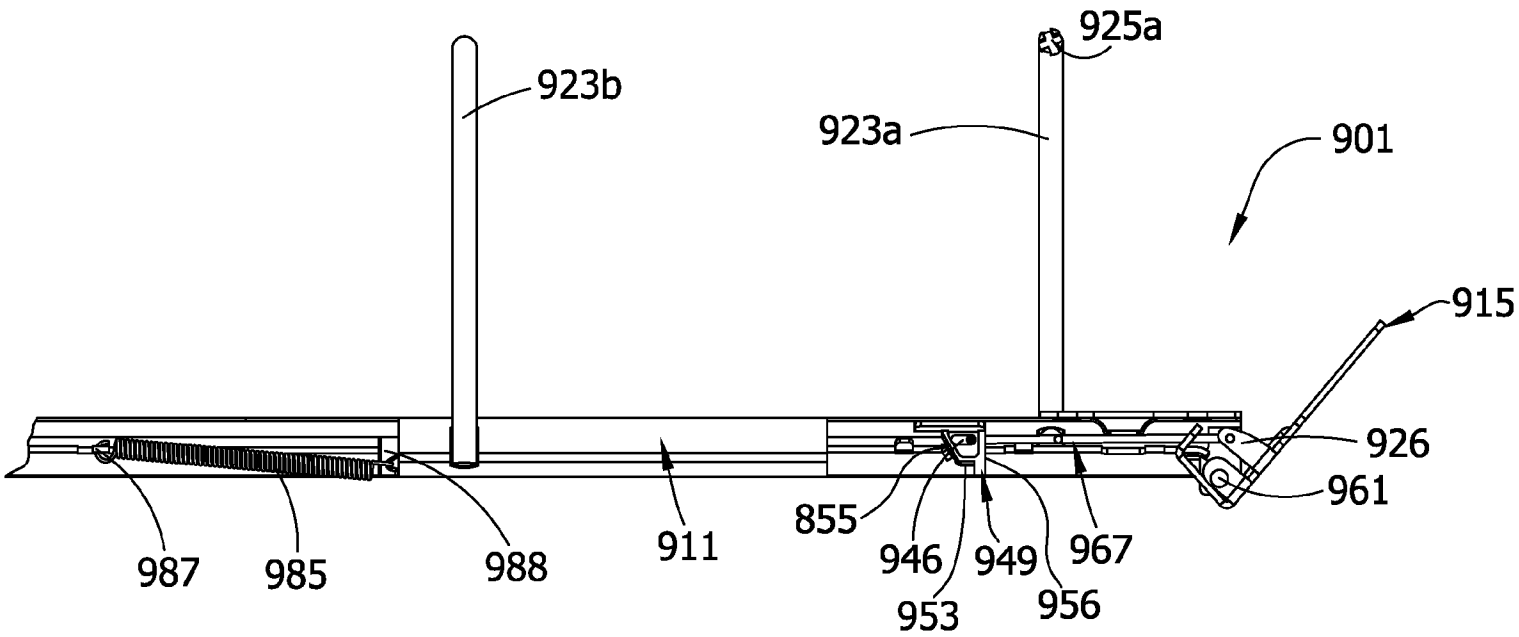
FIG. 75 is an enlarged fragmentary side elevation similar to FIG. 74 but with the ring binder mechanism at the opened position and with the lever in a second deformed position.

Operation of the ring binder mechanism of this embodiment will now be described. FIGS. 70, 72, and 73 illustrate the mechanism 901 in a closed and locked position with the lever 915 in the upright position. To unlock the ring binder mechanism 923*a*, 923*b* and open the ring members, an operator pivots the lever 915 outward and downward (clockwise as indicated by the arrow in FIG. 74). The lower lip 937 of the lever 915 is initially spaced apart from the lower surfaces of the hinge plates 927*a*, 927*b* (FIG. 73). This provides time for the upper arms 926 to pull the intermediate connector 967, which simultaneously pulls the travel bar 945 and moves the locking elements 949 toward the lever 915 and into registration with openings 929*a*, 929*b*, 929*c* in the hinge plates 927*a*, 927*b* before the lower lip 937 engages the hinge plates. The spring 985 extends and tends to pull the travel bar 945 and locking elements 949 back to the locked position with the locking elements behind the hinge plates 927*a*, 927*b*. As shown in FIG. 74, the lower lip 937 of the lever 915 then moves into engagement with lower surfaces of the hinge plates 927*a*, 927*b* (only one hinge plate 927*a* is shown) and begins pushing them upward. Once the hinge plates 927*a*, 927*b* pass through the co-planar position, the spring force of the housing 911 pivots the hinge plates fully upward over the locking elements 949 and the ring members 923*a*, 923*b* open as shown in FIG. 75. The spring 985 recoils slightly and seats the locking elements 949 against inward edges of the openings 929*a*, 929*b*, 929*c* in the hinge plates 927*a*, 927*b*. The spring 985 is still under tension, but the locking elements 949 remain seated in the openings 929*a*, 929*b*, 929*c* and resist the spring's tension. The spring force of the housing 911 prevents the locking elements 949 from camming the hinge plates 927*a*, 927*b* downward under the urge of the extension spring 985.

Figure 76A:
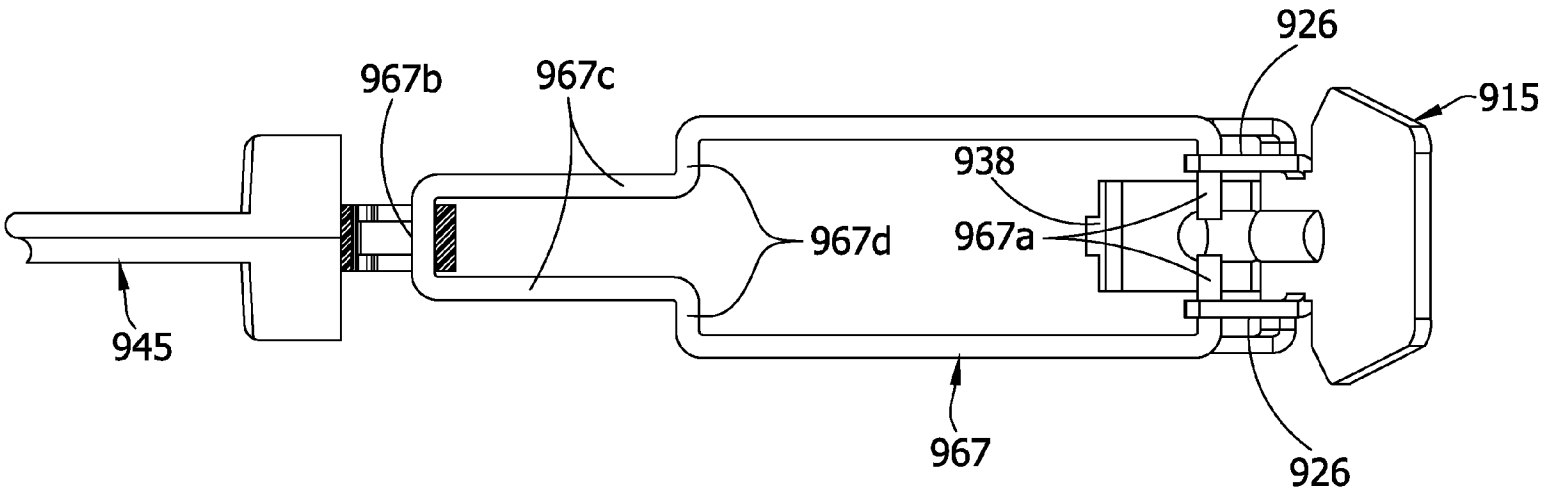
FIGS. 76A and 76B are top plan views illustrating pivoting movement of the lever toward the closed and locked position and the concurrent movement of the intermediate connector.
Figure 76B:
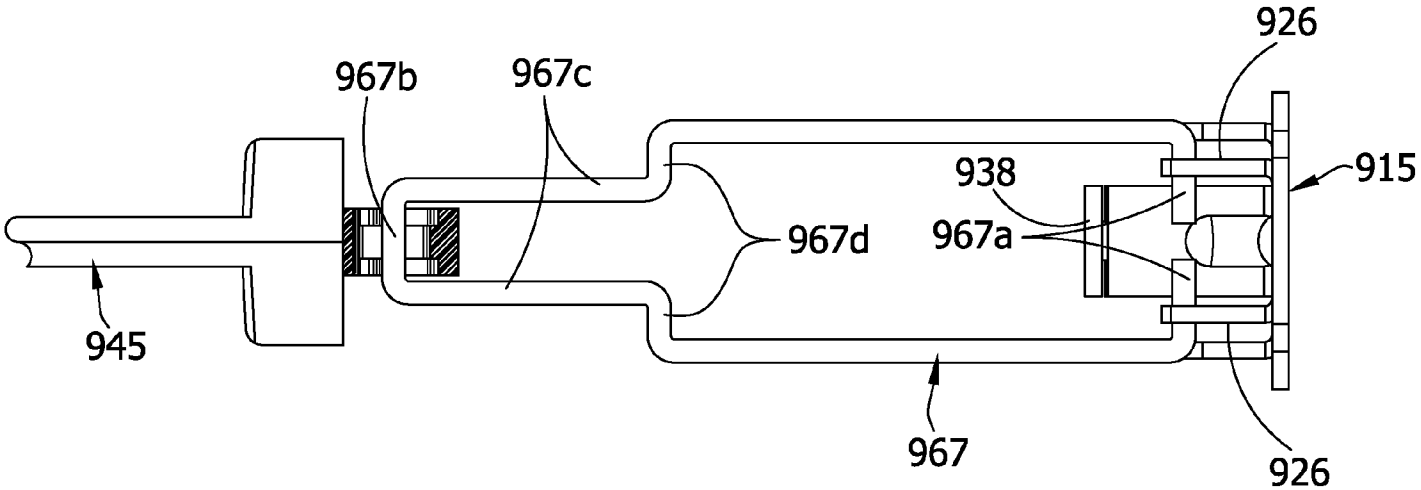

To close the ring members 923*a*, 923*b* and return the mechanism 901 to the locked position, an operator pivots the lever 915 upward and inward. The upper arms 926 of the lever 915 push the intermediate connector 967 forward. The narrow end 967*b* of the intermediate connector moves within the elongate opening 946 in the first locking element 949 of the travel bar 945 from the rearward end of the elongate opening toward a forward end of the elongate opening (FIG. 76B).

Thus, the travel bar 945 is initially stationary. As the lever 915 continues to pivot, the upper tab 938*a* of the I-shaped structure 938 moves into engagement with upper surfaces of the hinge plates 927*a*, 927*b* and pivots the hinge plates downward, through the co-planar position, and opens the ring members 923*a*, 923*b*. Sloped inward edges 955 of the locking elements 949 allow the travel bar 945 to move slightly as the hinge plates 927*a*, 927*b* pivot down. As soon as the hinge plates 927*a*, 927*b* clear bottom surfaces of the locking elements 949, the extension spring 985 pulls on the travel bar 945 and moves it and the locking elements back to the locked position with the locking elements behind the hinge plates. The travel bar 945 moves a short distance relative to the intermediate connector 967 until the narrow end 967*ba* of the intermediate connector again contacts the outward end of the elongate opening 946 in the travel bar 945. The travel bar 945 then pulls on the intermediate connector 967 and the lever 915, and returns the lever to its upright position (FIG. 73).

In this embodiment the lower lip 937 of the lever 915 is spaced apart from the lower surfaces of the hinge plates 927*a*, 927*b* when the ring members 923*a*, 923*b* are closed. This provides room for the lower lip 937 to pivot to pull the locking elements 949 from the locked position behind the hinge plates 927*a*, 927*b* to the unlocked position in registration with openings 929*a*, 929*b*, 929*c* in the hinge plates before beginning to pivot the hinge plates upward.

Also in this embodiment, the intermediate connector 967 and the first locking element 949 of the travel bar 945 are formed so that the locking element slidably receives the intermediate connector, allowing the intermediate connector to move relative to the locking element and travel bar in a linear direction along a longitudinal axis of the travel bar. The intermediate connector 967 is initially positioned relative to the locking element 949 so that opening movement of the lever 915 pulls on the connector and simultaneously moves the travel bar 945 and locking elements toward the lever and out of the locked position. The intermediate connector 967 can then move relative to the locking elements 949 and travel bar 945 so that closing movement of the lever 915 pushes on the intermediate connector but does not initially move the travel bar. Instead, the intermediate connector 967 moves relative to the travel bar 945 so that the lever 915 can first pivot the hinge plates 927*a*, 927*b* downward to close the ring members 923*a*, 923*b*. Then the spring 985 pulls the travel bar 945 and locking elements 949 to the locked position, which in turn pull the lever 915 to the upright position.

It is envisioned that the lever 915 of this embodiment is formed from a rigid material such as sheet metal. Other materials may be used within the scope of the invention.

Figure 83A:
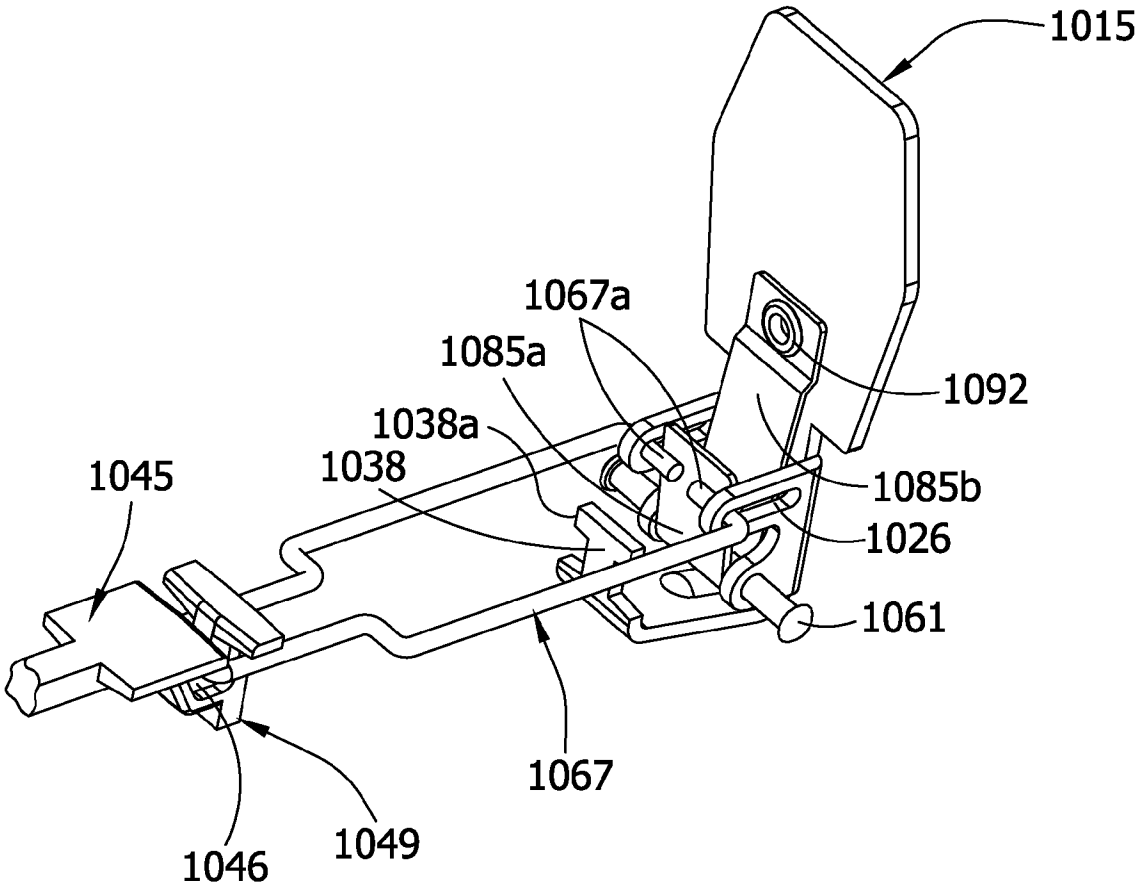
FIGS. 83A and 83B are enlarged perspective views illustrating pivoting movement of the lever toward the closed and locked position and the concurrent movement of the intermediate connector.
Figure 83B:
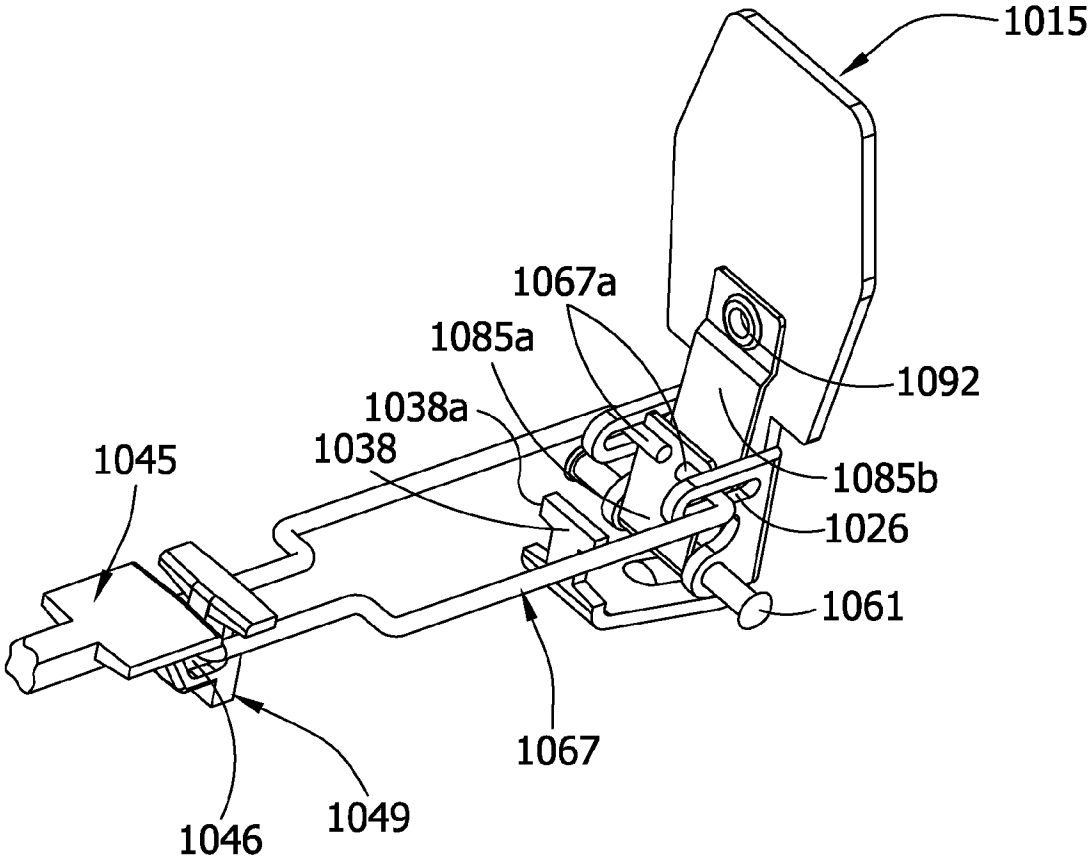
Figure 84:
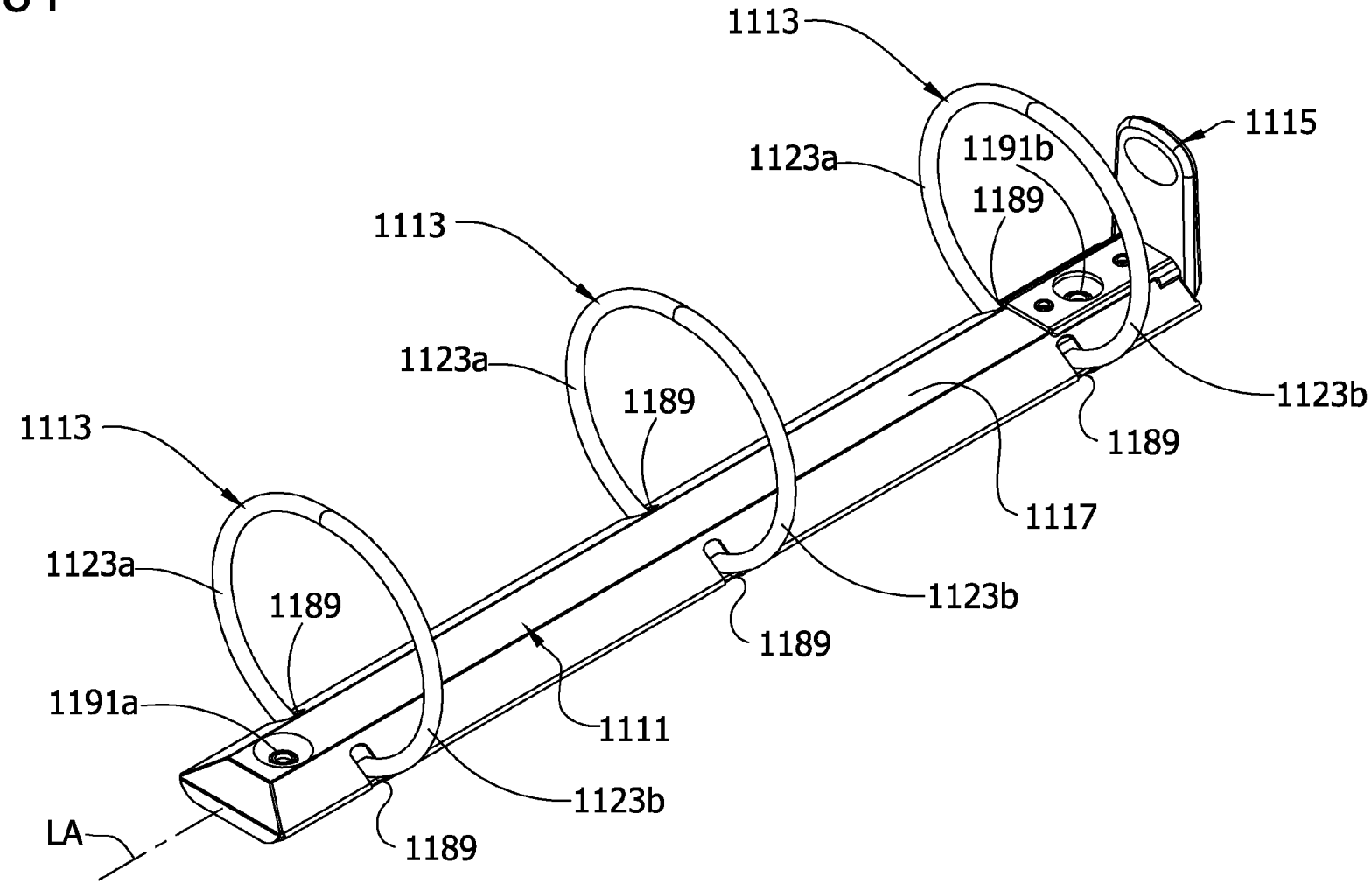
FIG. 84 is a top side perspective of a twelfth embodiment of a ring binder mechanism at a closed and locked position and with the lever in a first relaxed position.
Figure 85:
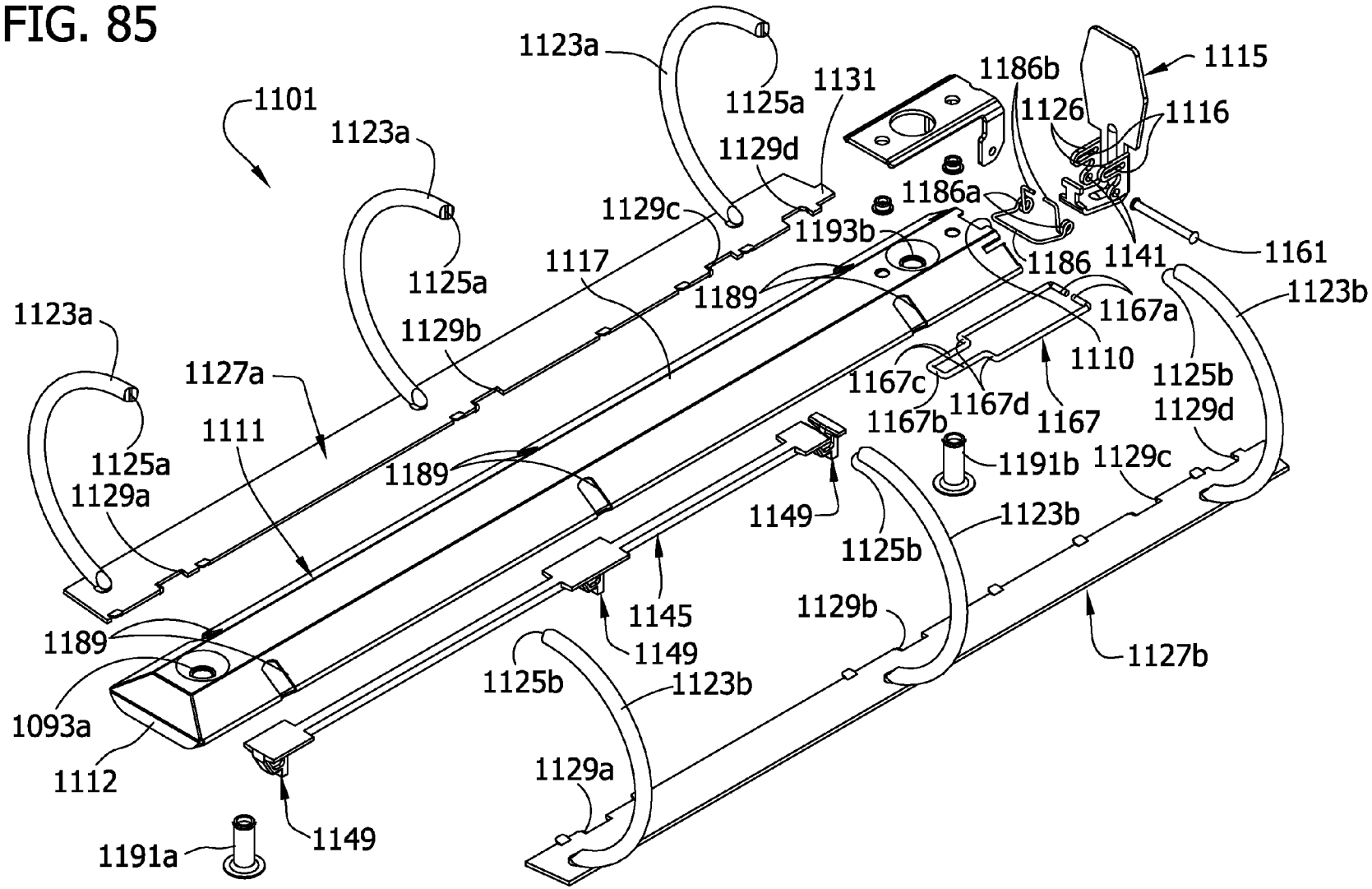
FIG. 85 is an exploded perspective of the ring binder mechanism.
Figure 86:
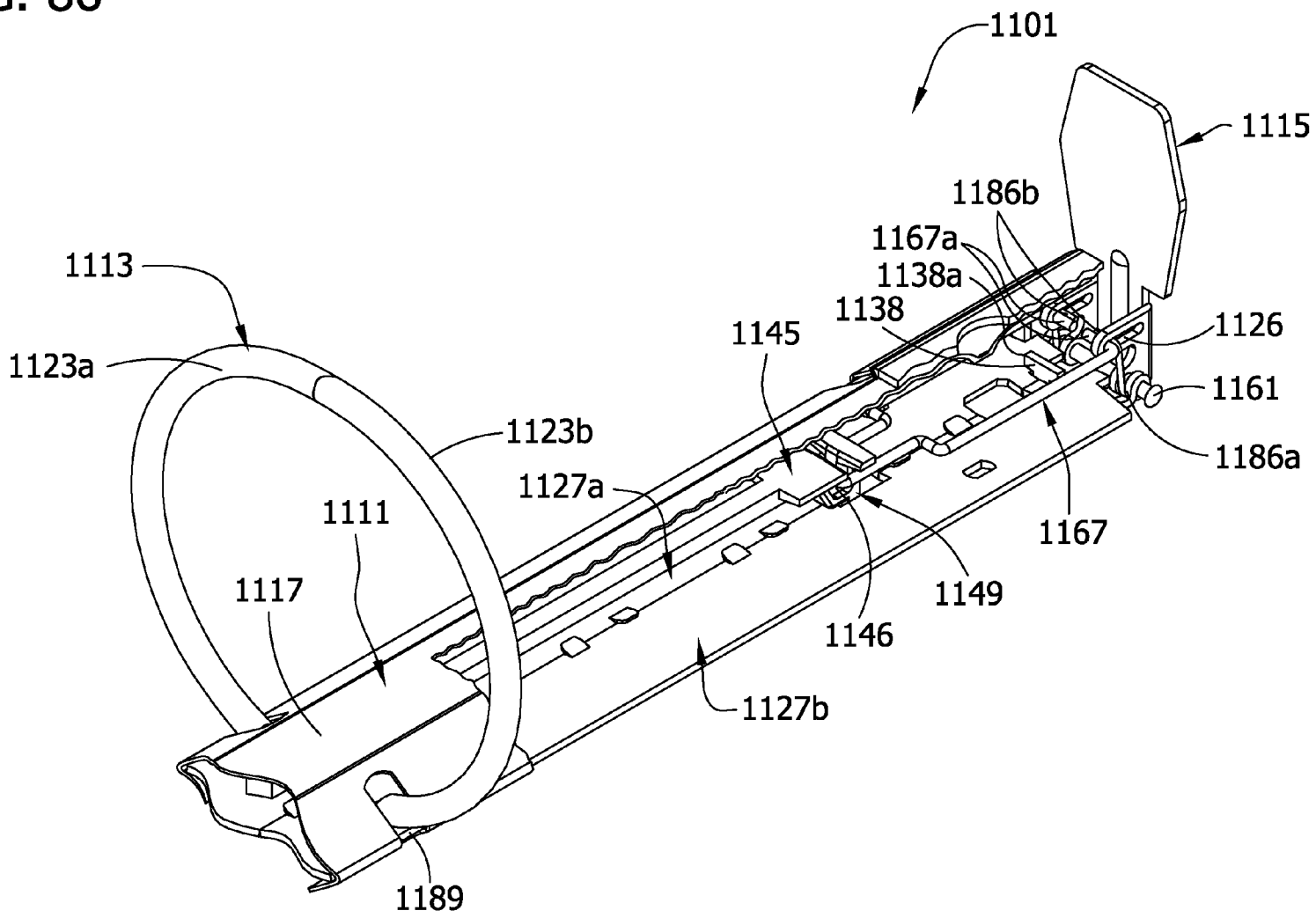
FIG. 86 is an enlarged fragmentary perspective of the ring binder mechanism of FIG. 84 with a portion of a housing broken away to reveal internal construction.
Figure 87:
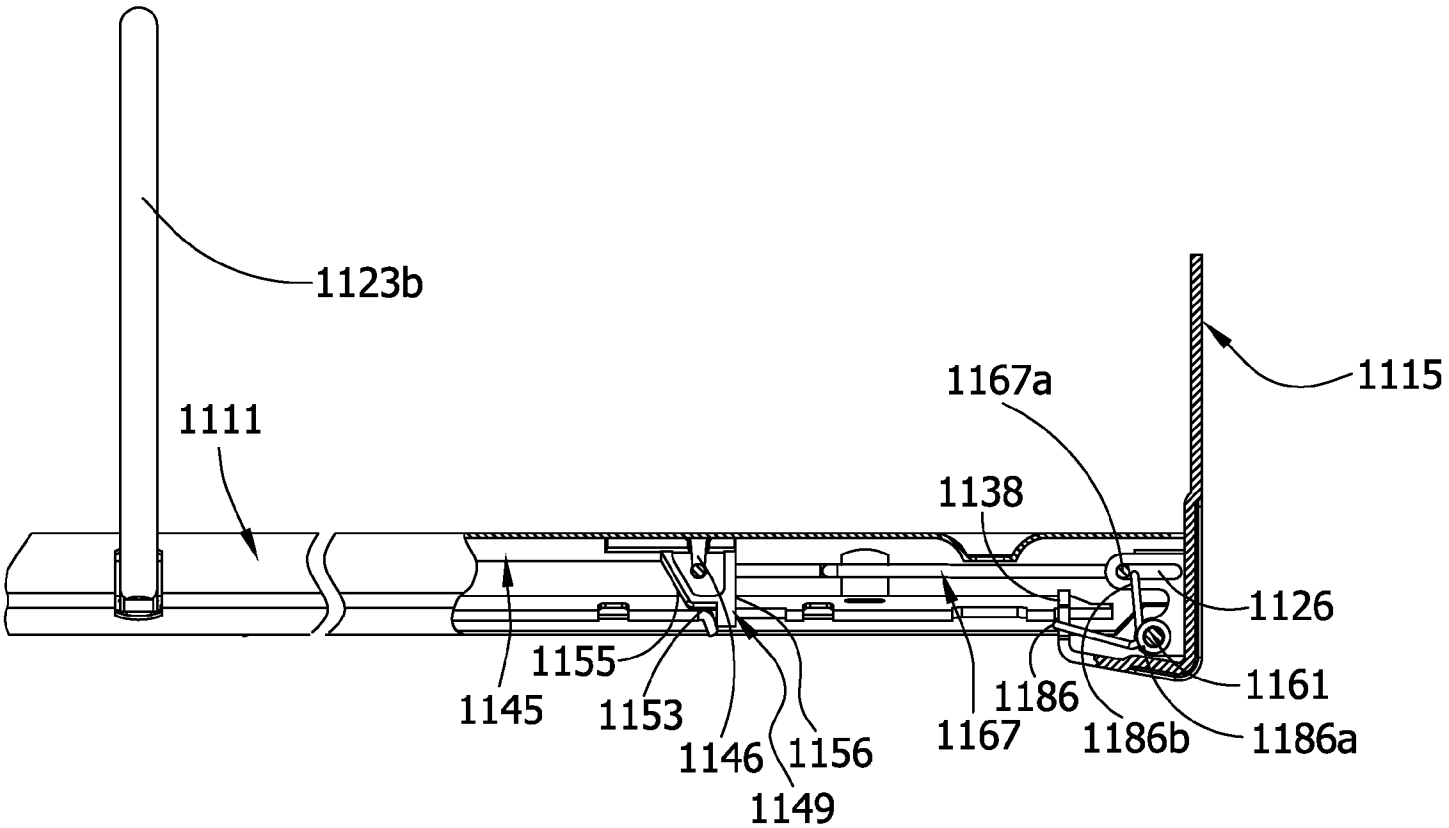
FIG. 87 is an enlarged fragmentary side elevation of the ring binder mechanism with the housing and a hinge plate removed.

FIGS. 77-83B illustrate an eleventh embodiment of a ring binder mechanism 1001 in which a spring plate 1085 and torsion spring 1086 (broadly, "biasing members") are used to bias a travel bar 1045 and locking elements 1049 toward the locked position and a lever 1015 to the upright position. The tension spring of the previous embodiment is omitted in this embodiment. Also in this embodiment, an intermediate connector 1067 is connected to the travel bar 1045 so that the intermediate connector does not slide relative to the travel bar. Instead, upper arms 1026 of the lever 1015 are formed with elongate openings 1016 so that the intermediate connector 1067 can slide in a linear direction within the openings relative to the lever (FIG. 83B).

Figure 78:
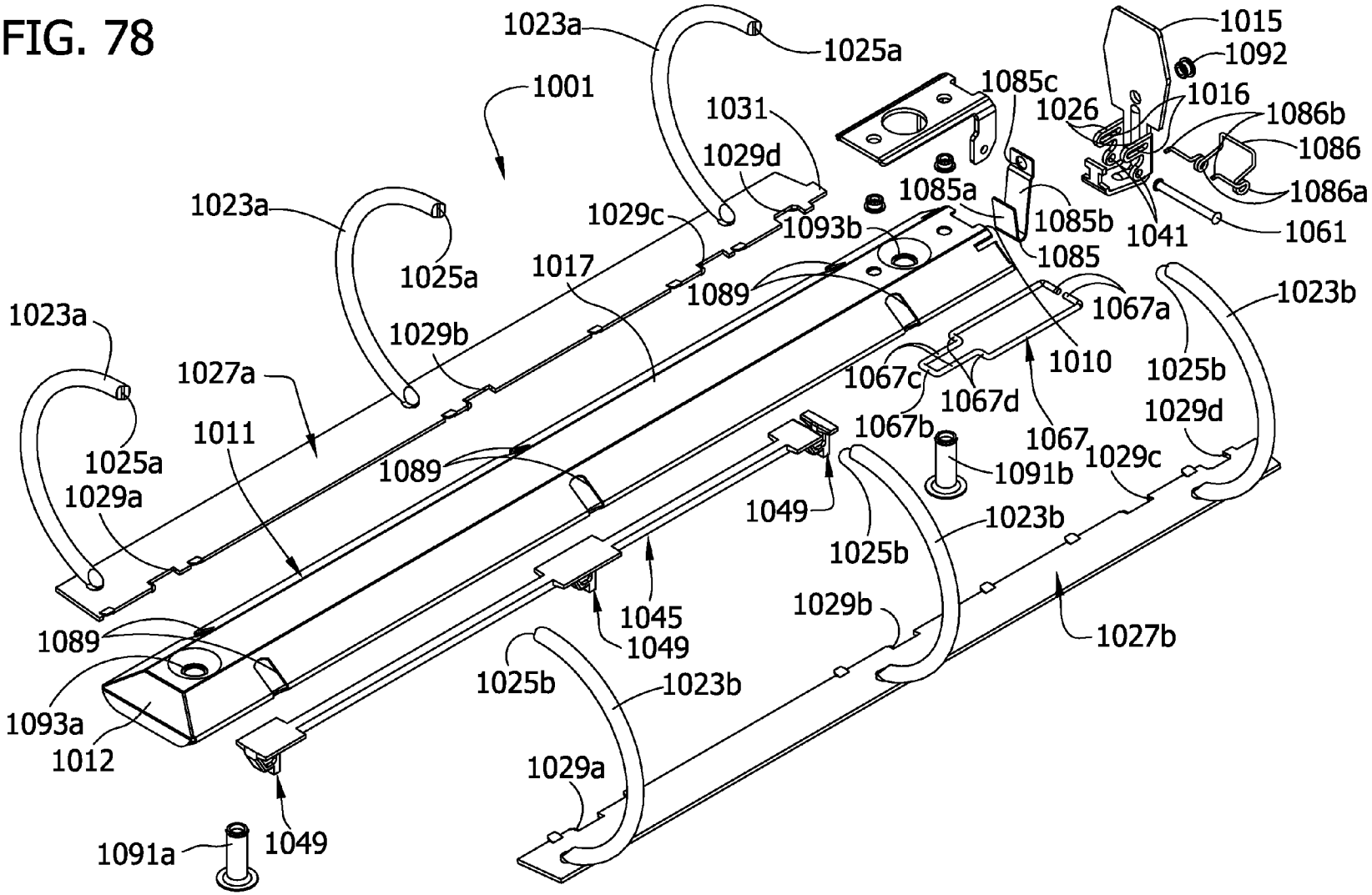
FIG. 78 is an exploded perspective of the ring binder mechanism.

As shown in FIG. 78, the spring plate 1085 is U-shaped with a first arm 1085*a* and a second arm 1085*b*. The second arm 1085*b* includes an opening 1085*c* for receiving a rivet 1092 to connect the spring plate to an inward side of the lever 1015. Specifically, the spring plate 1085 connects to the lever 1015 between the upper arms 1026 of the lever and above a lower lip 1037. The torsion spring 1086 engages an outward side of the lever 1015. Particularly, a body of the spring 1086 extends around the outward side of the lever 1015. Coils 1086*a* in the spring 1086 align with mounting openings 1041 in the lever 1015 so that a mounting pin 1061 which connects the lever to the housing 1011 also connects the torsion spring to the lever. Free ends 1086*b* of the torsion spring 1086 are disposed to engage the underside of the housing 1011 to limit their movement in a clockwise direction (as shown in FIG. 80) about the axis of the mounting pin 1061.

Figure 77:
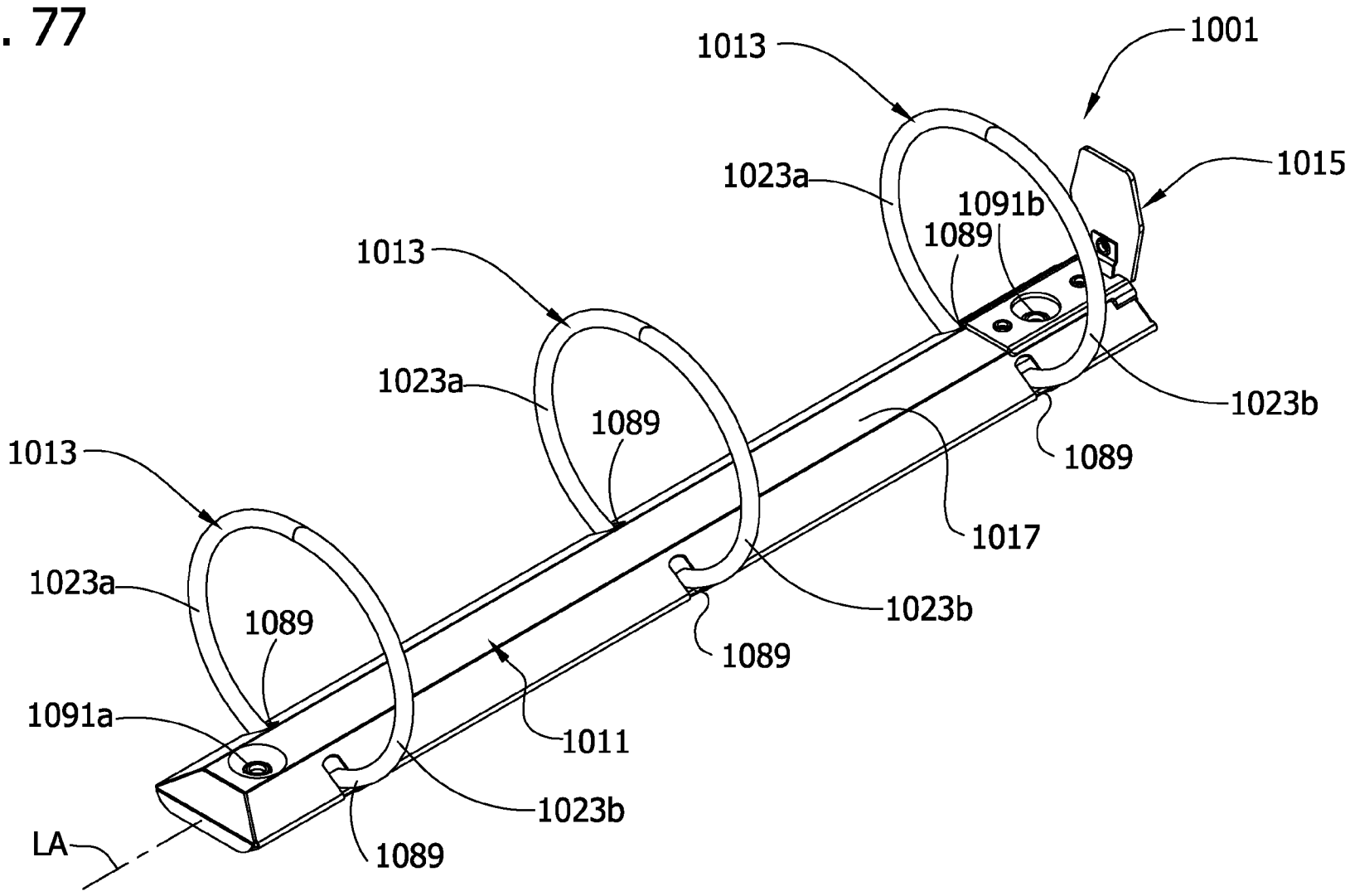
FIG. 77 is a top side perspective of a eleventh embodiment of a ring binder mechanism at a closed and locked position and with the lever in a first relaxed position.
Figure 79:
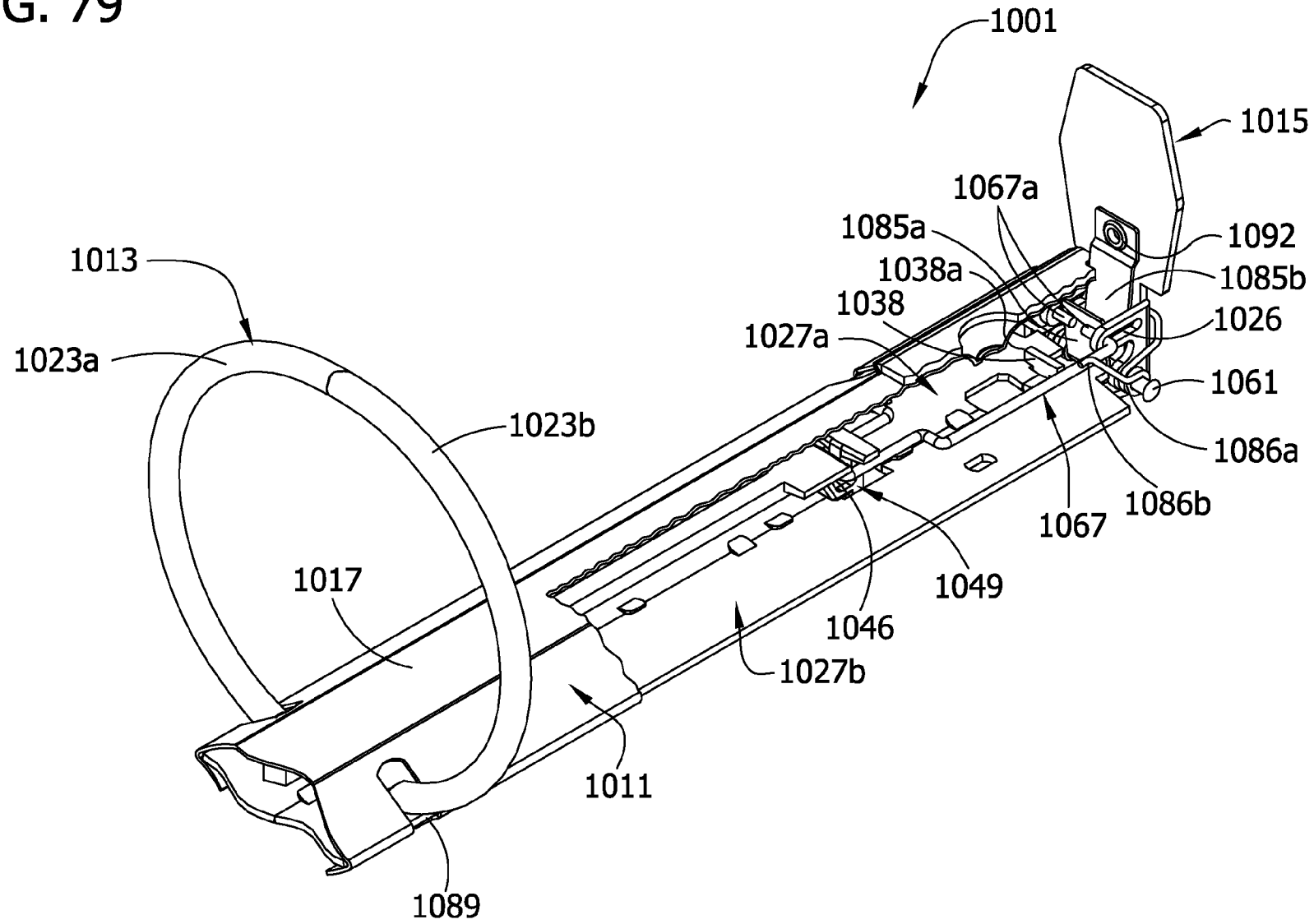
FIG. 79 is an enlarged fragmentary perspective of the ring binder mechanism of FIG. 77 with a portion of a housing broken away to reveal internal construction.
Figure 80:
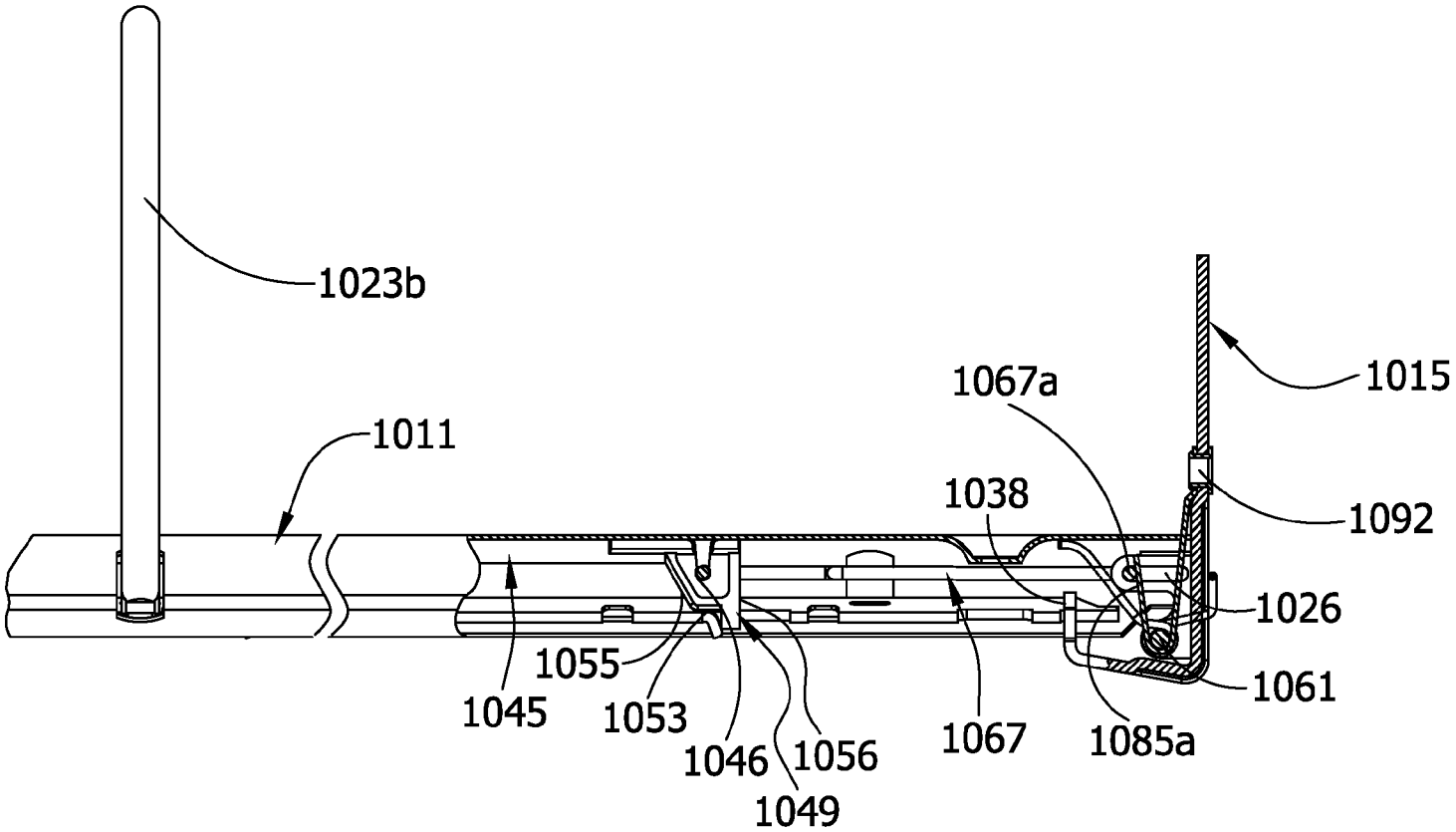
FIG. 80 is an enlarged fragmentary side elevation of the ring binder mechanism with the housing and a hinge plate removed.
Figure 81:
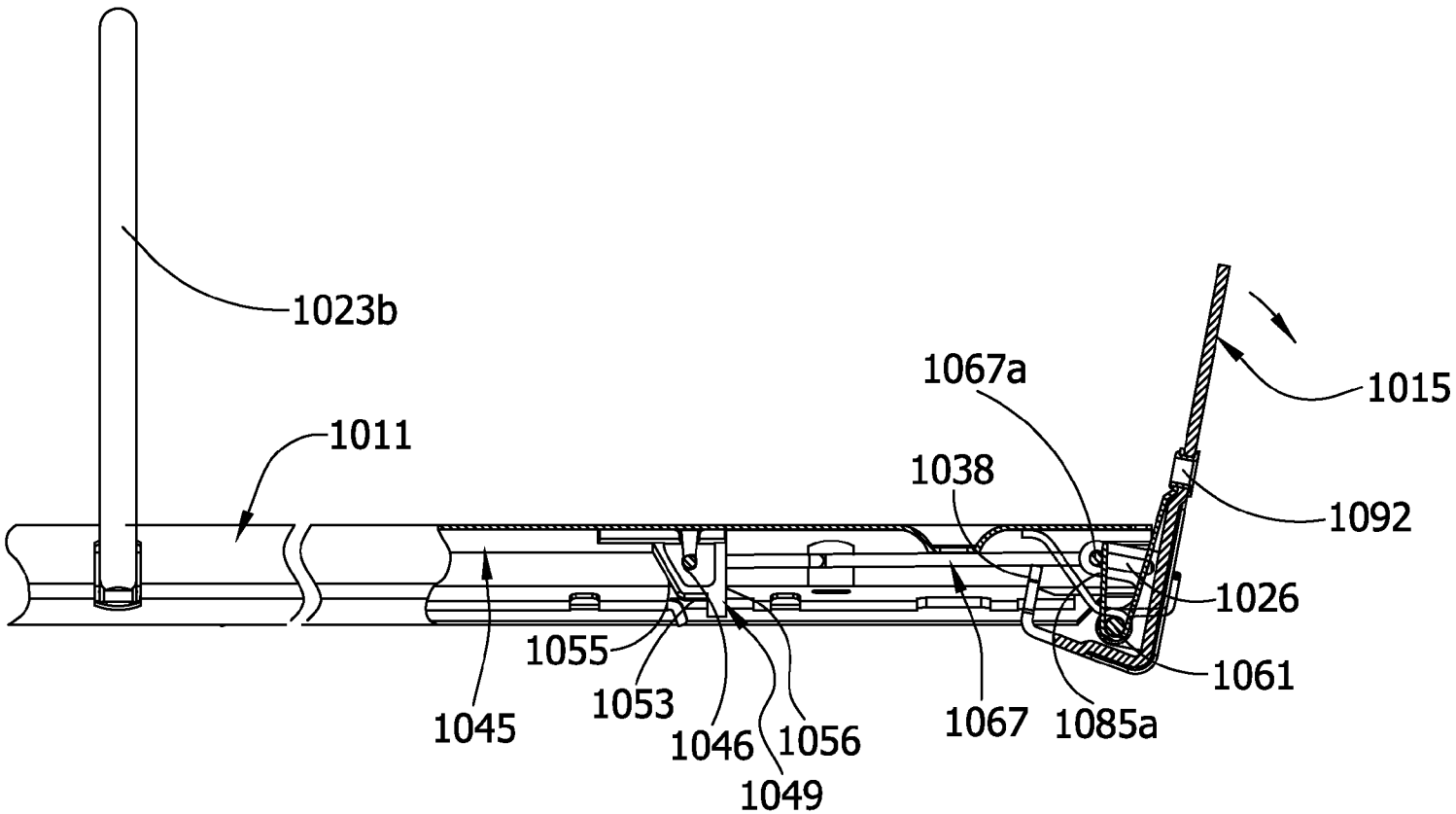
FIG. 81 is an enlarged fragmentary side elevation similar to FIG. 80 but with the lever at the first deformed position.
Figure 82:
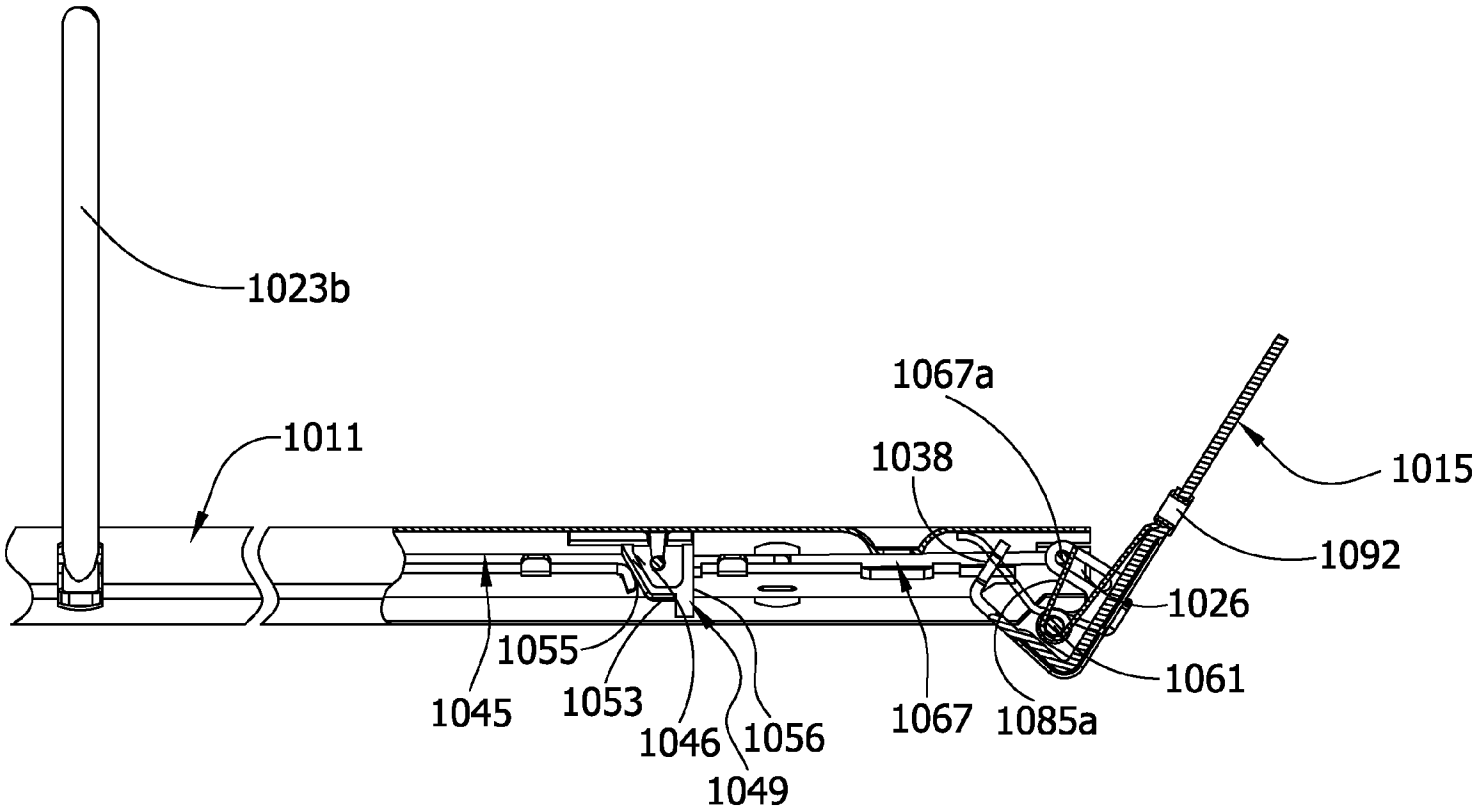
FIG. 82 is an enlarged fragmentary side elevation similar to FIG. 81 but with the ring binder mechanism at the opened position and with the lever in a second deformed position.

In this variation, when the ring members 1023*a*, 1023*b* are closed as shown in FIGS. 77, 79, and 80, free ends 1067*a* of the intermediate connector 1067 are positioned at an inward end of the elongate openings 1016 in the upper arms 1026 of the lever 1015. The first arm 1085*a* of the spring plate 1085 engages the free ends 1067*a* of the intermediate connector 1067 and urges them to this position. When the lever 1015 pivots to open the ring members 1023*a*, 1023*b* as indicated by the arrow in FIG. 81, the lever simultaneously pulls the intermediate connector 1067 and travel bar 1045 toward the lever and moves the locking elements 1049 to the unlocked position in registration with openings 1029*a*, 1029*b*, 1029*c* in the hinge plates 1027*a*. 1027*b*. The torsion spring 1086 extending around the outward side of the lever 1015 tensions and bends with the movement of the lever, tending to urge the lever back toward the upright position. If the lever 1015 is released before the ring members 1023*a*, 1023*b* open and the hinge plates 1027*a*, 1027*b* pass through the co-planar position, the torsion spring 1086 will push the lever back to the upright position, conjointly moving the travel bar 1045 and locking elements 1049 back to the locked position. Once the ring members 1023*a*, 1023*b* are open (FIGS. 82 and 83A) and the locking elements 1049 are seated in the openings 1029*a*, 1029*b*, 1029*c* in the hinge plates 1027*a*, 1027*b*, the locking elements resist movement of the travel bar 1045 and intermediate connector 1067 via the spring force of the housing 1011 (the spring force of the housing resists camming forces of the locking elements that may tend to pivot the hinge plates downward). This also resists the bias of the torsion spring 1086 tending to pivot the lever 1015 upward and inward.

When the lever 1015 is pivoted to close the ring members 1023*a*, 1023*b*, the lever swings upward and inward, but the intermediate connector 1067 is held stationary (FIG. 83B). The locking elements 1049 are positioned in the openings 1029*a*, 1029*b*, 1029*c* in the upwardly pivoted hinge plates 1027*a*, 1027*b* and are seated against forward edges of the hinge plate openings and resist forward movement of the travel bar 1045 and intermediate connector 1067. As the lever 1015 continues to pivot, it moves relative to the intermediate connector 1067, which slides within the elongate openings 1016 in the upper arms 1026 of the lever. This can be seen in FIG. 83B. The first arm 1085*a* of the spring plate 1085 is pushed by the intermediate connector 1067 toward the second arm 1085*b* of the spring plate, which is held relatively stationary against the free ends 1067*a* of the intermediate connector 1067. This flexes and tensions the spring plate 1067. An upper tab 1038*a* of the I-shaped formation 1038 of the lever 1015 engages the hinge plates 1027*a*, 1027*b* and pivots them toward the co-planar position. Sloped inward edges 1055 of the locking elements 1049 allow the travel bar 1045 to move slightly as the hinge plates 1027*a*, 1027*b* pivot down. Once the hinge plates 1027*a*, 1027*b* pivot over the locking elements 1049, the lever 1015 moves to the upright position and moves the intermediate connector 1067, travel bar 1025 and locking elements 1049 to the locked position. The tensioned spring plate 1085 pushes the intermediate connector 1067 to the forward end of the elongate openings 1016 in the upper arms 1026, ensuring the travel bar 1045 and locking elements 1049 move fully to the locked position. At about the same time, the tension spring 1086 pushes upward on the lever 1015, ensuring it moves fully back to the upright position.

FIGS. 85-90B illustrate a ring binder mechanism 1101 having a twelfth embodiment. In this mechanism, a torsion spring 1186 (broadly, a "biasing member") is positioned with a closed end of the spring under a pair of hinge plates 1027*a*, 1027*b*. Free ends 1186*b* of the spring 1186 are bent inward and fit through elongate openings 1116 in upper arms 1126 of a lever 1115 and rest against free ends 1167*a* of the intermediate connector 1167 (outward of the connector ends).

Figure 88:
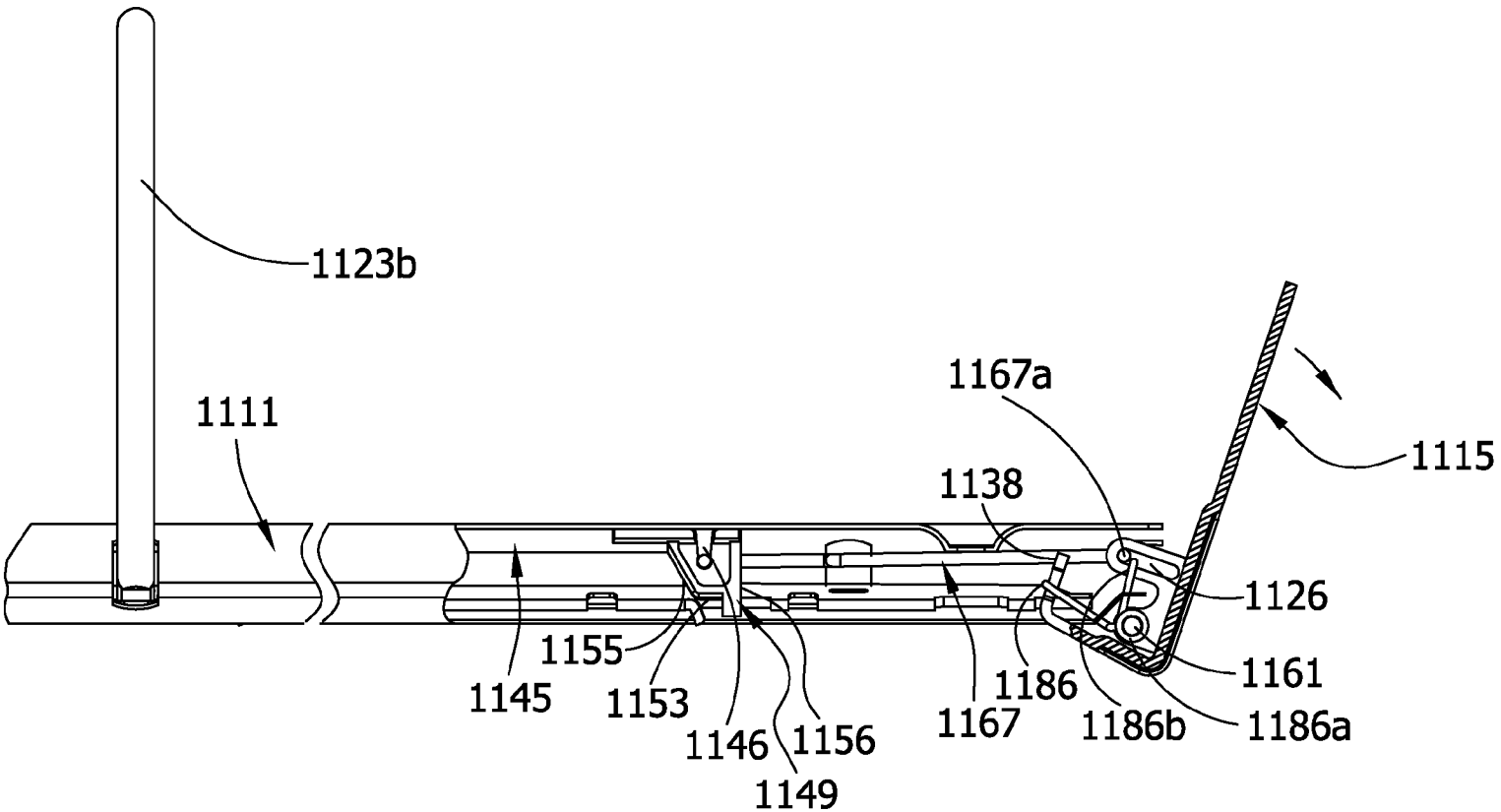
FIG. 88 is an enlarged fragmentary side elevation similar to FIG. 87 but with the lever at the first deformed position.
Figure 89:
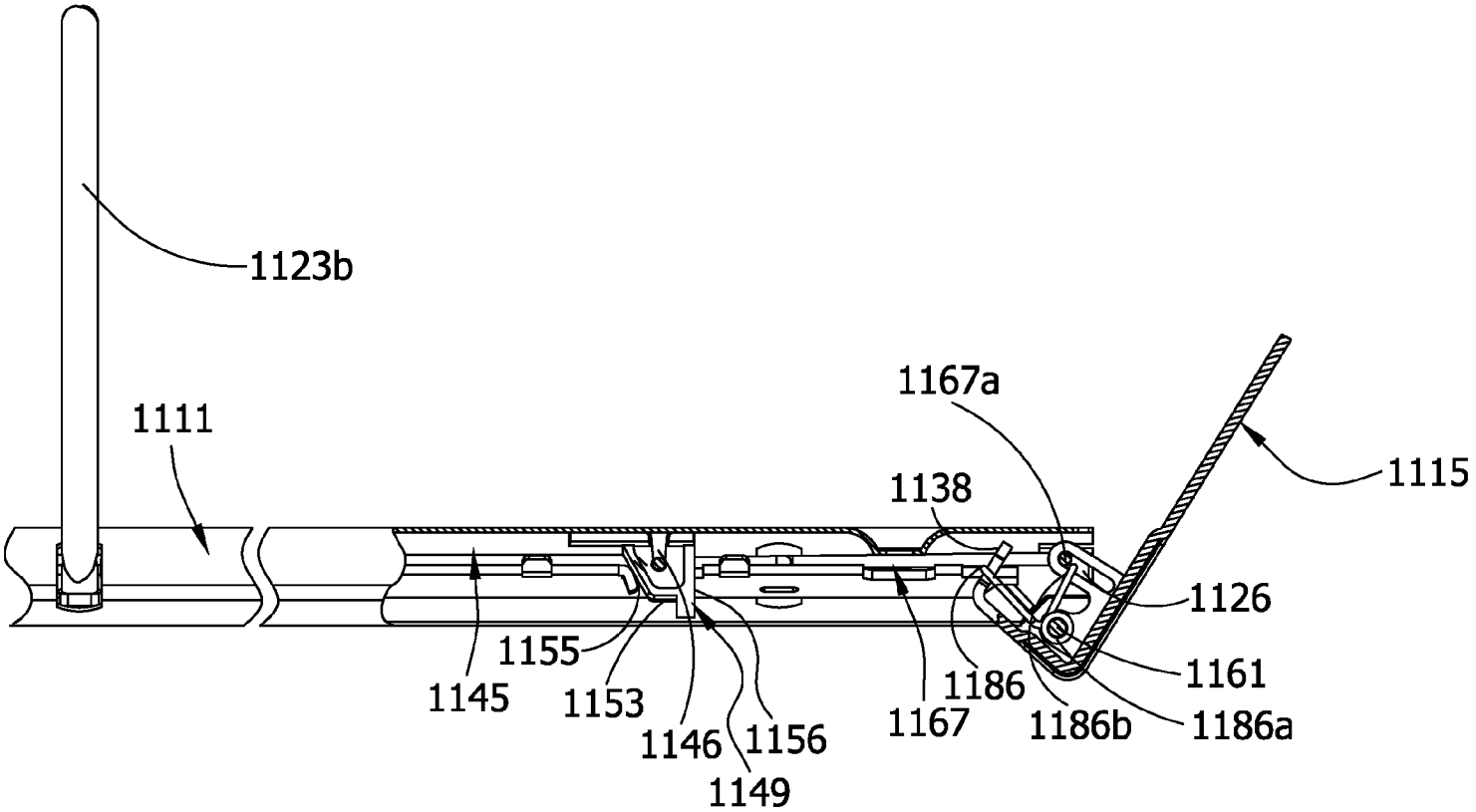
FIG. 89 is an enlarged fragmentary side elevation similar to FIG. 88 but with the ring binder mechanism at the opened position and with the lever in a second deformed position.
Figure 90A:
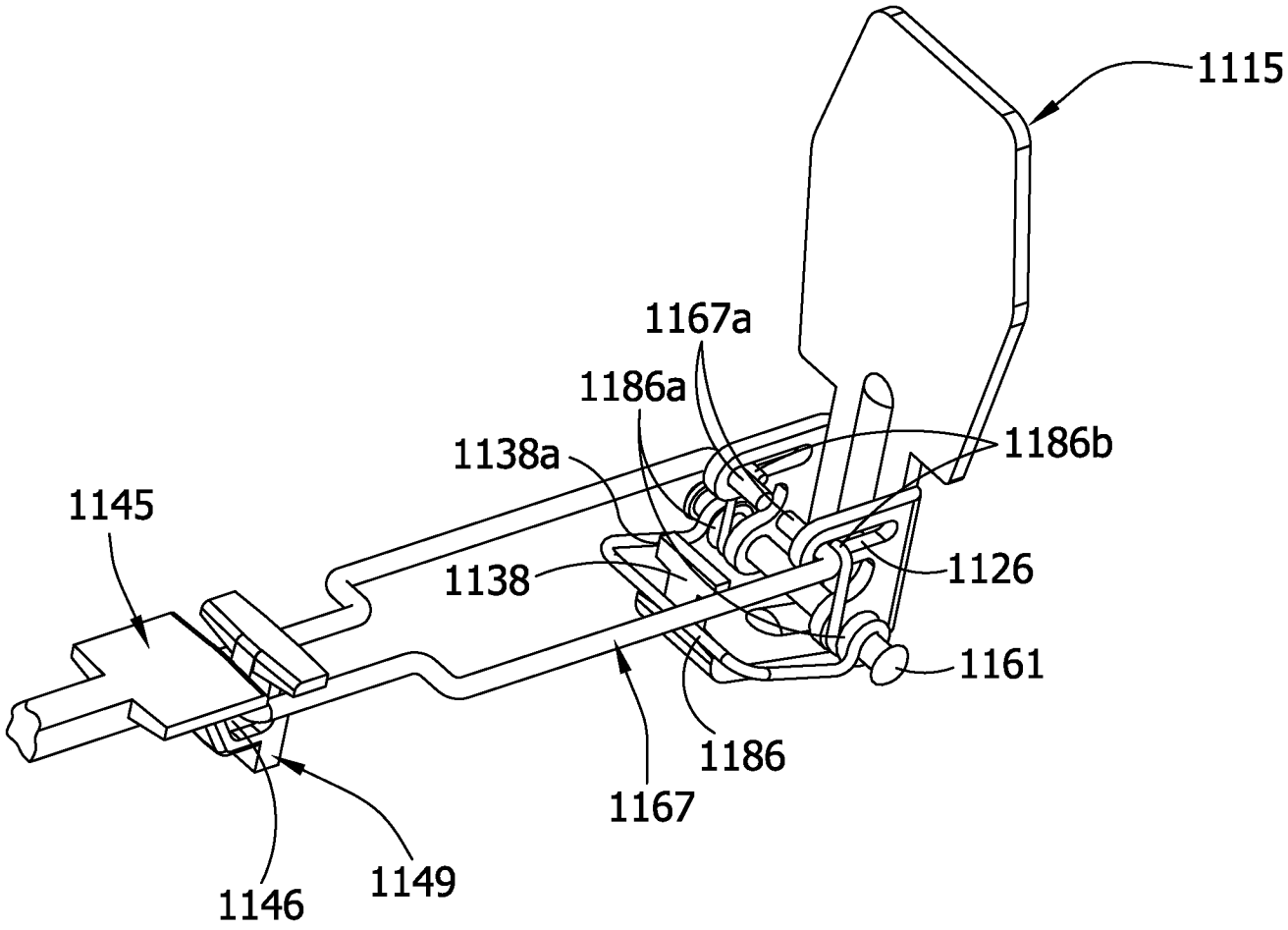
FIGS. 90A and 90B are enlarged perspective views illustrating pivoting movement of the lever toward the closed and locked position and the concurrent movement of the intermediate connector.
Figure 90B:
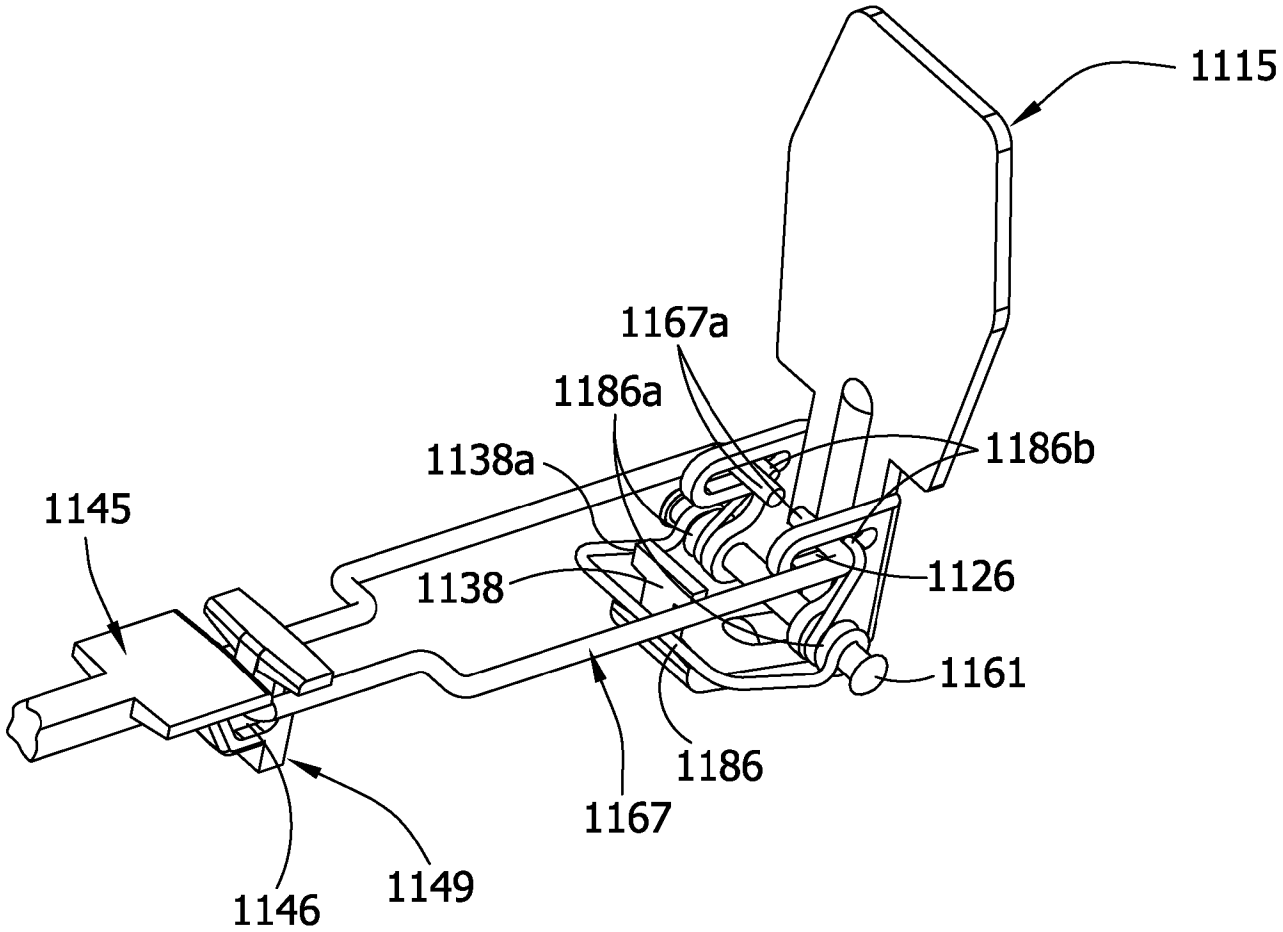

When the lever 1115 pivots to open paired ring members 1123*a*, 1123*b*, the lever pulls the intermediate connector 1167 toward it (FIG. 88). The lever 1115 also pulls the free ends 1186*b* of the spring 1186 away from the closed end of the spring, creating a tension in the spring that tends to urge the lever 1115 back toward the upright position. When the lever 1115 pivots to close the ring members 1123*a*, 1123*b*, the intermediate connector 1167 is initially held substantially stationary by locking elements 1149 seated in the openings 1129*a*, 1129*b*, 1129*c* in the hinge plates 1127*a*, 1127*b*. As the lever 1115 continues to pivot, the lever moves relative to the intermediate connector 1167. The free ends 1167*a* of the intermediate connector 1167 slide toward the rearward end of the elongate openings 1116 in the upper arms 1126 of the lever 1115 (FIG. 90B). The intermediate connector 1167 pushes the free ends 1186*b* of the spring 1186 to the outward end of the elongate openings 1116 thereby tensioning the spring. Once the hinge plates 1127*a*, 1127*b* pivot over the locking elements 1149, the spring 1186 immediately pushes the intermediate connector 1167 inward and moves the travel bar 1145 and locking elements 1149 to the locked position.

Figure 91:
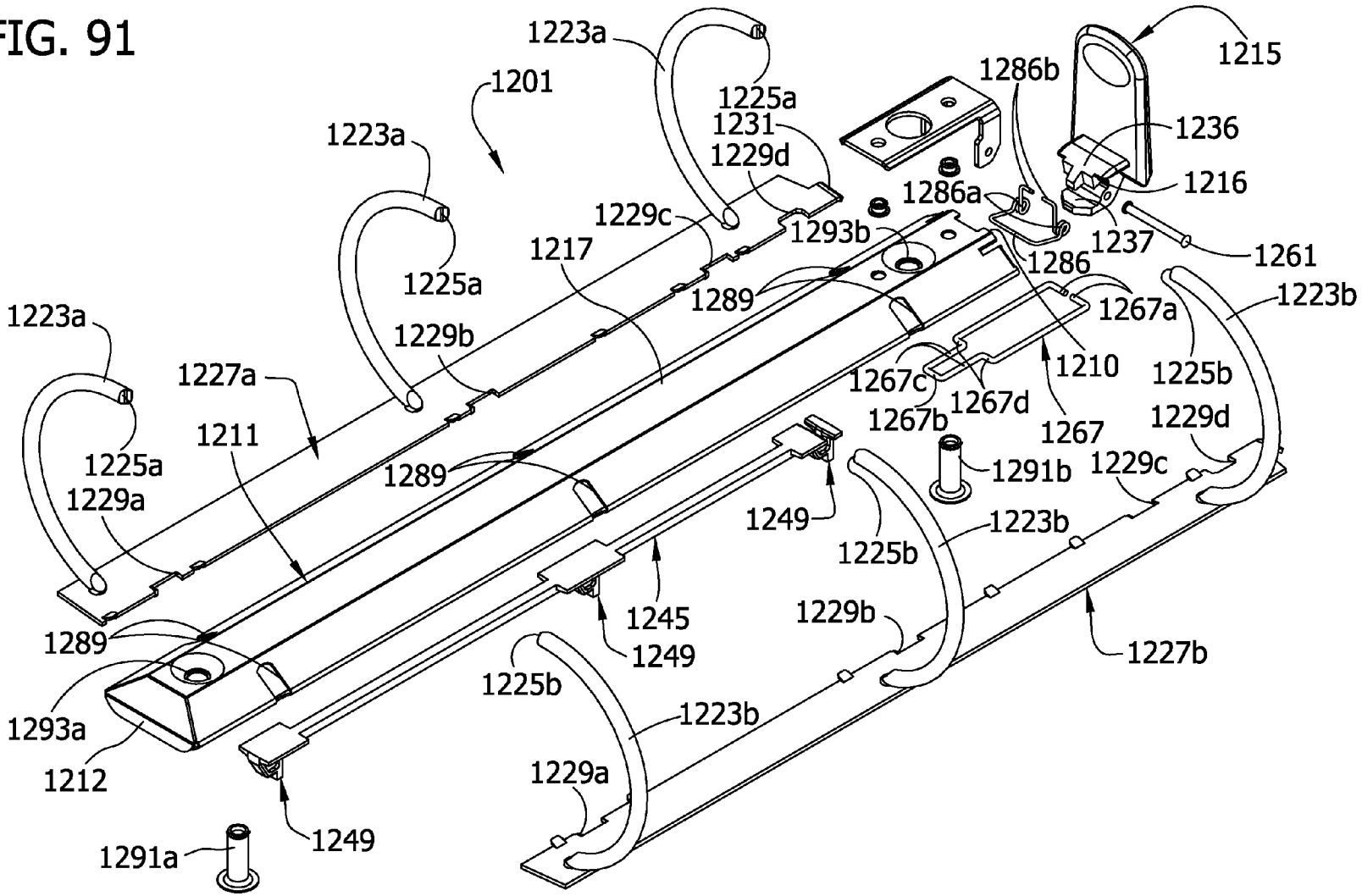
FIG. 91 is an exploded perspective of the ring binder mechanism having a thirteenth embodiment.

FIG. 91 illustrates a thirteenth embodiment of the ring binder mechanism 1201, which is substantially the same as the twelfth embodiment of FIGS. 85-90B. In this embodiment, however, a lever 1215 is shaped differently and is formed from a plastic material. The lever 1215 operates the mechanism 1201 to open and close ring members 1223*a*, 1223*b* in substantially the same manner as described above with respect to the lever 1115 of the previous ring binder mechanism 1101.

Components of ring binder mechanisms of the embodiments described and illustrated herein are made of a suitable rigid material, such as a metal (e.g. steel). But mechanisms having components made of a nonmetallic material, specifically including a plastic, do not depart from the scope of this invention.

When introducing elements of the ring binder mechanisms herein, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of "forward" and "rearward" and variations of these terms, or the use of other directional and orientation terms, is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose leaf pages, the mechanism comprising:

a housing;

a ring support supported by the housing for movement relative to the housing;

rings for holding the loose-leaf pages, each ring including a first ring member and a second ring member, the first ring member being mounted on the ring support for movement relative to the second ring member between a closed position and an opened position, in the closed position the two ring members form a substantially continuous, closed loop for allowing loose-leaf pages retained by the rings to be moved along the rings from one ring member to the other, and in the opened position the two ring members form a discontinuous, open loop for adding or removing loose-leaf pages from the rings;

an actuator mounted on the housing for movement relative to the housing for causing the pivoting motion of the ring support to move the ring members from the closed position to the opened position;

a travel bar comprising at least one locking element and being moveable between a locked position wherein the ring members are locked in the closed position and an unlocked position wherein the ring members are capable of being moved to the opened position, the travel bar including a mounting groove having at least one narrower section and a wider section spaced inward on the travel bar from the narrower section;

an intermediate connector operably connecting the travel bar to the actuator, the intermediate connector having a portion thereof captured by the wider section of the mounting groove in the travel bar, the portion of the intermediate connector being moveable within the wide section of the mounting groove so that the intermediate connector can move relative to the travel bar; and wherein the intermediate connector includes first and second ends, the second end including a neck and a head at the free end of the neck, the head being captured by the wide section of the mounting groove in the travel bar and the neck being received by the narrow section.

2. A ring binder mechanism as set forth in claim 1 wherein the head of the intermediate connector comprises a pair of bent wires having free ends, and the wide section of the mounting groove includes a pair elongate openings for receiving the free ends of the bent wires.

3. A ring binder mechanism as set forth in claim 1 wherein the intermediate connector comprises a wire having an enlarged head.

4. A ring binder mechanism as set forth in claim 3 wherein the intermediate connector further comprises a cup receiving the enlarged head of the wire.

5. A ring binder mechanism as set forth in claim 3 wherein the intermediate connector comprises a wire having a pair of spaced apart loops.

6. A ring binder mechanism as set forth in claim 1 wherein the ring support comprises a pair of hinge plates.

7. A ring binder mechanism as set forth in claim 1 further comprising a biasing member engaging the intermediate connector and at least one of the travel bar and actuator, the biasing member being positioned to bias the travel bar toward the locked position.

8. A ring binder mechanism as set forth in claim 7 wherein the biasing member engages the travel bar.

9. A ring binder mechanism as set forth in claim 7 wherein the biasing member comprises a coiled spring.

10. A ring binder mechanism as set forth in claim 9 wherein the coiled spring is received in the mounting groove.

11. A ring binder mechanism as set forth in claim 7 wherein the travel bar includes a free end, the biasing member being in direct contact with the free end of the travel bar.

12. A ring binder mechanism as set forth in claim 1 wherein the intermediate connector has a tab including the relatively narrower neck and the relatively wider head at the free end of the neck and the tab is received in the mounting groove of the travel bar.

13. A ring binder mechanism as set forth in claim 12 wherein the head of the tab is received in the wide section of the mounting groove and the neck of the tab is received in the narrow section of the mounting groove.

14. A ring binder mechanism as set forth in claim 13 wherein the tab allows the intermediate connector to pivot relative to the travel bar for accommodating vertical movements of the intermediate connector that occur when the is moved to move the ring support.

15. A ring binder mechanism as set forth in claim 14 wherein the wider section of the mounting groove in the travel bar has a length and the head of the tab has a length that is shorter than the length of the wider section of the mounting groove such that the head can move along the length of the wider section of the mounting groove.

16. A ring binder mechanism as set forth in claim 1 wherein the intermediate connector comprises a wire.

17. A ring binder as set forth in claim 1 wherein the intermediate connector comprises a wire having a pair of spaced apart loops.

18. A ring binder as set forth in claim 17 wherein the head of the intermediate connector captured by the wider section of the mounting groove in the travel bar comprises a first of the loops.

19. A ring binder as set forth in claim 18 wherein a second of the loops is disposed outside of the mounting groove in the travel bar.

* * * * *